US006491729B1

(12) United States Patent
Lee et al.

(10) Patent No.: US 6,491,729 B1
(45) Date of Patent: Dec. 10, 2002

(54) DRY-CLEANING SOLVENT COMPOSITION

(75) Inventors: Chin Yen Lee, 4Fl., No. 18, Alley 12, Lane 118, Sec. 3 Jen Ai Rd., Taipei (TW); Shen Kung Liao, Tai-Chung (TW)

(73) Assignee: Chin Yen Lee (TW)

( * ) Notice: Subject to any disclaimer, the term of this patent is extended or adjusted under 35 U.S.C. 154(b) by 0 days.

(21) Appl. No.: 09/493,524

(22) Filed: Jan. 28, 2000

(30) Foreign Application Priority Data

Feb. 2, 1999 (CN) ..... 99100508 A

(51) Int. Cl.[7] ..... D06L 1/02
(52) U.S. Cl. ..... 8/142; 510/285; 510/412
(58) Field of Search ..... 8/142, 564; 510/285, 510/412, 277, 281, 276; 134/40

(56) References Cited

U.S. PATENT DOCUMENTS 5,321,152 A * 6/1994 Chu et al.
5,426,214 A * 6/1995 Chu et al.
5,454,969 A * 10/1995 Fields et al.

OTHER PUBLICATIONS

"The Handbook of Solvents", Scheflan and Jacobs, D. Van Nostrand Company, Inc., New York, NY, 1953.*

* cited by examiner

*Primary Examiner*—Gregory E. Webb
(74) *Attorney, Agent, or Firm*—Ostrolenk, Faber, Gerb & Soffen, LLP

(57) ABSTRACT

A dry-cleaning solvent composition for dry-cleaning is disclosed, comprising a compound or solvent selected from the group consisting of propylene glycol methyl ether formate, propylene glycol methyl ether acetate, propylene glycol methyl ether propionate, propylene glycol methyl ether butyrate, propylene glycol ethyl ether formate, propylene glycol ethyl ether acetate, propylene glycol ethyl ether propionate, propylene glycol ethyl ether butyrate, ethylene glycol methyl ether formate, ethylene glycol methyl ether acetate, ethylene glycol methyl ether propionate. ethylene glycol methyl ether butyrate, and the mixture thereof. The dry-cleaning solvent composition may further comprise a compound or solvent selected from the group consisting of perchloroethylene, stoddard solvent type I, stoddard solvent type II, and the mixture thereof, in an amount of below 70 wt %. The dry-cleaning solvent composition has properties of low pollution and low toxicity and is a good dry-cleaning solvent for the textile such as clothes and fabrics. Further, the dry-cleaning solvent composition has small influence on physical properties and color fastness of the fabric so that the dry-cleaning solvent composition is adapted as a dry-cleaning solvent for replacing conventional dry-cleaning solvents, such as perchloroethylene, stoddard solvent type I and stoddard solvent type II.

4 Claims, 1 Drawing Sheet h=hue angle $\Delta h$=hue difference c=chroma $\Delta c$=chroma difference

DRY-CLEANING SOLVENT COMPOSITION

FIELD OF THE INVENTION

This invention relates to a dry-cleaning solvent and in particular to a dry-cleaning solvent composition having properties of low pollution and low toxicity and used as a dry-cleaning solvent for the textile such as fabrics and clothes.

BACKGROUND OF THE INVENTION

Organic solvents, such as perchloroethylene, trifluorotrichloroethane, trichloroethane etc., are conventionally used as a dry-cleaning solvent for dry-cleaning the textile, because hydrophilic fibers of the textile are not expanded and deformed when they are dry-cleaned with the organic solvents and the capability of the organic solvent in removing greasy dirts is significant.

Further, perchloroethylene has an excellent chemical stability which is also inflammable and inexpensive. Nevertheless, it is harmful if an excess quantity of perchloroethylene is inhaled, which may cause damage to liver, kidney, skin, sense organs, nerve systems etc. It is known that dry cleaners inhale an excess quantity of perchloroethylene may easily get liver cancer, kidney cancer, bladder cancer etc. For trifluorotrichloroethane and trichloroethane, they damage the ozone of the earth and cause greenhouse effect, so they are not going to be used after year 2000.

Even in Taiwan, stoddard solvents type I and type II which are petroleum solvents produced by the Chinese Petroleum Corporation can also be used as a dry-cleaning solvent for dry-cleaning the textile. Stoddard solvents type I and type II likely damage our living environment and hurt the health of dry cleaning workers, and they can corrode fibers of the textile during dry cleaning and have a characteristic of exploding with flame so that these petroleum solvents are dangerous in use and storage.

Thus, a dry cleaning solvent is required to overcome the above problems and completely replace the above-mentioned conventional organic solvents.

SUMMARY OF THE INVENTION

The object of the present invention is to provide a dry-cleaning solvent composition which has properties of low pollution and low toxicity and may slightly affect the color fastness of the fabric when the fabric are dry-cleaned with the dry-cleaning solvent composition. The composition is an environmentally friendly solvent thereof.

The present invention provides a dry-cleaning solvent composition comprising a compound or solvent selected from the group consisting of propylene glycol methyl ether formate (also known as propylene glycol mono methyl ether formate, PMP), propylene glycol methyl ether acetate (also known as propylene glycol mono methyl ether acetate), propylene glycol methyl ether propionate (also known as propylene glycol mono methyl ether propionate), propylene glycol methyl ether butyrate (also known as propylene glycol mono methyl ether butyrate), propylene glycol ethyl ether formate (also known as propylene glycol mono ethyl ether formate), propylene glycol ethyl ether acetate (also known as propylene glycol mono ethyl ether acetate), propylene glycol ethyl ether propionate (also known as propylene glycol mono ethyl ether propionate), propylene glycol ethyl ether butyrate (also known as propylene glycol mono ethyl ether butyrate), ethylene glycol methyl ether formate (ethylene glycol mono methyl ether formate), ethylene glycol methyl ether acetate (ethylene glycol mono methyl ether acetate), ethylene glycol methyl ether priopionate (ethylene glycol mono methyl ether propionate), ethylene glycol methyl ether butyrate (ethylene glycol mono methyl ether butyrate), and the mixture thereof. The dry-cleaning solvent may further comprise below 70 wt % of a compound or solvent selected from the group consisting of perchloroethylene, stoddard solvent type I, stoddard solvent type II, and the mixture thereof.

DETAILED DESCRIPTION OF PREFERRED EMBODIMENTS

Figure 1:
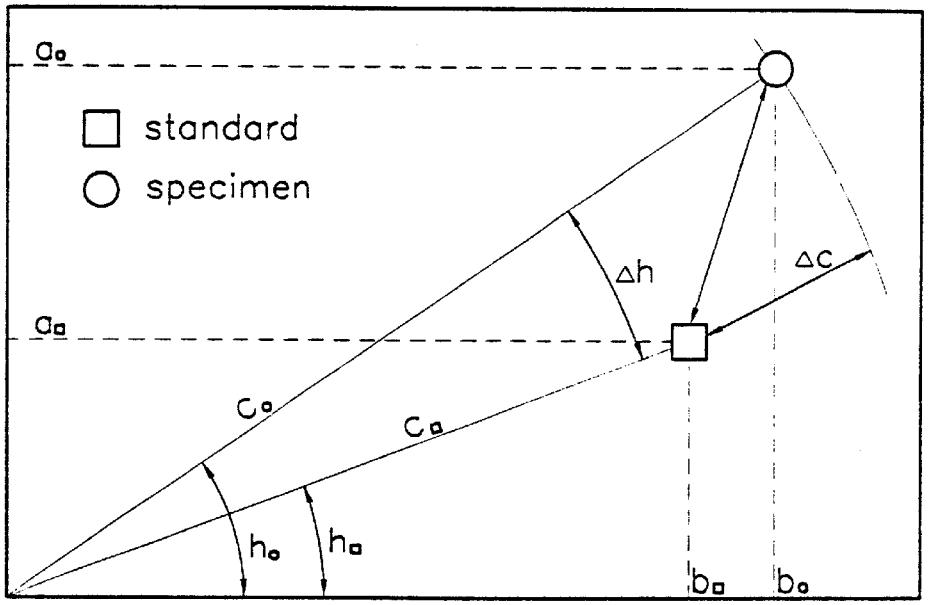
FIG. 1(PRIOR ART)
FIG. 1 is a conventional axial diagram showing the hue difference and the chroma difference.

The present invention will be better understood from the following Examples 1 to 12, wherein Examples 1 to 9 describe the differences between propylene glycol methyl ether propionate used as a dry-cleaning solvent in accordance with the present invention and the conventional dry-cleaning solvents, such as perchloroethylene, stoddard solvents type I and type II in term of degree of dry-cleaning fabrics, and Examples 10 to 12 describe the differences between different dry-cleaning solvent compositions in accordance with the present invention in term of degree of dry-cleaning fabrics.

Propylene glycol methyl ether propionate used in Examples 1 to 9 is obtained by means of reaction (1) and reaction (2) shown in the following:

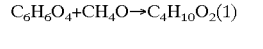

$$C_6H_6O_4+CH_4O \rightarrow C_4H_{10}O_2 \quad (1)$$

propylene oxide methanol propylene glycol methyl ether

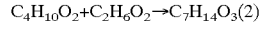

$$C_4H_{10}O_2+C_2H_6O_2 \rightarrow C_7H_{14}O_3 \quad (2)$$

propionic acid propylene glycol methyl ether propionate wherein reaction (2) has been disclosed in U.S. Pat. No. 5,239,111 by Chu et al.

Methotate is used as a trademark or commercial name to identify the commercial propylene glycol methyl ether propionate manufactured by Shiny Chemical Industry Co., Ltd., Taiwan. The specifications of Methotate are shown in the following:

appearance: transparent liquid hue: 10 Pt-Co Test Max.

specific gravity (20/20° C.): 0.945–0.955 acidity: 0.1% of acetic acid by weight purity: 99.5% of propylene glycol methyl ether propionate by weight water content: 0.1% of water by weight non-vaporizing component: 0.02 g/100 ml distillation range (from original state to dry state): 157 to 167° C.

Further, the physical properties of the commercial propylene glycol methyl ether propionate, Methotate, are shown in the following:

molecular formula:

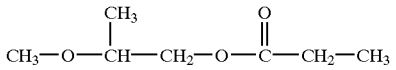

molecular weight: 146.0 specific gravity(20° C.,1 atm): 0.95 boiling point(1 atm): 160.0° C.

solidifying point: below −50.0° C.

flash point: 56.0° C.

flame point: 360.0° C.

viscosity (20° C.): 1.2 cps evaporating rate (NBAC=100): 19 vapor pressure (20° C.): 0.9 mmHg solubility: 20 ml degree of dry cleaning: 9 drying time: 27 min

"NBAC=100" refers the evaporating rate of normal butyl acetate (NBAC) is taken as 100, so that of Methotate is 19. The solubility is measured in the condition "weight of paint (amino resin): weight of solvent (Methotate sample+toluene)=2:1" using hexane to titrate the solution. The degree of cleaning is measured in the following: immerse a plate in amino resin paint, take it out in air for one minute for drying, and immerse it in Methotate thinner for 30 seconds, take it out in air for 30 seconds for drying, this is one process cycle, then immerse the plate in Methotate thinner for 30 seconds again, repeat the process until the painted film is lost; the unit of degree of cleaning is the number of the cycle, the smaller the number is, the larger degree of cleaning is. The drying time is measured in the following: weight of paint (amino resin): weight of Methotate thinner=2:1, coat the paint on a plate, and use fingers to sense the coated film to identify when the file becomes dried so as to measure the drying time.

Further, propylene glycol methyl ether propionate is not toxic according to a toxicity test carried out by Taiwan Testing Center for Agriculture Pesticide, the testing results for Methotate are shown as follows:

acute oral toxicity (mouse)>12000 mg/Kg acute skin toxicity (mouse)>12000 mg/Kg acute inhaling toxicity (mouse)>6072 mg/Kg deformed fetus (mouse): index=0 acute toxicity (water flea)>100 mg/Kg acute toxicity (carp): 60 to 100 mg/Kg original skin irritation (rabbit): index=0 original eye irritation (rabbit): index=0 biodegradable test (28 days):

| | |
|---|---|
| Biochemical Oxygen Demand(B O D) | 94% |
| Total Organic Carbon(T O C) | 97% |
| Gas Chromatography(G C) | 100% |

Therefore, propylene glycol methyl ether propionate is not toxic.

The properties of propylene glycol methyl ether propionate, Methotate, and those of the conventional dry cleaning solvents, such as perchloroethylene, stoddard solvent type I and stoddard solvent type II are shown in Table 1. As shown in Table 1, propylene glycol methyl ether propionate contains no fluorine and chlorine elements and is not a toxic organic solvent. Further, it is not dangerous in use and storage. The propylene glycol methyl ether propionate used in Examples 1 to 12 of the invention refers "Methotate" unless otherwise specified. The present invention discloses different experiments, the following Examples 1 to 9, for illustrating the differences between propylene glycol methyl ether propionate and the three conventional dry-cleaning solvents, perchloroethylene, stoddard solvents type I and type II in term of degree of dry-cleaning and proving that propylene glycol methyl ether propionate is superior to the conventional dry-cleaning solvents in term of degree of dry cleaning so that propylene glycol methyl ether propionate is adapted to be used as a dry-cleaning solvent.

The dry-cleaning solvents, the textile such as dyed fabrics, undyed fabrics and undyed yarns, the tests of dry-cleaning and the tests of degree of dry-cleaning fabrics demonstrated Examples 1 to 9 are described in the following.

The dry-cleaning solvents used in Examples 1 to 9 are respectively perchloroethylene, stoddard solvents type I and type II in addition to propylene glycol methyl ether propionate.

The dyed fabrics used in Examples 1 to 9 are taken randomly from markets and are nine different kinds of dyed fabrics including four pure fabrics and five blend fabrics, the ingredients thereof are respectively 100% polyester, 100% cotton, 100% wool, 100% nylon, 55% polyester and 45% cotton (hereinafter called "polyester/cotton"), 45% wool and 55% polyacrylonitrile (hereinafter called "wool/polyacrylonitrile"), 45% wool and 55% polyester (hereinafter called "wool/polyester"), 65% polyester and 35% rayon (hereinafter called "polyester/rayon"), and 50% nylon and 50% polyacrylonitrile (hereinafter called "nylon/polyacrylonitrile").

The undyed fabrics used in Examples 1 to 9 are five different kinds of gray goods, the ingredients thereof are respectively 100% nylon, 100% polyester, 100% silk, 100% cotton, and 100% wool.

The undyed yarns used in Examples 1 to 9 are five different kinds of gray goods, the ingredients thereof are respectively 100% nylon 6, 100% polyester, 100% flax, 100% cotton, and 100% wool.

The dry-cleaning tests of Examples 1 to 9 are carried out under the conditions according to CNS (Chinese National Standards)- 8429 measuring color fastness and CNS-8431 measuring color fastness to organic solvent. All the fabric sample are respectively dry-cleaned with the dry cleaning solvents under following conditions: liquid ratio is 1:40 and temperature is 25±2° C. Then, the sample is placed into a flask. After shaking the flask for about 30 minutes, the sample is dried under the temperature of 60±2° C.

All the dyed fabrics, the undyed fabrics, and the undyed yarns, and are respectively dry-cleaned with the four dry-cleaning solvents according to the above conditions and repeated one time, two and five times, but for propylene glycol methyl ether propionate, the dry-cleaning process are repeated one time, two, five, ten and twenty times. Then, the dry-cleaned sample is tested for the physical property and color fastness. The tests of physical property include a test of bursting strength, a test of softness, a test of degree of shrinkage and a test of tensile strength, and the results thereof are observed and pictured by means of a microscope (enlarging 50 times) and a scanning electron microscope (SEM) (enlarging 1500 times). The tests of color fastness include a test of color fastness to xenon light, a test of color fastness to abrasion and a test of color fastness to dry-cleaning solvent. These are all carried out according to CNS regulations.

In the tests of the degree of cleaning fabrics in Examples 1 to 9, four kinds of standard soil test cloths are taken, the types of the cloth are respectively polyester, cotton, wool, polyester/cotton. The conditions of the tests of degree of cleaning fabrics are similar to those of the above dry-cleaning tests. After the soil test cloths have been dry cleaned, the reflectance, the whiteness index and the yellowness index thereof are measured by means of a color matching system to identify the degree of cleaning fabrics of the dry-cleaning solvents.

With reference to following Examples 1 to 12, they further describe features of the present invention. They are only for the purpose of illustration and by no means of any limitation therefor.

EXAMPLE 1

Observing the Surface of Fabrics After Fabrics are Dry-cleaned with Dry-cleaning Solvents A. By Means of a Microscope After the above nine dyed fabrics are respectively dry-cleaned five times with the above four dry-cleaning solvents, except that the dry-cleaning operation is carried out five and ten times with propylene glycol methyl ether propionate. The surface of the dyed fabrics are observed by means of a microscope for disclosing the effect of dry-cleaning solvents on the structures of the dyed fabrics. As a result, the structure of the surfaces of the dyed fabrics after dry cleaned are related to the times of dry-cleaning. That is, the more times of dry-cleaning, the more relaxed the surface structure of the dyed fabrics. The degree of relaxation is also related to the twist of yarn and the thread count of the fabric. For the dyed fabrics, since the thread counts of the dyed fabrics of nylon and wool are greater, the changes in the surface structure thereof are smaller. On the contrary, the thread counts of the dyed fabrics of cotton and polyester/cotton are smaller, so the change in the surface structure thereof are greater.

B. By Means of a Scanning Electron Microscope

As mentioned previously, using a microscope to observe the surfaces of the dyed fabrics is a macroscopic investigation. However using a scanning electron microscope, which enlarges the sample 1500 times for observation of the surfaces of the dyed fabrics, is a microscopic investigation. The change of the surface structure of the dyed fabrics after dry-cleaned can be clearly observed by means of a scanning electron microscope. The results are shown in Table 2.

Table 2 shows that among the four solvents propylene glycol methyl either propionate has smallest influence to fibers of the dyed fabrics except the dyed fabric of wool.

EXAMPLE 2

Testing Effects of Dry-drying Cleaning Solvents on Degree of Cleaning Fabrics After the soil test cloths of polyester/cotton, wool, cotton and polyester are respectively dry-cleaned with the dry-cleaning solvents, the degrees of cleaning the soil test cloths of the dry-cleaning solvents is measured. The dry-cleaning procedure is carried out under the conditions that temperature is 25±2° C., liquid ratio is 1:40 and dry cleaning time is 30 minutes in a shaking manner and then the soil test cloths which have been dry-cleaned are dried under the temperature of 60±2° C.

Color differences can be analyzed according to Munsell Color Solid Theory and a bright and a chroma of a hue can be decided by means of a solid rectangular coordinate.

According to an opponent-color coordinate recommended by the CIE (Commission International de I'Eclairage) Society in 1976, wherein a redness-greenness coordinate is set to be the "a" coordinate with redness as a positive value and greenness as a negative together with a yellowness-blueness coordinate forms the "b" coordinate wherein yellowness indicates a positive value and blueness indicates a negative value, the two sets of coordinates form a two dimensional coordinate further with a third coordinate which indicates the bright to form the opponent-color coordinate designed by the CIE Lab, a bright value "L" in the third coordinate, a chroma value "a" in the redness-greenness coordinate and a chroma value "b" in the yellowness-blueness coordinate are related to red, blue, green tristimulus values as shown in the following:

$$L=116\times(Y/Yn)^{1/3}-16$$

$$a=500\times[(X/Xn)^{1/3}-(Y/Yn)^{1/3}]$$

$$b=200\times[(Y/Yn)^{1/3}-(Z/Zn)^{1/3}]$$

where Xn, Yn, Zn are the tristimulus values of a particular standard illuminate.

The values under $D_{65}$ light source are respectively:

Xn=94.83

Yn=100.00

Zn=107.38 wherein the X, Y and Z are respectively the tristimulus values of the sample under illuminate $D_{65}$. The $D_{65}$ represents a standard light source corresponding to the spectral energy distribution of the simulated average sunlight.

According to the above equations, a chroma value "c" and a hue value "h" are defined by the CIE Society:

$$h=\tan^{-1}(b/a)$$

$$c=(a_2+b^2)^{1/2}$$

Now define color difference ΔE:

$$\Delta E=((\Delta L)^2+(\Delta a)^2+(\Delta b)^2)^{1/2}$$

with reference to FIG. 1, it shows a relationship between these values of chroma, hue angle, chroma difference and hue angle difference. In FIG. 1, Δc indicates the chroma difference between a chroma value of a specimen sample and a chroma value of a standard sample, and Δh indicates the hue angle difference. By means of the analysis of chroma difference and hue angle difference, the two values Δc and Δh, can be easily obtained.

Tables 3 to 6 show that after the soil test cloth of polyester/cotton is dry-cleaned one time with propylene glycol methyl ether propionate, the bright difference ΔL of the soil test cloth of polyester/cotton increases 4, and after that is dry-cleaned five times, the bright difference increases 4.53, so propylene glycol methyl ether propionate is superior to other three dry cleaning solvents.

For the soil test cloth of wool, all the dry cleaning solvents including propylene glycol methyl ether propionate make bright difference negative, when using propylene glycol methyl ether propionate to dry-clean it two times is better than using the other three dry cleaning solvents.

As per the soil test cloth of polyester, using stoddard solvent type I, stoddard solvent type II, or perchloroethylene to dry-clean it is better than using propylene glycol methyl ether propionate, because after it is dry-cleaned with stoddard solvent type I, stoddard solvent type II, or perchloroethylene, the bright difference is larger than 6.

As per soil test cloth of cotton, using stoddard solvent type I or perchloroethylene to dry clean it is better than using the other two dry-cleaning solvents.

Further, after any of the four soil test cloth is respectively dry-cleaned with the four dry cleaning solvents, the whiteness indexes and the yellowness index thereof are shown in Table 7.

As per soil test cloth of polyester, the whiteness index thereof increases about 7.5 after it is dry-cleaned one time with propylene glycol methyl ether propionate and the whiteness index increases about 13 after it is dry-cleaned more than one time with propylene glycol methyl ether propionate. Further, the whiteness index thereof increases about 11 after it is respectively dry cleaned one time with any one of the other three dry-cleaning solvents, but the increase in whiteness index is not related to the higher number of times of dry cleaning.

As per the soil test cloth of cotton, the whiteness index thereof increases 8 to 10 after it is dry cleaned with any one of the four dry-cleaning solvents.

As per the soil test cloth of polyester/cotton, the whiteness index thereof increases 8 after it is dry-cleaned with propylene glycol methyl ether propionate, and increases about 5 to 7 after it is dry cleaned with any one of the other three dry cleaning solvents.

As per the soil test cloth of wool, the whiteness index thereof increases about 2 after it is dry-cleaned more than one time with propylene glycol methyl ether propionate, and increases about 1 after it is dry-cleaned with stoddard solvent type I or stoddard solvent type II, but the whiteness and yellowness indexes thereof does not change appreciably after it is dry-cleaned with perchloroethylene.

EXAMPLE 3

Testing Effects of Dry-cleaning Solvents on Degree of Shrinking Fabrics

The test in Example 3 is to measure thread counts of the above nine dyed fabrics after the dyed fabrics are respectively dry-cleaned with the above four dry-cleaning solvents. Then, the degree of shrinking the dyed fabrics of the dry-cleaning solvents are obtained by means of the following equation, and the test results are shown in Tables 8 to 16.

The degree of shrinkage =(fabric scale before dry-cleaned−fabric scale after dry-cleaned)÷fabric scale before dry-cleaned×100[{]ps According to Tables 8 to 16, it is apparent that:

1. As per the dyed fabric of polyester, the degrees of shrinkage thereof in the warp sense and the weft sense are respectively about 0.1% and 1.6% after it is dry-cleaned with stoddard solvent type I.

2. As per the dyed fabric of wool/polyacrylonitrile. The degrees of shrinkage thereof in the warp sense and the weft sense are respectively about 0.5% and 0.8% after it is respectively dry-cleaned with propylene glycol methyl ether propionate and stoddard solvent type I, and the degree of shrinkage thereof in the weft sense is 7.5% after it is dry-cleaned five times with stoddard solvent type I.

3. As per the dyed fabric of cotton, the degrees of shrinkage thereof in the warp sense and the weft sense are respectively about 0.5% and 1.7% after it is dry-cleaned with propylene glycol methyl ether propionate, respectively about 1.4% and 0.8%–3.3% after it is dry-cleaned with stoddard solvent type I, and respectively about 1% and 2% after it is dry-cleaned with perchloroethylene.

4. As per the dyed fabric of polyester/cotton, the degrees of shrinkage thereof in the warp sense and the weft sense are respectively about 0.47% and 1.66% after it is dry-cleaned above five times with propylene glycol methyl ether propionate, and respectively about 0.94% and 3.3% after it is dry-cleaned more than one time with stoddard solvent type I.

5. As per the dyed fabric of polyester/rayon, the degrees of shrinkage thereof in the warp sense and the weft sense are respectively about 0.46%~0.92% and 1.66% after it is dry-cleaned with propylene glycol methyl ether propionate, and respectively about 1.8% and 4.9% after it is dry-cleaned by stoddard solvent type I.

6. As per the dyed fabric of nylon/polyacrylonitrile, the degrees of shrinkage thereof in the warp sense and the weft sense are respectively about 2% and 9% after it is dry-cleaned with propylene glycol methyl ether propionate, respectively about 3% and 4%–5% after it is dry-cleaned with stoddard solvent type I, and respectively about 2% and 1.4% after it is dry-cleaned with stoddard solvent type II.

7. As per the dyed fabric of wool/polyester, the degrees of shrinkage thereof in the warp sense and the weft sense are both about 4.8%–8% after it is dry-cleaned one time to five times with propylene glycol methyl ether propionate, and respectively about 0.7% and 3% after it is dry-cleaned with stoddard solvent type I.

8. As per the dyed fabric of wool, the degrees of shrinkage thereof in the warp sense and the weft sense are respectively about 1%~3% and 1.5% after it is dry-cleaned with stoddard solvent type I and are both about 2% after it is dry-cleaned with perchloroethylene.

9. As per the dyed fabric of nylon, the degree of shrinkage thereof in the warp sense is about 1.72% after it is dry cleaned more than one time with propylene glycol methyl ether propionate. Further, the degrees of shrinkage thereof in the warp sense and the weft sense are respectively about 2% and 5% after it is dry-cleaned with stoddard solvent type I, and the degree of shrinkage thereof in the warp sense is about 1% after it is dry-cleaned with perchloroethylene.

EXAMPLE 4

Testing Effects of Dry-cleaning Solvents on the Tensile Strength of Fabrics

The fabric used includes the dyed fabric and the undyed fabric and the test is carried out by means of a testmetric-universal tensile tester and the results corresponding the maximum load point of the sample are shown in Tables 17 to 30, the load weight and displacement are obtained before the sample cracks and the stress, the strain and the specific stress are calculated according to the following equations.

stress=load weight/cross section area of fabric strain=(fabric length after elongation−fabric length before elongation)÷fabric length before elongation×100% specific stress=load weight/mass of unit fabric length

Table 17 shows that the load weight decreases from 26 Kg to 21–22 Kg and the strain increases 1%–2% after the dyed fabric of wool/polyester is dry-cleaned one time or two times with propylene glycol methyl ether propionate. However, the strain of the dyed fabric of wool/polyester after dry-cleaned with any other dry-cleaning solvent is higher than that after dry-cleaned with propylene glycol methyl ether propionate. That is, the dyed fabric of wool/polyester may be easily deformed after it is dry-cleaned with stoddard solvent type I, stoddard solvent type II , or perchloroethylene.

Table 18 shows that the load weight increases 3–5 Kg after the dyed fabric of polyester is dry-cleaned with propylene glycol methyl ether propionate or stoddard solvent type I. Further, the displacement of that dry-cleaned with the former increase 10–15 mm, the displacement of that dry-cleaned with the latter does not increase.

Further, the strain of the dyed fabric of polyester after dry-cleaned with propylene glycol methyl ether propionate is higher (increases by about 10%) than that after dry-cleaned with any other dry-cleaning solvent.

Table 19 shows that the load weight increases about 3 kg after the dyed fabric of cotton is dry-cleaned with propylene glycol methyl ether propionate or perchloroethylene. However, the strain decreases from 3% to 10% after the dyed fabric of cotton is dry-cleaned with any one of the four dry-cleaning solvents.

Table 20 shows that the load weight decreases 6–7 Kg and the strain increases about one time after the dyed fabric of wool is dry-cleaned with propylene glycol methyl ether propionate, similar results apply after it is dry-cleaned with perchoroethylene. As shown in Table 20, stoddard solvent type I and stoddard solvent type II influence slightly the load weight of the dyed fabric of wool, but appreciably the strain of the dyed fabric of wool.

Table 21 shows that the load weight increases 6 Kg after the dyed fabric of wool/polyacrylonitrile is dry-cleaned with propylene glycol methyl ether propionate, stoddard solvent type I, or stoddard solvent type II. The strain increases 4%–5% after the dyed fabric of wool/polyacrylonitrile is dry-cleaned with stoddard solvent type I or perchloroethylene, and increases 75%–14% after it is dry-cleaned with propylene glycol methyl ether propionate or stoddard solvent type II, but the load weight and the strain of the dyed fabric wool/polyacronitrile decreases with the increase of the times of dry-cleaning.

Table 22 shows that all dry-cleaning solvents influence slightly the dyed fabric of nylon/polyacrylonitrile, but the load weight increases about 4 Kg only after it is dry-cleaned with stoddard solvent type II.

Table 23 shows that the load weight increases about 3–5 Kg after the dyed fabric of nylon is dry-cleaned with any of the four dry-cleaning solvents and the strain varies slightly. Some results show that the load weight of the dyed fabric of nylon reaches 40–60 Kg should be instrument error.

Table 24 shows that the load weight increases 3–8 Kg after the dyed fabric of polyester/rayon is dry-cleaned with propylene glycol methyl ether propionate or perchloroethylene, and stoddard solvents type I and type II are effective slightly to the load weight of the dyed fabric of polyester/rayon. Further, the strain varies slightly except the dyed fabric of polyester/rayon is dry-cleaned more than one time with the stoddard solvent type II which can make the strain thereof decrease more than 8%.

Table 25 shows that the load weight increases 3–4 Kg after the dyed fabric of polyester/cotton is dry-cleaned with any one of the four dry-cleaning solvents. Further, the strain increases 5%–7% after the dyed fabric of polyester/cotton is dry-cleaned with propylene glycol methyl ether propionate or stoddard solvent type I. However, the results obtained for the case dry-cleaned with stoddard solvent type II should be instrument error.

The test is also carried out for the undyed fabrics of gray cotton goods, gray nylon goods, gray polyester goods, gray silk goods, and gray wool goods which are dry-cleaned with the four dry-cleaning solvents, the results are shown in Tables 26–30. Table 26 shows that the load weight decreases 9–12 Kg, about 20%–25%, and the strain increases 15–2% after the undyed fabric of cotton gray foods is dry-cleaned more than one time with any one of the four dry-cleaning solvents.

In Table 27, it shows that the load weight increases 7–11 Kg after the undyed fabric of nylon gray goods is dry-cleaned with any one of the four dry cleaning solvents, but the load weight decreases 4–6 Kg after the nylon is dry-clean ed again with any one of the four dry cleaning solvents except propylene glycol methyl ether propionate. Further, the strain increases 8%–10% after the undyed fabric of nylon gray goods is dry-cleaned with any one of the four dry-cleaning solvents.

Table 28 shows that the load weight decreases 20–30 Kg, about 40%–50%, and the strain increases 8%–10% after the undyed fabric of gray polyester goods is dry-cleaned with any one of the four dry-cleaning solvents.

Table 29 shows that the load weight decreases 1–4 Kg and the strain increases 2%–5% after the undyed fabric of gray silk goods is dry-cleaned with any one of the four dry-cleaning solvents, wherein the load weight decreases about 30% after the undyed fabric of gray silk goods is dry-cleaned with perchloroethylene. Therefore, perchloroethylene has the largest influence on the load weight.

Table 30 shows that the load weights decrease about 8 Kg and 16 Kg after the undyed fabric of gray wool goods is respectively dry-cleaned more than five times with propylene glycol methyl ether propionate and perchloroethylene, Further, the strain decreases more than 3% after the undyed fabric of gray wool goods is dry-cleaned with any of the dry cleaning solvents except propylene glycol methyl ether propionate.

EXAMPLE 5

Testing the Bursting Strength and the Softness of Fabrics

Fabrics used in Example 5 include the above dyed fabrics and the undyed fabrics and the results of the test are shown in Tables 31 to 44.

Table 31 shows that the bursting strength increases above 3% after the dyed fabric of wool/polyester is dry-cleaned with any one of the dry-cleaning solvents except perchloroethylene. Further, the softness decreases above 11% after the dyed fabric of wool/polyester is dry-cleaned with stoddard solvent type I, and decreases 4%–8% after dry-cleaned with any one of the other dry-cleaning solvent.

Table 32 shows that the bursting strength decreases 2%–5% after the dyed fabric of wool is dry-cleaned with perchloroethylene, increases about 11% after the dyed fabric of wool is dry-cleaned with any one of the other dry-cleaning solvents. Further, the softness decreases 20%–30% after the dyed fabric of wool is dry-cleaned with the dry-cleaning solvents except stoddard solvent type II.

Table 33 shows that the bursting strength decreases about 1.92% after the dyed fabric of polyester is dry-cleaned with stoddard solvent type I more than one time, decreases 1.92%–3.85% after the dyed fabric of polyester is dry-cleaned with any one of the other dry-cleaning solvents. Further, the softness increases above 14% after the dyed fabric of polyester is dry-cleaned with stoddard solvent type II, but decreases about 20% after the dyed fabric of polyester is dry-cleaned with any one of the other dry-cleaning solvents.

Table 34 shows that the bursting strength increases about 4.55% after the dyed fabric of wool/polyacrylonitrile is dry-cleaned with propylene glycol methyl ether propionate. Further, after the dyed fabric of wool/polyacrylonitrile is dry-cleaned ten times with propylene glycol methyl ether propionate, the bursting strength increases about 13%, and this is similar to those after dry-cleaned with stoddard solvent type I or stoddard solvent type II. Also, the bursting strength increases 6%–11% after the dyed fabric of wool/polyacrylonitrile is dry-cleaned with perchloroethylene. Further, the softness decreases about 3.7% after the dyed fabric of wool/polyacrylonitrile is dry-cleaned one time with propylene glycol methyl ether propionate, and increases about 7.41% after the dyed fabric of wool/polyacrylonitrile is dry-cleaned more than one time with propylene glycol methyl ether propionate. Also, the softness increases about 11.11% after the dyed fabric of wool/polyacrylnitrile is dry-cleaned one time with perchloroethylene, but varies slightly after the dyed fabric of wool/polyacrylnitrile is dry-cleaned more than one time with perchloroethylene. Stoddard solvent type I has small influence on the softness of the dyed fabric of wool/polyacrylonitrile, while stoddard solvent type II can decrease the softness of that by 5%–1%.

Table 35 shows that the bursting strength increases about 7% after the dyed fabric of polyester/rayon is dry-cleaned with any one of the four dry-cleaning solvents except perchloroethylene, and decreases about 2% after the dyed fabric of polyester/rayon is dry-cleaned one time with perchloroethlene and increases about 4.81% after the dyed fabric of polyester/rayon is dry-cleaned two times with perchloroethylene. Further, the softness decreases about 12.5% after the dyed fabric of polyester/rayon is dry-cleaned with stoddard solvent type I, and decreases 1%–4% after the dyed fabric of polyester/rayon is dry-cleaned with any one of the other dry-cleaning solvents.

Table 36 shows that the bursting strength increases about 32% after the dyed fabric of nylon/polyacrylonitrile is dry-cleaned with propylene glycol methyl ether propionate, but decreases with times of dry-cleaning. Also, the bursting strength increases about 10% after the dyed fabric of nylon/polyacrylonitrile is dry-cleaned with any one of the other dry-cleaning solvents. Further, the softness decreases about 5% or increases about 15% or 10% after the dyed fabric of nylon/polyacrylonitrile is dry-cleaned one time with stoddard solvent type I, stoddard solvent type II, or perchloroethylene, and varies slightly with the increase of times of dry-cleaning.

Table 37 shows that the bursting strength decreases about 14.57% after the dyed fabric of cotton is dry-cleaned one time and two times with propylene glycol methyl ether propionate, and this is similar to those after the dyed fabric of cotton is dry-cleaned two times with stoddard solvent type I or five times with perchloroethylene. Also, the bursting strength decreases 5–10% after the dyed fabric of cotton is dry-cleaned with stoddard solvent type II. Further, the softness increases above 50% after the dyed fabric of cotton is dry-cleaned with any dry-cleaning solvent, and in particular with stoddard solvent type II.

Table 38 shows that the bursting strength decreases about 4% after the dyed fabric of polyester/cotton is dry-cleaned with propylene glycol methyl ether propionate, stoddard solvent type I or type II, and the result applies to the one after the dyed fabric of polyester/cotton is dry-cleaned five times with perchloroethylene. Further, the softness increases above 30% after the dyed fabric of polyester/cotton is dry-cleaned with stoddard solvent type II, and increases or decreases below 10% after the dyed fabric of polyester/cotton is dry-cleaned with any one of the other dry-cleaning solvents.

Table 39 shows that the bursting strength decreases 8%–11%, 5%, 5%, 3% after the dyed fabric of nylon is respectively dry-cleaned with propylene glycol methyl ether propionate, stoddard solvent type I, stoddard solvent type II, and perchloroethylene. Further, the softness varies smallest after the dyed fabric of nylon is dry-cleaned with propylene glycol methyl ether propionate. Stoddard solvent type I or stoddard solvent type II can increase the softness of the fabric by 20%, and perchloroethylene can decrease it by 16%–34%.

Table 40 shows that the bursting strength varies smallest after the undyed fabric of gray polyester goods is dry-cleaned with perchloroethylene as compared to the other dry-cleaning solvent. Further, the softness decreases above 10% after the undyed fabric of gray polyester goods is dry-cleaned with any one of the four dry-cleaning solvents more than one time.

Table 41 shows that the bursting strength decreases about 6% after the undyed fabric of gray nylon goods is dry-cleaned with propylene glycol methyl ether propionate, stoddard solvent type I, or stoddard solvent type II, and decreases about 4.8% after the undyed fabric of gray nylon goods is dry-cleaned more than one time with perchloroethylene. Further, the softness decreases above 30% after the undyed fabric of gray nylon goods is dry-cleaned with propylene glycol methyl ether propionate, and decreases 25% after dry-cleaned with stoddard solvent type I, and decreases above 20% after dry-cleaned more than one time with stoddard solvent type II or perchloroethylene.

Table 42 shows that the bursting strength decreases about 7%, 5.5%, and 3.7% after the undyed fabric of gray cotton goods is dry-cleaned one time, two times, and five times respectively with propylene glycol methyl ether propionate, and decreases 5%–7% after dry-cleaned with any one of the other dry-cleaning solvents. Further, the softness increases about 22% after the undyed fabric of gray cotton goods is dry-cleaned with stoddard solvent type I, and decreases after dry-cleaned with any one of the other dry-cleaning solvents.

Table 43 shows that the bursting strength decreases about 20% after the undyed fabric of gray silk goods is dry-cleaned with any one of the four dry-cleaning solvents. Further, the softness decreases 10%–20% after the undyed fabric of gray silk goods is dry-cleaned with any one of the four dry-cleaning solvents.

Table 44 shows that the bursting strength decreases about 3% after the undyed fabric of gray wool goods is dry-cleaned with any one of the four dry-cleaning solvents. Further, the softness increases and decreases about 7% after the undyed fabric of gray wool goods is dry-cleaned with propylene glycol methyl ether propionate and stoddard solvent type II respectively and decreases about 2.6% after dry-cleaned with stoddard solvent type I, and increases 2.6%–5% after dry-cleaned with perchloroethylene.

EXAMPLE 6

Testing the Color Fastness to Light of Fabrics

The fabric used in Example 6 include the above 9 dyed fabrics and the tests of color fastness of fabrics are carried out after the fabric are respectively dry-cleaned with the above four dry-cleaning solvents, wherein the tests of color fastness include a test of color fastness to light (Example 6), a test of color fastness to dry-cleaning (Example 7) and a test of color fastness to abrasion (Example 8).

In Example 6, the fabric are placed in a light fastness tester after dry-cleaned under the Xenon arc-light for 260 hours, the color changes are compared with a blue wool light fastness and the results are shown in Table 45. As per the grade in connection with the color fastness to light, sixth grade is superior to fifth grade, etc.

The test of color fastness to light is conducted according to CNS (Chinese National Standard)-8429 testing color fastness and CNS (Chinese National Standard)-3846 testing color fastness to Xenon arc-light. The standard blue fabric is produced by means of scouring and bleaching the pousseline fabric which is weaved of worsted yarn(wool), the thread counts thereof are respectively 114±2 and 96±2 ropes/5 cm in warp sense and weft sense, and then being dyed by the dyes in Table 46 according to CNS (Chinese National Standard)-1493 testing color fastness to light.

In Table 46 the color fastness to light of the first grade standard color blue fabric is the lowest. That is, the color fastness to light of the eighth grade standard color blue fabric is the highest.

Table 45 shows that the color fastness to light of the dyed fabrics after dry-cleaned degrades to a certain extent according to the dry-cleaning solvent used and the times of dry-cleaning. For example, the color fastness to light degrades to fourth grade after the dyed fabric of nylon is dry-cleaned with stoddard solvent type II, and degrades to fourth to fifth grade after dry-cleaned one time or two times with perchloroethylene and to fourth grade after dry-cleaned five times with perchloroethylene. The color fastness to light degrades from 3rd–4th grade to third grade after the dyed fabric of polyester is dry-cleaned with propylene glycol methyl ether propionate or perchloroethylene. The color fastness to light degrades from to 4th–5th grade to fourth grade after the dyed fabric of cotton is dry-cleaned with any one of the four dry-cleaning solvents except propylene glycol methyl ether propionate. The color fastness to light degrades from 4th–5th grade to third grade after the dyed fabric of polyester/cotton is dry-cleaned with stoddard solvent type I or perchloroethylene. Further, stoddard solvents type I and type II are most effective to the color fastness to light of the dyed fabrics of wool, wool/polyacrylonitrile and wool/polyester. According to above descriptions, when propylene glycol methyl ether propionate is used as a dry-cleaning solvent, it has no influence on the color fastness to light of the dyed fabrics of nylon, polyester/rayon, cotton, wool, wool/polyacrylonitrile and wool/polyester.

Meanwhile, the color fastness to light of the dyed fabrics of polyester, polyester/cotton, and nylon/polyacrylonitrile degrades when they are dry cleaned with propylene glycol methyl ether propionate more than 20 times.

EXAMPLE 7

Testing the Color Fastness to Dry-cleaning of Fabrics

The test of the color fastness to dry-cleaning of the fabric is preformed after the fabric is dry-cleaned with the four dry-cleaning solvents to measure its reflectance by a spectrophotometer.

Since different light waves of different color will have their maximum absorbion at different range of wavelength, therefore invisible lights with wavelength of 400–700 nm can provide different levels of reflection so as to define a functional curve of reflectance versus wavelength. Nevertheless, the reflectance is inversely proportional to the concentration of a dye dyed on the fabric. An empirical equation is shown as:

$$K/S=(1-R)^2/2R$$

wherein K is absorption coefficient, S is extinction coefficient, and R is reflectance at the maximum absorbing wavelength.

According to above description, the K/S value is proportional to the concentration of dye on the fabric. Further, according to the opponent-color coordinate recommended by the CIE Society in 1976, wherein a redness-greenness coordinate forms the "a" coordinate where redness denotes a positive value and greenness denotes a negative value together with a yellowness-blueness coordinate forms the "b" coordinate where yellowness indicates a positive value and blueness indicates a negative value; the two sets of coordinates forming a two dimensional coordinate, together with a third coordinate which indicates the bright form a CIE Lab the opponent-color coordinate, a value "L" of bright in the third coordinate, a value "a" of chroma in the redness-greenness coordinate and a value "b" of chroma in the yellowness-blueness coordinate are related to tristimulus values as the following:

$$L=116\times(Y/Yn)^{1/3}-16$$

$$a=500\times[(X/Xn)^{1/3}-(Y/Yn)^{1/3}]$$

$$b=500\times[(Y/Yn)^{1/3}-(Z/Zn)^{1/3}]$$

$$h=tan^{-1}(b/a)$$

$$c=(a^2+b^2)½$$

where the definitions of the Xn Yn, Xn are the same as before.

The color difference is analyzed according to Munsell Color Solid Theory which shows that the hue difference and the chroma difference can be obtained by means of a solid rectangular coordinate, and the graphic demonstration of the differences is shown in FIG. 1.

In Table 47, it is apparent that the K/S value increases 2 to 4 after the dyed fabric of wool is dry-cleaned with propylene glycol mono methyl ether propionate, but decreases 3 after the dyed fabric of wool is dry-cleaned above five times with propylene glycol methyl ether propionate. The K/S value increases about 2 after the dyed fabric of wool is dry-cleaned with perchloroethylene, and varies slightly after the dyed fabric of wool is dry-cleaned with stoddard solvent type I or stoddard solvent type II. Further, as shown in Table 48, perchloroethylene has largest influence on the bright difference (ΔL) of the dyed fabric of wool, and makes the bright difference of the dyed fabric of wool decrease about 1.5%. The influence of propylene glycol methyl ether propionate is next to that of perchloroethylene.

Tables 49 and 50 show that the K/S value decreases 2 to 3 after the dyed fabric of polyester/rayon is dry-cleaned more than five times with propylene glycol mono methyl ether propionate or one time with stoddard solvent type I. Further, the bright decreases 0.3 to 0.5 after the dyed fabric of polyester/rayon is dry-cleaned with stoddard solvent type II or perchloroethylene, but increases 1 after dry-cleaned one time with propylene glycol mono methyl ether propionate or more than one time with stoddard solvent type I.

Tables 51 and 52 show that the K/S value and the grade of color change respectively decreases about 0.3 and to second to third grade or below after the dyed fabric of nylon is dry-cleaned with stoddard solvent type II, but the grade of color change and pollution respectively decreases to below second grade and between third and fourth grade after dry-cleaned with perchloroethylene. Further, the bright decreases about 2 after the dyed fabric of nylon is dry-cleaned with stoddard solvent type II or perchloroethylene.

Tables 53 and 54 show that the K/S value increase 0.1, the grade of color change decreases to first to second grade and the grade of pollution is between third and fourth grade after the dyed fabric of polyester/cotton is dry-cleaned with stoddard solvent type II or perchloroethylene. Further, stoddard solvent type II and prechloroethylene also make the bright of the dyed fabric of polyester/cotton decrease about 7 to 8.

Tables 55 and 56 show that the K/S value decreases about 1 and the grade of color change is fourth grade after the dyed fabric of cotton is dry-cleaned with stoddard solvent type II, but the grade of color change is third to fourth grade after the dyed fabric of cotton is dry-cleaned more than one time with perchloroethylene. Further, stoddard solvent type II and perchloroethylene have influence on the bright of the dyed fabric of cotton and make it decrease about 0.6 and 0.7 to 1, respectively.

Tables 57 and 58 show that the K/S value decreases 1 to 2 after the dyed fabric of wool/polyacrylonitrile is dry-cleaned with propylene glycol methyl ether propionate, stoddard solvent type I, or stoddard solvent type II, and the grade of color change decreases to third to fourth grade after the dyed fabric of wool/ polyacrylonitrile is dry-cleaned with stoddard solvent type II. Further, perchloroethylene is least effective to the bright of the dyed fabric of wool/ polyacrylonitrile. The bright increase 0.3 to 0.6 after the dyed fabric is dry cleand with propylene glycol methyl ether propionate.

Tables 59 and 60 show that the K/S value decreases about 1 and the grade of color change is fourth grade after the dyed fabric of wool/polyester is dry-cleaned with stoddard solvent type II, and the grade of color change decreases to third to fourth grade after the dyed fabric of wool/polyester is dry-cleaned with perchloroethylene. Further, the bright decreases slightly after the dyed fabric of wool/polyester is dry-cleaned below five times with propylene glycol methyl ether propionate, but increases after the dyed fabric of wool/polyester is dry-cleaned more than five times with propylene glycol methyl ether propionate.

Tables 61 and 62 show that the K/S value decreases 50% and the brightness index increases 1 to 2 after the dyed fabric of polyester is dry-cleaned with any one of perchloroethylene, stoddard solvent type II and propylene glycol methyl ether propionate, but perchloroethylene is less effective to the dyed fabric of polyester than the other three dry-cleaning solvents.

Tables 63 and 64 show that the K/S value increases about 2 after the dyed fabric of nylon/polyacrylonitrile is dry-cleaned with stoddard solvent type I or stoddard solvent type II, and increases about 5 after the dyed fabric of nylon/ polyacrylonitrile is dry-cleaned with perchloroethylene. Further, the bright decreases about 1 and above 1.5 after the dyed fabric of nylon/polyacrylonitrile is respectively dry-cleaned with stoddard solvent type I or stoddard solvent type II and perchloroethylene.

EXAMPLE 8

Testing the Color Fastness to Abrasion of Fabrics

Fabrics used in Example 8 are dyed fabrics and the results of the test of the color fastness to abrasion of the fabrics are shown in Tables 65 to 73.

As shown in Tables 65 to 73, the color fastness to abrasion of the dyed fabric of wool/polyester increases from the 4th grade to 4th–5th grade after dry-cleaned with propylene glycol methyl ether propionate or stoddard solvent type I, but remains the same after dry-cleaned with stoddard solvent type II or perchloroethylene. The color fastness to abrasion of the dyed fabric of wool decreases from 4th grade to 3rd–4th grade after dry-cleaned two times with stoddard solvent type II. Further, the color fastness to abrasion of any of the other seven dyed fabrics after dry-cleaned is similar to that before dry-cleaned.

EXAMPLE 9

Testing the Whiteness Index and Yellowness Index of the Undyed Fabrics

The reflectance of an undyed fabric is measured by a spectrophotometer by means of an ICS-GAIN colormatching system according to ASTM (American Society and Testing Maerial) E-313-73 and ASTM D-1925-70. The measured reflectance is converted into tristimulus values (X, Y, Z) by means of the colormatching system and then the tristimulus values are put into the following equations to calculate a whiteness index (WI) and a yellowness index (YI).

$$WI(ASTM)=3.338Z-3Y$$

$$YI(ASTM)=100\times(1.28X-1.06Z)/Y$$

Tables 74 and 75 show that the yellowness index decreases about 2 and the whiteness index decreases about 20 after the gray nylon goods is dry-cleaned with perchloroethylene, while the yellowness index decreases about 3 and the whiteness index decreases about 20 after the gray nylon goods is dry-cleaned with any one of the other three dry-cleaning solvents. Further, the bright decreases 7 to 8 after the gray nylon goods is dry-cleaned with any one of the four dry-cleaning solvents.

Tables 76 and 77 show that the bright increases about 1.8 after the gray silk goods is dry-cleaned with propylene glycol methyl ether propionate, and increases about 1 after the gray silk goods is dry-cleaned with any one of the other three dry-cleaning solvents. Further, the yellowness index decreases about 4 and the whiteness index increases about 11 after the gray silk goods is dry-cleaned with propylene glycol methyl ether propionate which has stronger effect than other dry cleaning solvents.

Tables 78 and 79 show that all the dry-cleaning solvents have small effect on the bright of the gray cotton goods, but make the yellowness index of the gray cotton goods increase about 0.5 after dry-cleaned. Further, the whiteness index of the gray cotton goods decreases about I after dry-cleaned with stoddard solvent type I only.

Tables 80 and 81 show that all the dry-cleaning solvents have small effect on the bright of the gray wool goods. Further, the yellowness index of the gray wool goods increases about 1 and the whiteness index thereof decreases about 3 to 5 after dry-cleaned with any one of the four dry-cleaning solvents except propylene glycol methyl ether propionate.

Tables 82 and 83 show that the yellowness index decreases about 2 after the gray polyester goods is dry-cleaned with propylene glycol methyl ether propionate, and decreases 3 to 4 after the gray polyester goods is dry-cleaned with perchloroethylene. Further, the whiteness index decreases about 20 and the bright decreases more than 4 after the gray polyester goods is dry-cleaned with any one of the four dry-cleaning solvents except stoddard solvent type II.

According to the descriptions in Examples 1 to 9, propylene glycol methyl ether propionate has smaller influence on fabrics than conventional dry cleaning solvents such as stoddard solvent type I, stoddard solvent type II and perchloroethylene do, and has good dry-cleaning effect and does not change physical property of fabrics (e.g., surface structure of the fabric) significantly so that propylene glycol methyl ether propionate is an environmentally friendly dry cleaning solvent and can completely replace the conventional dry-cleaning solvents, perchloroethylene, stoddard solvent type I and stoddard solvent type II.

The present invention further discloses the dry-cleaning solvent compositions formed by mixing various amounts of propylene glycol methyl ether acetate or propylene glycol methyl ether propionate with various amounts of perchloroethylene, stoddard solvent type I, stoddard solvent type II (hereinafter called "dry-cleaning oil"), or the mixture thereof and compare the influence on the color fastness of the fabric of each composition as shown in Examples 10 to 12.

The dry-cleaning solvent compositions used in Examples 10 to 12 are as follows.

dry-cleaning solvent composition A: comprising 100% propylene glycol mono methyl ether acetate;

dry-cleaning solvent composition B: comprising 70 wt % propylene glycol monomethyl ether acetate and 30 wt % dry-cleaning oil;

dry-cleaning solvent composition C: comprising 30 wt % propylene glycol monomethyl ether acetate and 70 wt % dry-cleaning oil;

dry-cleaning solvent composition D: comprising 70 wt % propylene glycol monomethyl ether propionate and 30 wt % dry-cleaning oil; and dry-cleaning solvent composition E: comprising 30 wt % propylene glycol monomethyl ether propionate and 70 wt % dry-cleaning oil.

The cloth samples used in Examples 10 to 12 are selected in a random way from the market, which are eight different kinds of cloth, the ingredients thereof are respectively 100% wool, 100% cotton, 100% polyester, 100% nylon, polyester/rayon, polyester/cotton, polyester/wool and ultra-thin denier of polyester.

Examples 10 to 12 are conducted under the conditions according to CNS-8429 test rules of color fastness and CNS-8431 test rules of color fastness to organic solvent. All samples of dyed fabrics are respectively dry-cleaned with the dry-cleaning solvent compositions A to E under the following process conditions: liquid ratio is 1:40 and temperature is 25±2° C. Then, the sample is put into a flask. After shaking it for about 30 minutes, the sample is dried under a temperature of 60±2° C. for 1 hour.

Each sample is respectively processed with the dry-cleaning solvent compositions A to E according to the above process conditions and the process repeats one time, two times and five times. Then, the sample is respectively tested for the physical properties and color fastness. The tests of color fastness include a test of color fastness to an organic solvent, to abrasion, and to dry-hot, as shown in Examples 10 to 12. The color change of the processed sample is also analyzed by colormatching system, the color fastness is tested too.

With reference to the following Examples 10 to 12, they further describe features of the present invention and they are by no means of any limitation therefor. The test of color fastness and the symbol used are the same as what Examples 7 describes.

EXAMPLE 10

Testing the Color Fastness to Dry-cleaning of Fabrics

Tables 84 and 85 show that the dry-cleaning solvent compositions A to E influence slightly the K/S value of the dyed fabric of wool, but the K/S value of the dyed fabric of wool has an increasing trend after the dyed fabric of wool is dry-cleaned with dry-cleaning solvent composition A and a decreasing trend after the dyed fabric of wool is dry-cleaned with dry-cleaning solvent composition B or C, and decreases first and then increases after the dyed fabric of wool is dry-cleaned with dry-cleaning solvent composition D.

Further, the bright difference (ΔL) of the dyed fabric of wool is between −0.8 and 0.3 after the dyed fabric of wool is dry-cleaned with any one of dry-cleaning solvent compositions A to E.

Tables 86 and 87 show that the dry-cleaning solvent compositions A to E have small influence on the K/S value of the dyed fabric of polyester/rayon, while the K/S value has an increasing tend after it is dry-cleaned with any one of dry-cleaning solvent compositions A to E. Further, the bright difference (ΔL) of the dyed fabric of polyester/rayon is between 4.5 and 0.5 after it is dry-cleaned with any one of dry-cleaning solvent compositions A to E.

Tables 88 and 89 show that the K/S value of the dyed fabric of polyester increases first and then decreases after it is dry-cleaned with dry-cleaning solvent composition A or E, but decreases first and then increases after it is dry-cleaned with dry-cleaning solvent composition B, D, or C. Further, the bright difference (ΔL) of the dyed fabric of polyester is about 1.19 after it is dry-cleaned one time or two times with dry-cleaning solvent composition B, about 0.19 after it is dry-cleaned five times with dry-cleaning solvent composition B, and between about −0.5 and 0.5 after it is dry-cleaned with dry-cleaning solvent composition A, C, D, or E.

EXAMPLE 11

Testing the Color Fastness to Abrasion of Fabrics

The results of Example 11 are shown in Tables 90 to 95. As shown in Tables 90 to 95, the color fastness to abrasion of the dyed fabric of wool decreases obviously after it is dry-cleaned five times with dry-cleaning solvent composition A, and the color fastness to abrasion of the dyed fabric of polyester/rayon decreases obviously after it is dry-cleaned five times with dry-cleaning solvent composition B or after it is dry-cleaned two times with dry-cleaning solvent composition C or D. The grade of color change of the rest test is between the fourth to the fifth grade.

EXAMPLE 12

Testing the Color Fastness to Dry-hot of Fabrics

The results of Example 12 are shown in Table 96 to 101. As shown in tables 96 to 101, the color fastness to dry-hot of the dyed fabric of wool decreases obviously after it is dry-cleaned one time with dry-cleaning solvent composition A or after it is dry-cleaned five times with dry-cleaning solvent composition E. The color fastness to dry-hot of the dyed fabric of polyester/rayon decreases obviously after it is dry-cleaned five times with dry-cleaning solvent composition D. The color fastness to dry-hot of the dyed fabric of polyester decreases after it is dry-cleaned five times with dry-cleaning solvent composition B, one time with dry-cleaning solvent composition C, or one time or two times with dry-cleaning solvent composition D. The grade of color change of the rest test is between the fourth to fifth grade.

According to the Examples 10 to 12, dry-cleaning solvent compositions A to E are superior to the conventional dry-cleaning solvents in terms of the influence on the physical property, color fastness of the fabric, wherein dry-cleaning solvent composition A is better than dry-cleaning solvent compositions B to E since it will not change the physical property or color of the fabric appreciably.

However, propylene glycol methyl ether formate, propylene glycol methyl ether acetate, propylene glycol methyl ether propionate, propylene glycol methyl ether butyrate, propylene glycol ethyl ether formate, propylene glycol ethyl ether acetate, propylene glycol ethyl ether propionate, propylene glycol ethyl ether butyrate, ethylene glycol methyl ether formate, ethylene glycol methyl ether acetate, ethylene glycol methyl ether propionate, and ethylene glycol methyl ether butyrate are more expensive than conventional dry-cleaning solvents, but propylene glycol methyl ether formate, propylene glycol methyl ether acetate, propylene glycol methyl ether propionate, propylene glycol methyl ether butyrate, propylene glycol ethyl ether formate, propylene glycol ethyl ether acetate, propylene glycol ethyl ether propionate, propylene glycol ethyl ether butyrate, ethylene glycol methyl ether formate, ethylene glycol methyl ether acetate, ethylene glycol methyl ether propionate, and ethylene glycol methyl ether butyrate have more excellent degree of cleaning fabrics than conventional dry-cleaning solvents do. Therefore, the present invention provides a dry-cleaning solvent composition comprising a compound or solvent selected from the group consisting of propylene glycol methyl ether formate, propylene glycol methyl ether acetate, propylene glycol methyl ether propionate, propylene glycol methyl ether butyrate, propylene glycol ethyl ether formate, propylene glycol ethyl ether acetate, propylene glycol ethyl ether propionate, propylene glycol ethyl ether butyrate, ethylene glycol methyl ether formate, ethylene glycol methyl ether acetate ethylene glycol methyl ether propionate. ethylene glycol methyl ether butyrate, and the mixture thereof. Below 70 wt % of the dry cleaning solvent composition may be perchloroethylene, stoddard solvent type I, stoddard solvent type II or the mixture thereof for reducing the cost thereof.

Although preferred embodiments have been described to illustrate the present invention, it is apparent that changes and modifications in the described embodiments can be carried out without departing from the scope of the invention intended to be limited only by the appended claims.

TABLE 1 the differences in property between propylene glycol methyl ether propionate and conventional dry cleaning solvents

| | Dry cleaning solvent | | | |
|---|---|---|---|---|
| Item | Propylene glycol methyl ether propionate | Perchloroethylene | Stoddard solvent type I | Stoddard solvent type II |
| Appearance and smell | Transparent liquid, no suspensions and water | Transparent liquid, ether-like smell | Transparent liquid, no suspensions and water, gasoline-like smell | Transparent liquid, no suspensions and water, gasoline-like smell |
| Component | 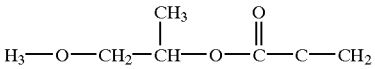 | 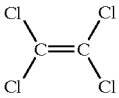 | Iso-paraffin 24.8%<br>N-paraffin 26.5%<br>Olefin 0.8%<br>Naphthene 13.8%<br>Total Aromatics 21.3%<br>($C_8$ 1.1%, $C_9$ 12.6%, $C_{10}$ 5%, $C_{11}$ 2.5%)<br>Others 12.9% | Iso-paraffin 24.8%<br>N-paraffin 26.5%<br>Olefin 0.8%<br>Naphthene 13.8%<br>Total Aromatics 21.3%<br>($C_8$ 1.1%, $C_9$ 12.6%, $C_{10}$ 5%, $C_{11}$ 2.5%)<br>Others 12.9% |
| Molecular weight | 146 | 166 | — | — |
| Specific gravity | 0.95 | 1.625 | 0.745–0.825 | 0.748–0.82 |
| Boiling point | 160° C. | 121° C. | 149–208° C. | 177–213° C. |
| Freezing point | <–50° C. | –22.4° C. | — | — |
| Flash point | 56° C. | — | 38° C. | 60° C. |
| Ignition point | 360° C. | Inflammable | 230–260° C. | — |
| Viscosity (at 25° C.) | 1.2 | — | 0.84 CP (centi poise) | — |
| Vaporizing rate (NBAC = 100) | 19 | — | 70 | — |
| Vapor pressure | 0.9 mm-Hg | — | 2 mm-Hg | — |
| Solubility | — | Insoluble in water, soluble in ethyl alcohol, ethyl ether, oils | Insoluble in water, soluble in non-polar solvents, such as gasoline, ethyl ether, oils, benzene, chloroform, carbon tetrachloride, carbon disulfide, etc. | Insoluble in water, soluble in non-polar solvents, such as gasoline, ethyl ether, oils, benzene, chloroform, carbon tetrachloride, carbon disulfide, etc. |
| Dangerousness | — | Stimulativeness to eyes and skin, medium toxicity | Extremely dangerous in storage. React with the following compounds to produce dangerous reaction:<br>1. chlorine gas<br>2. nitric acid<br>3. strong oxidizing agent<br>4. sulfuric acid | Extremely dangerous in storage. React with the following compounds to produce dangerous reaction:<br>1. chlorine gas<br>2. nitric acid<br>3. strong oxidizing agent<br>4. sulfuric acid |

TABLE 2 the surface of the dyed fabric are observed by means of a scanning electron microscope (SEM) after the dyed fabric is dry cleaned with dry cleaning solvents

| Dyed fabric | Dry cleaning solvent: Stoddard solvent type I | Stoddard solvent type 11 | Propylene glycol methyl ether propionate | Perchloroethylene |
|---|---|---|---|---|
| Nylon | cracked and flayed | cracked and flayed | small influence | flayed |
| Nylon/polyacrylonitrile | extremely cracked and flayed | extremely cracked and flayed | slightly cracked and flayed | small influence |
| Polyester/rayon | extremely cracked and flayed | extremely cracked and flayed | small influence | cracked and flayed |
| Polyester | cracked and flayed | extremely cracked and flayed | slight corrosion | oligomers are precipitated on the surface thereof |
| Cotton | small influence | small influence | small influence | small influence |
| Polyester/cotton | small influence | small influence | small influence | small influence |
| Wool | structure of cuticle is destroyed | structure of cuticle is destroyed | structure of cuticle is destroyed | structure of cuticle is destroyed |
| Wool/polyacrylonitrile | structure of cuticle is destroyed | structure of cuticle is destroyed | structure of cuticle is destroyed | structure of cuticle is destroyed |
| Wool/polyester | extremely cracked and flayed | structure of cuticle is destroyed | structure of cuticle is destroyed | structure of cuticle is destroyed |

TABLE 3 the difference of Lab values of the soil test cloth of polyester/cotton after the soil test cloth of polyester/cotton is dry cleaned one time, two or five times with a dry cleaning solvent

| dry cleaning solvent | | item: ΔL | Δa | Δb | Δc | Δh | ΔE |
|---|---|---|---|---|---|---|---|
| propylene glycol | one time | 4.04 | −0.16 | −0.47 | −0.42 | 0.28 | 4.07 |
| methyl ether | two times | 3.48 | −0.5 | −0.95 | −0.48 | 0.96 | 3.64 |
| propionate | five times | 4.53 | −0.06 | −0.55 | −0.52 | 0.17 | 4.57 |
| stoddard solvent | one time | 3.77 | −0.04 | −0.41 | −0.39 | 0.12 | 3.79 |
| type I | two times | 4.16 | −0.08 | −0.41 | −0.39 | 0.16 | 4.18 |
| | five times | 1.05 | 0 | −0.32 | −0.32 | 0.05 | 1.1 |
| perchloroethylene | one time | 3.26 | −0.04 | −0.41 | −0.4 | 0.11 | 3.29 |
| | two times | 3.94 | −0.07 | −0.43 | −0.41 | 0.15 | 3.96 |
| | five times | 2.8 | −0.06 | −0.4 | −0.39 | 0.13 | 2.83 |
| stoddard solvent | one time | 3.55 | −0.06 | −0.28 | −0.26 | 0.1 | 3.57 |
| type II | two times | 4.27 | −0.09 | −0.46 | −0.43 | 0.19 | 4.29 |
| | five times | 3.41 | −0.15 | −0.69 | −0.61 | 0.35 | 3.48 |

TABLE 4 the difference of Lab values of the soil test cloth of wool after the soil test cloth of wool is dry cleaned one time, two or five times with a dry cleaning solvent

| dry cleaning solvent | | item: ΔL | Δa | Δb | Δc | Δh | ΔE |
|---|---|---|---|---|---|---|---|
| propylene glycol | one time | −2.42 | −0.04 | −0.67 | −0.66 | 0.15 | 2.51 |
| methyl ether | two times | 0.12 | −0.1 | −0.5 | −0.48 | 0.18 | 0.52 |
| propionate | five times | −0.71 | −0.07 | −0.88 | −0.85 | 0.22 | 1.13 |
| stoddard solvent | one time | −1.53 | −0.08 | −0.82 | −0.8 | 0.22 | 1.74 |
| type I | two times | −0.45 | −0.12 | −0.66 | −0.63 | 0.23 | 0.81 |
| | five times | −1.02 | −0.12 | −0.7 | −0.67 | 0.24 | 1.24 |
| perchloroethylene | one time | −2.1 | −0.04 | −0.03 | −0.03 | 0.05 | 2.1 |
| | two times | −1.91 | −0.09 | −0.83 | −0.8 | 0.23 | 2.09 |
| | five times | −1.66 | −0.1 | −0.93 | −0.9 | 0.27 | 1.9 |
| stoddard solvent | one time | −2.43 | −0.06 | −0.78 | −0.76 | 0.19 | 2.55 |
| type II | two times | −1.39 | −0.07 | −0.77 | −0.74 | 0.2 | 1.59 |
| | five times | −2.42 | −0.26 | −1.21 | −1.13 | 0.5 | 2.73 |

TABLE 5 the difference of Lab values of the soil test cloth of polyester after the soil test cloth of polyester is dry cleaned one time, two or five times with a dry cleaning solvent

| dry cleaning solvent | | item: ΔL | Δa | Δb | Δc | Δh | ΔE |
|---|---|---|---|---|---|---|---|
| propylene glycol | one time | 4.75 | −0.2 | 0.12 | −0.1 | −0.21 | 4.76 |
| methyl ether | two times | 6.85 | −0.33 | −0.37 | 0.39 | −0.3 | 0.87 |
| propionate | five times | 7.07 | −0.1 | −0.26 | 0.27 | −0.17 | 7.08 |
| stoddard solvent | one time | 6.29 | −0.21 | −0.22 | 0.23 | −0.19 | 6.3 |
| type I | two times | 7.03 | −0.17 | −0.26 | 0.27 | −0.16 | 7.04 |
| | five times | 5.28 | −0.11 | 0.04 | −0.03 | −0.11 | 5.28 |
| perchloroethylene | one time | 6.68 | −0.19 | 0.07 | −0.06 | −0.19 | 6.68 |
| | two times | 7.6 | −0.17 | −0.2 | 0.21 | −0.16 | 7.61 |
| | five times | 5.26 | −0.14 | −0.14 | 0.15 | −0.13 | 5.67 |
| stoddard solvent | one time | 6.59 | −0.18 | −0.14 | 0.15 | −0.17 | 6.59 |
| type II | two times | 5.67 | −0.22 | −0.24 | 0.25 | −0.2 | 5.68 |
| | five times | 5.19 | −0.17 | −0.29 | 0.03 | −0.15 | 5.2 |

TABLE 6 the difference of Lab values of the soil test cloth of cotton after the soil test cloth of cotton is dry cleaned one time, two or five times with a dry cleaning solvent

| dry cleaning solvent | | item: ΔL | Δa | Δb | Δc | Δh | ΔE |
|---|---|---|---|---|---|---|---|
| propylene glycol | one time | 3.85 | −0.1 | −0.62 | −0.58 | 0.25 | 3.9 |
| methyl ether | two times | 4.64 | −0.22 | −0.81 | −0.69 | 0.48 | 4.72 |
| propionate | five times | 4.38 | −0.02 | −0.78 | −0.76 | 0.19 | 4.45 |
| stoddard solvent | one time | 4.62 | −0.07 | −0.46 | −0.44 | 0.17 | 4.64 |
| type I | two times | 3.99 | −0.01 | −0.44 | −0.43 | 0.09 | 4.02 |
| | five times | 4.84 | −0.08 | −0.46 | −0.44 | 0.17 | 4.86 |
| perchloroethylene | one time | 4.22 | −0.02 | −0.61 | −0.6 | 0.14 | 4.27 |
| | two times | 4.04 | −0.04 | −0.64 | −0.62 | 0.18 | 4.09 |
| | five times | 2.8 | −0.02 | −0.68 | −0.66 | 0.16 | 2.88 |
| stoddard solvent | one time | 3.82 | −0.08 | −0.19 | −0.17 | 0.12 | 3.83 |
| type II | two times | 4.49 | −0.1 | −0.63 | −0.59 | 0.26 | 4.53 |
| | five times | 3.83 | −0.13 | −0.41 | −0.37 | 0.22 | 3.86 |

TABLE 7 the whiteness index and the yellowness index of a soil test cloth before the soil test cloth is dry cleaned and after the soil test cloth is dry cleaned one time, two and five times with a dry cleaning solvent

| | | the soil test cloth of | | | | | | | |
|---|---|---|---|---|---|---|---|---|---|
| | | Polyester | | cotton | | polyester/cotton | | wool | |
| dry cleaning solvent | | whiteness index | yellowness Index | whiteness index | yellowness index | whiteness Index | yellowness index | whiteness index | yellowness index |
| before dry cleaned | | 45.11 | −10.35 | 39.47 | 3.85 | 37.82 | 3.41 | 22.57 | 11.22 |
| propylene glycol | one time | 52.63 | −9.73 | 47.44 | 2.2 | 45.3 | 2.02 | 22.07 | 9.8 |
| methyl ether | two times | 58.12 | −10.93 | 49.44 | 1.64 | 46.27 | 0.53 | 24.12 | 9.88 |
| propionate | five times | 58.12 | −10.45 | 48.85 | 1.93 | 46.3 | 1.97 | 24.33 | 9.09 |
| stoddard solvent | one time | 56.49 | −10.45 | 48.04 | 2.59 | 44.61 | 2.32 | 23.35 | 9.29 |
| type I | two times | 57.98 | −10.42 | 46.96 | 2.71 | 45.22 | 2.27 | 23.99 | 9.53 |
| | five times | 53.68 | −9.72 | 48.39 | 2.57 | 42.04 | 3.07 | 23.54 | 9.48 |
| perchloroethylene | one time | 56.16 | −9.61 | 47.96 | 2.31 | 43.87 | 2.32 | 20.62 | 11.37 |
| | two times | 58.86 | −10.22 | 47.78 | 2.23 | 44.96 | 2.23 | 22.99 | 9.3 |
| | five times | 55.02 | −10.21 | 45.97 | 2.18 | 43.16 | 2.33 | 23.54 | 9 |
| stoddard solvent | one time | 56.75 | −10.18 | 45.76 | 3.2 | 43.82 | 2.61 | 22.35 | 9.52 |
| type II | two times | 55.43 | −10.57 | 48.48 | 2.17 | 45.58 | 2.13 | 23.33 | 9.42 |
| | five times | 54.68 | −10.69 | 46.59 | 2.67 | 45.12 | 1.54 | 23.58 | 8.18 |

TABLE 8 the degree of shrinkage of the dyed fabric of wool/polyester after dry-cleaned one time, two and five times with a dry-cleaning solvent

| | | the degree of shrinkage | | | | | |
|---|---|---|---|---|---|---|---|
| | | warp sense | | | weft sense | | |
| wool/polyester | | fabric scale before dry-cleaned | fabric scale after dry-cleaned | the degree of shrinkage | fabric scale before dry-cleaned | fabric scale after dry-cleaned | the degree of shrinkage |
| propylene glycol | one time | 21.5 | 21.5 | 0% | 6.2 | 5.9 | 4.83% |
| methyl ether | two times | 21.5 | 21.5 | 0% | 6.2 | 5.9 | 4.83% |
| propionate | five times | 21.5 | 21.4 | 0.46% | 6.2 | 5.7 | 8.06% |
| stoddard solvent | one time | 21.2 | 21.05 | 0.7% | 6.7 | 6.65 | 0.74% |
| type I | two times | 21.15 | 21 | 0.709% | 6 | 5.8 | 3.33% |
| | five times | 20.5 | 20.3 | 0.97% | 5.9 | 5.7 | 3.38% |
| stoddard solvent | one time | 4.9 | 4.9 | 0% | 4.8 | 4.8 | 0% |
| type II | two times | 4.85 | 4.85 | 0% | 4.9 | 4.9 | 0% |
| | five times | 4.9 | 4.9 | 0% | 4.8 | 4.8 | 0% |
| perchloroethylene | one time | 4.9 | 4.9 | 0% | 4.9 | 4.9 | 0% |
| | two times | 4.9 | 4.85 | 1.02% | 5 | 5 | 0% |
| | five times | 4.8 | 4.8 | 0% | 4.8 | 4.8 | 0% |

TABLE 9 the degree of shrinkage of the dyed fabric of wool after dry-cleaned one time, two and five times with a dry-cleaning solvent

| | | the degree of shrinkage | | | | | |
|---|---|---|---|---|---|---|---|
| | | warp sense | | | weft sense | | |
| wool | | fabric scale before dry-cleaned | fabric scale after dry-cleaned | the degree of shrinkage | fabric scale before dry-cleaned | fabric scale after dry-cleaned | the degree of shrinkage |
| propylene glycol | one time | 12.9 | 12.9 | 0% | 10.4 | 10.4 | 0% |
| methyl ether | two times | 12.9 | 12.9 | 0% | 10.4 | 10.4 | 0% |
| propionate | five times | 12.9 | 12.9 | 0% | 10.4 | 10.4 | 0% |
| stoddard solvent | one time | 15.41 | 15.15 | 1.68% | 6.29 | 6.2 | 1.42% |
| type I | two times | 15.3 | 14.95 | 2.28% | 5.9 | 5.8 | 1.69% |
| | five times | 15.15 | 14.55 | 3.69% | 6.1 | 5.75 | 5.73% |

TABLE 9-continued the degree of shrinkage of the dyed fabric of wool after dry-cleaned one time, two and five times with a dry-cleaning solvent

| wool | | the degree of shrinkage | | | | | |
|---|---|---|---|---|---|---|---|
| | | warp sense | | | weft sense | | |
| | | fabric scale before dry-cleaned | fabric scale after dry-cleaned | the degree of shrinkage | fabric scale before dry-cleaned | fabric scale after dry-cleaned | the degree of shrinkage |
| stoddard solvent | one time | 4.9 | 4.9 | 0% | 4.7 | 4.7 | 0% |
| type II | two times | 4.9 | 4.9 | 0% | 4.85 | 4.85 | 0% |
| | five times | 4.8 | 4.8 | 0% | 4.9 | 4.9 | 0% |
| perchloroethylene | one time | 5 | 5 | 0% | 5 | 4.95 | 1% |
| | two times | 5 | 4.9 | 2% | 4.9 | 4.8 | 2.04% |
| | five times | 4.9 | 4.9 | 0% | 4.8 | 4.8 | 0% |

TABLE 10 the degree of shrinkage of the dyed fabric of polyester after dry-cleaned one time, two and five times with a dry-cleaning solvent

| polyester | | the degree of shrinkage | | | | | |
|---|---|---|---|---|---|---|---|
| | | warp sense | | | weft sense | | |
| | | fabric scale before dry-cleaned | fabric scale after dry-cleaned | the degree of shrinkage | fabric scale before dry-cleaned | fabric scale after dry-cleaned | the degree of shrinkage |
| propylene glycol | one time | 21.5 | 21.5 | 0% | 6 | 6 | 0% |
| methyl ether | two times | 21.5 | 21.5 | 0% | 6 | 6 | 0% |
| propionate | five times | 21.5 | 21.5 | 0% | 6 | 6 | 0% |
| stoddard solvent | one time | 21.52 | 21.5 | 0.092% | 6.1 | 6 | 1.63% |
| type I | two times | 21.3 | 21.3 | 0% | 5.8 | 5.7 | 1.72% |
| | five times | 21.6 | 21.4 | 0.92% | 6 | 6 | 0% |
| stoddard solvent | one time | 4.7 | 4.7 | 0% | 4.7 | 4.7 | 0% |
| type II | two times | 4.8 | 4.8 | 0% | 4.8 | 4.8 | 0% |
| | five times | 4.7 | 4.7 | 0% | 4.8 | 4.8 | 0% |
| perchloroethylene | one time | 5 | 5 | 0% | 5 | 5 | 0% |
| | two times | 5 | 5 | 0% | 5 | 5 | 0% |
| | five times | 4.9 | 4.9 | 0% | 5 | 5 | 0% |

TABLE 11 the degree of shrinkage of the dyed fabric of wool/polyacrylonitrile after dry-cleaned one time, two and five times with a dry-cleaning solvent

| wool/polyacrylonitrile | | the degree of shrinkage | | | | | |
|---|---|---|---|---|---|---|---|
| | | warp sense | | | weft sense | | |
| | | fabric scale before dry-cleaned | fabric scale after dry-cleaned | the degree of shrinkage | fabric scale before dry-cleaned | fabric scale after dry-cleaned | the degree of shrinkage |
| propylene glycol | one time | 20.5 | 20.4 | 0.48% | 6.3 | 6.3 | 0% |
| methyl ether | two times | 20.5 | 20.5 | 0% | 6.3 | 6.3 | 0% |
| propionate | five times | 20.5 | 20.4 | 0.46% | 6.3 | 6.3 | 0% |
| stoddard solvent | one time | 20.72 | 20.55 | 0.82% | 6.35 | 6.3 | 0.78% |
| type I | two times | 20.5 | 20.45 | 0.24% | 6.6 | 6.6 | 0% |
| | five times | 20.2 | 20.1 | 0.49% | 6.45 | 6 | 7.5% |
| stoddard solvent | one time | 4.95 | 4.95 | 0% | 4.8 | 4.8 | 0% |
| type II | two times | 5 | 5 | 0% | 4.7 | 4.7 | 0% |
| | five times | 4.9 | 4.9 | 0% | 4.85 | 4.85 | 0% |
| perchloroethylene | one time | 5 | 5 | 0% | 5 | 5 | 0% |
| | two times | 4.9 | 4.9 | 0% | 4.9 | 4.9 | 0% |
| | five times | 4.9 | 4.9 | 0% | 4.8 | 4.8 | 0% |

TABLE 12 the degree of shrinkage of the dyed fabric of polyester/rayon after dry-cleaned one time, two and five times with a dry-cleaning solvent

| | | the degree of shrinkage | | | | | |
|---|---|---|---|---|---|---|---|
| | | warp sense | | | weft sense | | |
| polyester/rayon | | fabric scale before dry-cleaned | fabric scale after dry-cleaned | the degree of shrinkage | fabric scale before dry-cleaned | fabric scale after dry-cleaned | the degree of shrinkage |
| propylene glycol | one time | 21.7 | 21.6 | 0.46% | 6 | 5.9 | 1.66% |
| methyl ether | two times | 21.7 | 21.6 | 0% | 6 | 5.9 | 1.66% |
| propionate | five times | 21.7 | 21.5 | 0.92% | 6 | 5.9 | 1.66% |
| stoddard solvent | one time | 21.4 | 21 | 1.86% | 6.1 | 5.8 | 4.91% |
| type I | two times | 21.2 | 21.15 | 0.235% | 5.9 | 5.8 | 1.69% |
| | five times | 21.15 | 20.95 | 0.94% | 5.85 | 5.7 | 0.85% |
| stoddard solvent | one time | 4.9 | 4.9 | 0% | 4.85 | 4.85 | 0% |
| type II | two times | 5 | 5 | 0% | 5 | 5 | 0% |
| | five times | 5 | 5 | 0% | 5 | 5 | 0% |
| perchloroethylene | one time | 5 | 5 | 0% | 5 | 5 | 0% |
| | two times | 5 | 5 | 0% | 5 | 5 | 0% |
| | five times | 5 | 5 | 0% | 4.9 | 4.9 | 0% |

TABLE 13 the degree of shrinkage of the dyed fabric of nylon/polyacrylonitrile after dry-cleaned one time, two and five times with a dry-cleaning solvent

| | | the degree of shrinkage | | | | | |
|---|---|---|---|---|---|---|---|
| | | warp sense | | | weft sense | | |
| nylon/polyacrylonitrile | | fabric scale before dry-cleaned | fabric scale after dry-cleaned | the degree of shrinkage | fabric scale before dry-cleaned | fabric scale after dry-cleaned | the degree of shrinkage |
| propylene glycol | one time | 21.9 | 21.4 | 2.28% | 6.6 | 6 | 9.09% |
| methyl ether | two times | 21.9 | 21.3 | 2.73% | 6.6 | 6 | 9.09% |
| propionate | five times | 21.9 | 21.3 | 2.73% | 6.6 | 6 | 9.09% |
| stoddard solvent | one time | 21.5 | 20.8 | 3.25% | 6.1 | 5.85 | 4.09% |
| type I | two times | 21.4 | 20.7 | 3.27% | 6 | 5.7 | 5% |
| | five times | 21.85 | 20.3 | 7.09% | 6.8 | 5.45 | 19.85% |
| stoddard solvent | one time | 7.65 | 7.5 | 1.9% | 5.3 | 5.2 | 1.8% |
| type II | two times | 4.65 | 4.55 | 2.15% | 3.75 | 3.7 | 1.33% |
| | five times | 4.65 | 4.6 | 1.07% | 3.9 | 3.85 | 1.28% |
| perchloroethylene | one time | 4.3 | 4 | 6.57% | 3.5 | 3.5 | 0% |
| | two times | 4.1 | 4.1 | 0% | 3.55 | 3.55 | 0% |
| | five times | 4 | 4 | 0% | 3.7 | 3.7 | 0% |

TABLE 14 the degree of shrinkage of the dyed fabric of cotton after dry-cleaned one time, two and five times with a dry-cleaning solvent

| | | the degree of shrinkage | | | | | |
|---|---|---|---|---|---|---|---|
| | | warp sense | | | weft sense | | |
| cotton | | fabric scale before dry-cleaned | fabric scale after dry-cleaned | the degree of shrinkage | fabric scale before dry-cleaned | fabric scale after dry-cleaned | the degree of shrinkage |
| propylene glycol | one time | 21.6 | 21.5 | 0.46% | 6 | 5.9 | 1.66% |
| methyl ether | two times | 21.6 | 21.6 | 0% | 6 | 6 | 0% |
| propionate | five times | 21.6 | 21.5 | 0.46% | 6 | 6 | 0% |
| stoddard solvent | one time | 21.1 | 20.8 | 1.42% | 6.25 | 6.2 | 0.8% |
| type I | two times | 21.2 | 21.2 | 0% | 6 | 5.8 | 3.33% |
| | five times | 21.3 | 21.15 | 0.7% | 5.9 | 5.85 | 0.84% |

TABLE 14-continued the degree of shrinkage of the dyed fabric of cotton after dry-cleaned one time, two and five times with a dry-cleaning solvent

| cotton | | the degree of shrinkage | | | | | |
|---|---|---|---|---|---|---|---|
| | | warp sense | | | weft sense | | |
| | | fabric scale before dry-cleaned | fabric scale after dry-cleaned | the degree of shrinkage | fabric scale before dry-cleaned | fabric scale after dry-cleaned | the degree of shrinkage |
| stoddard solvent | one time | 4.85 | 4.85 | 0% | 4.9 | 4.9 | 0% |
| type II | two times | 4.9 | 4.9 | 0% | 5 | 5 | 0% |
| | five times | 4.9 | 4.9 | 0% | 5 | 5 | 0% |
| perchloroethylene | one time | 5 | 5 | 0% | 5 | 4.95 | 1% |
| | two times | 4.95 | 4.9 | 1.01% | 4.9 | 4.8 | 2.04% |
| | five times | 5 | 5 | 0% | 4.9 | 4.9 | 0% |

TABLE 15 the degree of shrinkage of the dyed fabric of polyester/cotton after dry-cleaned one time, two and five times with a dry-cleaning solvent

| polyester/cotton | | the degree of shrinkage | | | | | |
|---|---|---|---|---|---|---|---|
| | | warp sense | | | weft sense | | |
| | | fabric scale before dry-cleaned | fabric scale after dry-cleaned | the degree of shrinkage | fabric scale before dry-cleaned | fabric scale after dry-cleaned | the degree of shrinkage |
| propylene glycol | one time | 21.2 | 21.2 | 0% | 6 | 6 | 0% |
| methyl ether | two times | 21.2 | 21.2 | 0% | 6 | 6 | 0% |
| propionate | five times | 21.2 | 21.1 | 0.47% | 6 | 5.9 | 1.66% |
| stoddard solvent | one time | 21.2 | 21.1 | 0.47% | 5.9 | 5.85 | 0.84% |
| type I | two times | 21.2 | 21 | 0.94% | 6.1 | 5.9 | 3.27% |
| | five times | 21.65 | 21.45 | 0.923% | 6 | 5.8 | 3.33% |
| stoddard solvent | one time | 4.8 | 4.8 | 0% | 4.8 | 4.8 | 0% |
| type II | two times | 4.9 | 4.9 | 0% | 4.75 | 4.75 | 0% |
| | five times | 5.1 | 5.1 | 0% | 5 | 5 | 0% |
| perchloroethylene | one time | 4.9 | 4.9 | 0% | 4.9 | 4.9 | 0% |
| | two times | 5 | 5 | 0% | 5 | 5 | 0% |
| | five times | 5 | 5 | 0% | 5 | 5 | 0% |

TABLE 16 the degree of shrinkage of the dyed fabric of nylon after dry-cleaned one time, two and five times with a dry-cleaning solvent

| nylon | | the degree of shrinkage | | | | | |
|---|---|---|---|---|---|---|---|
| | | warp sense | | | weft sense | | |
| | | fabric scale before dry-cleaned | fabric scale after dry-cleaned | the degree of shrinkage | fabric scale before dry-cleaned | fabric scale after dry-cleaned | the degree of shrinkage |
| propylene glycol | one time | 19.8 | 19.8 | 0% | 5.8 | 5.8 | 0% |
| methyl ether | two times | 19.8 | 19.8 | 0% | 5.8 | 5.7 | 1.72% |
| propionate | five times | 19.8 | 19.8 | 0% | 5.8 | 5.7 | 1.72% |
| stoddard solvent | one time | 20.2 | 19.7 | 2.47% | 5.8 | 5.5 | 5.17% |
| type I | two times | 19.95 | 19.7 | 1.25% | 5.9 | 5.65 | 4.23% |
| | five times | 19.7 | 19.35 | 1.77% | 5.7 | 5.3 | 7.01% |
| stoddard solvent | one time | 4.85 | 4.85 | 0% | 4.95 | 4.95 | 0% |
| type II | two times | 5 | 5 | 0% | 4.9 | 4.9 | 0% |
| | five times | 4.9 | 4.9 | 0% | 4.9 | 4.9 | 0% |
| perchloroethylene | one time | 5 | 4.95 | 1% | 5 | 4.95 | 0% |
| | two times | 5 | 4.95 | 1% | 5 | 5 | 0% |
| | five times | 4.9 | 4.9 | 0% | 4.9 | 4.9 | 0% |

TABLE 17 the load weight, the displacement, the stress, the specific stress and the strain of the dyed fabric of wool/polyester at the maximum load point before dry-cleaned and after dry-cleaned with a dry-cleaning solvent

| wool/polyester | load weight (kg) | displacement (mm) | stress (kg/mm$^2$) | specific stress (kg/l) | strain (%) |
|---|---|---|---|---|---|
| before dry-cleaned | 26.39 | 44.48 | 2.31 | 26.39 | 29.65 |
| after dry-cleaned with propylene glycol methyl ether propionate | | | | | |
| one time | 21.67 | 47.62 | 1.9 | 21.67 | 31.75 |
| two times | 22.1 | 46.36 | 1.94 | 22.1 | 30.88 |
| five times | 35.83 | 50.11 | 3.14 | 35.83 | 33.4 |
| ten times | 26.24 | 50.95 | 2.3 | 26.24 | 33.96 |
| twenty times | 27.31 | 49.23 | 2.4 | 27.31 | 32.82 |
| after dry-cleaned with stoddard solvent type I | | | | | |
| one time | 20.25 | 63.75 | 1.5 | 20.25 | 42.5 |
| two times | 17.14 | 47.86 | 1.27 | 17.14 | 31.9 |
| five times | 24.1 | 7.93 | 1.79 | 24.1 | 47.95 |
| after dry-cleaned with stoddard solvent type II | | | | | |
| one time | 24.63 | 71.57 | 1.82 | 24.63 | 47.71 |
| two times | 38.36 | 78.27 | 2.84 | 38.36 | 52.18 |
| five times | 50.88 | 93.5 | 3.77 | 50.88 | 62.33 |
| after dry-cleaned with perchloroethylene | | | | | |
| one time | 21.76 | 75.72 | 1.61 | 21.76 | 50.48 |
| two times | 21.13 | 56.47 | 1.57 | 21.13 | 37.64 |
| five times | 29.11 | 77.59 | 2.15 | 29.11 | 51.72 |

TABLE 18 the load weight, the displacement, the stress, the specific stress and the strain of the dyed fabric of polyester at the maximum load point before dry-cleaned and after dry-cleaned with a dry-cleaning solvent

| polyester | load weight (kg) | displacement (mm) | stress (kg/mm$^2$) | specific stress (kg/l) | strain (%) |
|---|---|---|---|---|---|
| before dry-cleaned | 16.5 | 50.72 | 1.22 | 16.5 | 33.81 |
| after dry-cleaned with propylene glycol methyl ether propionate | | | | | |
| one time | 19.33 | 65.17 | 1.43 | 19.33 | 43.44 |
| two times | 15.73 | 42.72 | 1.16 | 15.73 | 24.48 |
| five times | 22.35 | 67.14 | 1.66 | 22.35 | 44.76 |
| ten times | 20.5 | 59.43 | 1.52 | 20.5 | 39.62 |
| twenty times | 19.18 | 51.05 | 1.42 | 19.18 | 34.03 |
| after dry-cleaned with stoddard solvent type I | | | | | |
| one time | 22.25 | 51.52 | 1.95 | 22.25 | 34.16 |
| two times | 21.47 | 52.31 | 1.88 | 21.47 | 34.87 |
| five times | 23.71 | 44.23 | 2.08 | 23.71 | 29.49 |
| after dry-cleaned with stoddard solvent type II | | | | | |
| one time | 38.61 | 51.52 | 2.9 | 38.61 | 34.34 |
| two times | 35.59 | 55.03 | 2.68 | 35.59 | 36.69 |
| five times | 31.6 | 53.42 | 2.38 | 31.6 | 35.61 |
| after dry-cleaned with perchloroethylene | | | | | |
| one time | 27.8 | 51.94 | 2.09 | 27.8 | 34.62 |
| two times | 23.9 | 48.91 | 1.8 | 23.9 | 32.61 |
| five times | 26.34 | 48.06 | 1.98 | 26.34 | 32.04 |

TABLE 19 the load weight, the displacement, the stress, the specific stress and the strain of the dyed fabric of cotton at the maximum load point before dry-cleaned and after dry-cleaned with a dry-cleaning solvent

| cotton | load weight (kg) | displacement (mm) | stress (kg/mm$^2$) | specific stress (kg/l) | strain (%) |
|---|---|---|---|---|---|
| before dry-cleaned | 20.2 | 27.71 | 2.93 | 20.2 | 18.47 |
| after dry-cleaned with propylene glycol methyl ether propionate | | | | | |
| one time | 33.01 | 14.37 | 4.78 | 33.01 | 9.58 |
| two times | 39.58 | 19.72 | 5.74 | 39.58 | 13.14 |
| five times | 45.18 | 21.21 | 6.55 | 45.18 | 14.14 |
| ten times | 23.95 | 15.91 | 3.47 | 23.95 | 10.6 |
| twenty times | 23.17 | 23.6 | 3.36 | 23.17 | 15.73 |
| after dry-cleaned with stoddard solvent type I | | | | | |
| one time | 40.11 | 18.65 | 5.81 | 40.11 | 12.43 |
| two times | 13.53 | 20.17 | 1.96 | 13.53 | 13.45 |
| five times | 13.49 | 20.33 | 1.95 | 13.49 | 13.55 |
| after dry-cleaned with stoddard solvent type II | | | | | |
| one time | 58.03 | 23.51 | 6.82 | 58.03 | 11.76 |
| two times | 61.93 | 24.86 | 7.28 | 61.93 | 12.43 |
| five times | 37.88 | 21.54 | 4.45 | 37.88 | 10.77 |
| after dry-cleaned with perchloroethylene | | | | | |
| one time | 22.88 | 11.3 | 2.69 | 22.88 | 5.65 |
| two times | 24.73 | 31.9 | 2.9 | 24.73 | 15.95 |
| five times | 23.52 | 28.06 | 2.76 | 23.52 | 14.03 |

TABLE 20 the load weight, the displacement, the stress, the specific stress and the strain of the dyed fabric of wool at the maximum load point before dry-cleaned and after dry-cleaned with a dry-cleaning solvent

| wool | load weight (kg) | displacement (mm) | stress (kg/mm$^2$) | specific stress (kg/l) | strain (%) |
|---|---|---|---|---|---|
| before dry-cleaned | 20.35 | 23.9 | 1.36 | 20.35 | 23.9 |
| after dry cleaned with propylene glycol methyl ether propionate | | | | | |
| one time | 13.83 | 47.04 | 0.92 | 13.83 | 47.94 |
| two times | 14.02 | 48.77 | 0.93 | 14.02 | 48.77 |
| five times | 13.15 | 43.11 | 0.88 | 13.15 | 43.11 |
| ten times | 14.21 | 39.62 | 0.93 | 14.02 | 39.62 |
| twenty times | 14.31 | 53.23 | 0.95 | 14.31 | 53.23 |
| after dry-cleaned with stoddard solvent type I | | | | | |
| one time | 24.39 | 44.03 | 1.63 | 24.39 | 44.03 |
| two times | 13.49 | 53.63 | 0.9 | 13.49 | 53.63 |
| five times | 23.81 | 37.08 | 1.59 | 23.81 | 37.08 |
| after dry-cleaned with stoddard solvent type II | | | | | |
| one time | 32.81 | 79.66 | 1.64 | 32.81 | 39.83 |
| two times | 28.58 | 78.02 | 1.43 | 28.58 | 39.01 |
| five times | 25.75 | 87.1 | 1.29 | 25.75 | 43.55 |
| after dry-cleaned with perchloroethylene | | | | | |
| one time | 16.65 | 81.25 | 0.83 | 16.65 | 40.62 |
| two times | 15.38 | 69.71 | 0.77 | 15.38 | 34.85 |
| five times | 13.92 | 75.31 | 0.7 | 13.92 | 37.66 |

TABLE 21 the load weight, the displacement, the stress, the specific stress and the strain of the dyed fabric of wool/polyacrylonitrile at the maximum load point before dry-cleaned and after dry-cleaned with a dry-cleaning solvent

| wool/ polyacrylonitrile | load weight (kg) | displacement (mm) | stress (kg/mm$^2$) | specific stress (kg/l) | strain (%) |
|---|---|---|---|---|---|
| before dry-cleaned | 16.99 | 32.46 | 1.03 | 16.99 | 21.64 |
| after dry-cleaned with propylene glycol methyl ether propionate | | | | | |
| one time | 23.71 | 43.26 | 1.44 | 23.71 | 28.84 |
| two times | 23.95 | 42.49 | 1.45 | 23.95 | 28.32 |
| five times | 25.51 | 46.68 | 1.55 | 25.51 | 29.12 |
| ten times | 25.66 | 41.57 | 1.55 | 25.66 | 27.71 |
| twenty times | 20.93 | 38.5 | 1.27 | 20.93 | 25.66 |
| after dry-cleaned with stoddard solvent type I | | | | | |
| one time | 22.49 | 39.89 | 1.36 | 22.49 | 26.6 |
| two times | 19.47 | 37.2 | 1.18 | 19.47 | 24.8 |
| five times | 20.06 | 39.92 | 1.22 | 20.06 | 26.61 |
| after dry-cleaned with stoddard solvent type II | | | | | |
| one time | 24.73 | 70.11 | 1.28 | 24.73 | 35.05 |
| two times | 24.73 | 69.84 | 1.28 | 24.73 | 34.9 |
| five times | 21.08 | 62.28 | 1.1 | 21.08 | 31.14 |
| after dry-cleaned with perchloroethylene | | | | | |
| one time | 21.18 | 50.92 | 1.1 | 21.18 | 25.46 |
| two times | 19.04 | 50.65 | 0.99 | 19.04 | 25.33 |
| five times | 16.46 | 45.23 | 0.85 | 16.46 | 22.62 |

TABLE 22 the load weight, the displacement, the stress, the specific stress and the strain of the dyed fabric of nylon/polyacrylonitrile at the maximum load point before dry-cleaned and after dry-cleaned with a dry-cleaning solvent

| nylon/ polyacrlonitrile | load weight (kg) | displacement (mm) | stress (kg/mm$^2$) | specific stress (kg/l) | strain (%) |
|---|---|---|---|---|---|
| before dry-cleaned | 11.49 | 62.08 | 1.2 | 11.49 | 41.39 |
| after dry-cleaned with propylene glycol methyl ether propionate | | | | | |
| one time | 10.13 | 63.53 | 1.05 | 10.13 | 42.35 |
| two times | 10.08 | 58.21 | 1.05 | 10.08 | 38.8 |
| five times | 10.08 | 58.21 | 1.05 | 10.08 | 38.8 |
| ten times | 14.56 | 53.32 | 1.52 | 14.56 | 35.54 |
| twenty times | 8.67 | 56.61 | 0.9 | 8.67 | 37.74 |
| after dry-cleaned with stoddard solvent type I | | | | | |
| one time | 11.07 | 66.48 | 1.15 | 11.07 | 44.32 |
| two times | 10.12 | 64.68 | 1.05 | 10.12 | 43.12 |
| five times | 13.58 | 62.3 | 1.41 | 13.58 | 41.51 |
| after dry-cleaned with stoddard solvent type II | | | | | |
| one time | 15.37 | 53.35 | 1.2 | 15.37 | 35.57 |
| two times | 15.26 | 86.85 | 1.19 | 15.26 | 57.9 |
| five times | 14.4 | 64 | 1.12 | 14.4 | 42.67 |
| after dry-cleaned with perchloroethylene | | | | | |
| one time | 12.86 | 73 | 1 | 12.86 | 48.66 |
| two times | 14.47 | 84.76 | 1.13 | 14.47 | 56.5 |
| five times | 9.67 | 57.66 | 0.76 | 9.67 | 38.44 |

TABLE 23 the load weight, the displacement, the stress, the specific stress and the strain of the dyed fabric of nylon at the maximum load point before dry-cleaned and after dry-cleaned with a dry-cleaning solvent

| nylon | load weight (kg) | displacement (mm) | stress (kg/mm$^2$) | specific stress (kg/l) | strain (%) |
|---|---|---|---|---|---|
| before dry-cleaned | 27.95 | 50.56 | — | 27.95 | 33.7 |
| after dry-cleaned with propylene glycol methyl ether propionate | | | | | |
| one time | 55.55 | 40.48 | — | 55.55 | 26.98 |
| two times | 30.43 | 26.95 | — | 30.43 | 17.72 |
| five times | 59.25 | 62.73 | — | 59.25 | 41.82 |
| ten times | 48.49 | 39.67 | — | 48.49 | 26.44 |
| twenty times | 43.04 | 37.10 | — | 43.04 | 24.73 |
| after dry-cleaned with stoddard solvent type I | | | | | |
| one time | 63.19 | 70.53 | — | 63.19 | 47.02 |
| two times | 60.71 | 44.92 | — | 60.71 | 29.94 |
| five times | 59.25 | 60.84 | — | 59.25 | 40.56 |
| after dry-cleaned with stoddard solvent type II | | | | | |
| one time | 41.63 | 53.72 | 5.92 | 41.63 | 35.81 |
| two times | 77.65 | 51.36 | 11.05 | 77.65 | 34.24 |
| five times | 66.55 | 45.54 | 9.47 | 66.55 | 30.36 |
| after dry-cleaned with perchloroethylene | | | | | |
| one time | 29.36 | 54.12 | 4.18 | 29.36 | 36.08 |
| two times | 31.84 | 52.12 | 4.53 | 31.84 | 34.74 |
| five times | 33.15 | 58.47 | 4.72 | 33.15 | 38.98 |

TABLE 24 the load weight, the displacement, the stress, the specific stress and the strain of the dyed fabric of polyester/rayon at the maximum load point before dry-cleaned and after dry-cleaned with a dry-cleaning solvent

| polyester/rayon | load weight (kg) | displacement (mm) | stress (kg/mm$^2$) | specific stress (kg/l) | strain (%) |
|---|---|---|---|---|---|
| before dry-cleaned | 40.75 | 40.93 | 3.02 | 40.75 | 27.29 |
| after dry-cleaned with propylene glycol methyl ether propionate | | | | | |
| one time | 43.14 | 44.55 | 3.2 | 43.14 | 29.7 |
| two times | 38.7 | 42.1 | 2.87 | 38.7 | 28.07 |
| five times | 40.99 | 41.69 | 3.04 | 40.99 | 27.79 |
| ten times | 45.91 | 43.86 | 3.4 | 45.91 | 29.24 |
| twenty times | 49.81 | 45.23 | 3.69 | 49.81 | 30.15 |
| after dry-cleaned with stoddard solvent type I | | | | | |
| one time | 39.58 | 42.9 | 2.93 | 39.58 | 28.6 |
| two times | 41.19 | 44 | 3.05 | 41.19 | 29.35 |
| five times | 46.4 | 45.68 | 3.44 | 46.4 | 30.45 |
| after dry-cleaned with stoddard solvent type II | | | | | |
| one time | 95.33 | 68.08 | 5.3 | 95.33 | 30.04 |
| two times | 44.11 | 39.71 | 2.45 | 44.11 | 19.86 |
| five times | 21.26 | 33.27 | 1.74 | 31.26 | 16.64 |
| after dry-cleaned with perchloroethylene | | | | | |
| one time | 45.57 | 53.34 | 2.53 | 45.57 | 26.67 |
| two times | 47.57 | 57.02 | 2.64 | 47.57 | 28.5 |
| five times | 55.11 | 57.82 | 3.06 | 55.11 | 28.91 |

TABLE 25 the load weight, the displacement, the stress, the specific stress and the strain of the dyed fabric of polyester/cotton at the maximum load point before dry-cleaned and after dry-cleaned with a dry-cleaning solvent

| polyester/cotton | load weight (kg) | displacement (mm) | stress (kg/mm$^2$) | specific stress (kg/l) | strain (%) |
|---|---|---|---|---|---|
| before dry-cleaned | 18.26 | 23.92 | 2.6 | 18.26 | 15.94 |
| after dry-cleaned with propylene glycol methyl ether propionate | | | | | |
| one time | 21.62 | 31.79 | 3.25 | 21.62 | 21.2 |
| two times | 21.91 | 31.41 | 3.29 | 21.91 | 20.94 |
| five times | 22.78 | 33.36 | 3.43 | 22.78 | 22.24 |
| ten times | 22.54 | 32.22 | 3.39 | 22.54 | 21.48 |
| twenty times | 22.05 | 31.95 | 3.32 | 22.05 | 21.3 |
| after dry-cleaned with stoddard solvent type I | | | | | |
| one time | 21.76 | 28.88 | 3.27 | 21.76 | 19.25 |
| two times | 23.37 | 30.37 | 3.51 | 23.37 | 20.24 |
| five times | 22.69 | 31.7 | 3.41 | 22.69 | 21.13 |
| after dry-cleaned with stoddard solvent type II | | | | | |
| one time | 48.93 | 28.63 | 6.96 | 48.93 | 14.31 |
| two times | 42.21 | 26.5 | 6 | 42.21 | 13.25 |
| five times | 40.85 | 29.53 | 5.81 | 40.85 | 17.76 |
| after dry-cleaned with perchloroethylene | | | | | |
| one time | 22.83 | 34.94 | 3.25 | 22.83 | 17.47 |
| two times | 21.42 | 32.96 | 3.05 | 21.24 | 16.48 |
| five times | 16.8 | 27.93 | 2.39 | 16.8 | 13.96 |

TABLE 26 the load weight, the displacement, the stress, the specific stress and the strain of the undyed fabric of gray cotton goods at the maximum load point before dry-cleaned and after dry-cleaned with a dry-cleaning solvent

| gray cotton goods | load weight (kg) | displacement (mm) | stress (kg/mm$^2$) | specific stress (kg/l) | strain (%) |
|---|---|---|---|---|---|
| before dry-cleaned | 33.98 | 13.35 | 6.8 | 33.98 | 6.67 |
| after dry-cleaned with propylene glycol methyl ether propionate | | | | | |
| one time | 22.44 | 14.36 | 4.49 | 22.44 | 7.18 |
| two times | 24.73 | 14.33 | 4.95 | 24.73 | 7.17 |
| five times | 31.89 | 17.54 | 6.38 | 31.89 | 8.77 |
| after dry-cleaned with stoddard solvent type I | | | | | |
| one time | 24.63 | 14.7 | 4.93 | 24.63 | 7.35 |
| two times | 22.59 | 14.51 | 4.52 | 22.59 | 7.25 |
| five times | 22.95 | 16.2 | 5.9 | 25.95 | 8.1 |
| after dry-cleaned with stoddard solvent type II | | | | | |
| one time | 29.99 | 15.46 | 6 | 29.99 | 7.73 |
| two times | 37.78 | 18.13 | 7.56 | 37.78 | 9.06 |
| five times | 22.15 | 15.37 | 4.43 | 22.15 | 7.69 |
| after dry-cleaned with perchloroethylene | | | | | |
| one time | 31.94 | 48.52 | 6.39 | 31.94 | 9.26 |
| two times | 21.71 | 16.54 | 4.34 | 21.71 | 8.27 |
| five times | 23.13 | 15.89 | 4.63 | 12.13 | 7.94 |

TABLE 27 the load weight, the displacement, the stress, the specific stress and the strain of the undyed fabric of gray nylon goods at the maximum load point before dry-cleaned and after dry-cleaned with a dry-cleaning solvent

| gray nylon goods | load weight (kg) | displacement (mm) | stress (kg/mm$^2$) | specific stress (kg/l) | strain (%) |
|---|---|---|---|---|---|
| before dry-cleaned | 20.74 | 41.12 | 4.15 | 20.74 | 20.56 |
| after dry cleaned with propylene glycol methyl ether propionate | | | | | |
| one time | 27.22 | 63.59 | 5.44 | 27.22 | 31.79 |
| two times | 31.89 | 58.07 | 6.38 | 31.89 | 29.03 |
| five times | 28.33 | 63.19 | 5.67 | 28.33 | 31.59 |
| after dry-cleaned with stoddard solvent type I | | | | | |
| one time | 31.21 | 57.9 | 6.24 | 31.21 | 28.95 |
| two times | 24.93 | 58.04 | 4.99 | 24.93 | 29.02 |
| five times | 26.68 | 65.98 | 5.34 | 26.68 | 32.99 |
| after dry-cleaned with stoddard solvent type II | | | | | |
| one time | 28.04 | 61.58 | 5.61 | 28.04 | 30.79 |
| two times | 24.39 | 39.36 | 4.88 | 24.39 | 19.68 |
| five times | 24.05 | 60.41 | 4.81 | 24.05 | 30.2 |
| after dry-cleaned with perchloroethylene | | | | | |
| one time | 32.81 | 65.96 | 6.56 | 32.81 | 32.98 |
| two times | 28.29 | 59.26 | 5.66 | 28.29 | 29.63 |
| five times | 32.28 | 63.23 | 6.46 | 32.28 | 31.62 |

TABLE 28 the load weight, the displacement, the stress, the specific stress and the strain of the undyed fabric of gray polyester goods at the maximum load point before dry-cleaned and after dry-cleaned with a dry-cleaning solvent

| gray polyester goods | load weight (kg) | displacement (mm) | stress (kg/mm$^2$) | specific stress (kg/l) | strain (%) |
|---|---|---|---|---|---|
| before dry-cleaned | 63.49 | 44.85 | 12.7 | 63.49 | 22.43 |
| after dry-cleaned with propylene glycol methyl ether propionate | | | | | |
| one time | 40.51 | 65.2 | 5.79 | 40.51 | 32.6 |
| two times | 35.74 | 57.25 | 5.1 | 35.74 | 28.63 |
| five times | 30.67 | 59.17 | 4.38 | 30.67 | 29.59 |
| after dry-cleaned with stoddard solvent type I | | | | | |
| one time | 35.39 | 60.53 | 5.06 | 35.39 | 30.27 |
| two times | 37.24 | 60.33 | 5.32 | 37.24 | 30.16 |
| five times | 38.61 | 59.47 | 5.52 | 38.61 | 29.73 |
| after dry-cleaned with stoddard solvent type II | | | | | |
| one time | 33.5 | 57.02 | 4.79 | 33.5 | 28.51 |
| two times | 34.81 | 57.51 | 4.97 | 34.81 | 28.76 |
| five times | 28.17 | 52.87 | 5.45 | 38.17 | 26.44 |
| after dry-cleaned with perchloroethylene | | | | | |
| one time | 33.2 | 60.46 | 4.74 | 33.2 | 30.23 |
| two times | 27.46 | 60.35 | 3.92 | 27.46 | 30.18 |
| five times | 36.66 | 54.62 | 5.24 | 36.66 | 27.31 |

TABLE 29 the load weight, the displacement, the stress, the specific stress and the strain of the undyed fabric of gray silk goods at the maximum load point before dry-cleaned and after dry-cleaned with a dry-cleaning solvent

| gray silk goods | load weight (kg) | displacement (mm) | stress (kg/mm$^2$) | specific stress (kg/l) | strain (%) |
|---|---|---|---|---|---|
| before dry-cleaned | 32.08 | 53.43 | 5.83 | 32.08 | 26.72 |
| after dry-cleaned with propylene glycol methyl ether propionate | | | | | |
| one time | 15.63 | 38.99 | 2.84 | 95.63 | 19.5 |
| two times | 32.57 | 55.75 | 5.92 | 32.57 | 27.88 |
| five times | 27.26 | 60.53 | 4.96 | 27.26 | 30.26 |
| after dry-cleaned with stoddard solvent type I | | | | | |
| one time | 31.74 | 62.08 | 5.77 | 31.74 | 31.04 |
| two times | 27.75 | 45.03 | 27.75 | 27.75 | 22.52 |
| five times | 28.97 | 60.48 | 28.97 | 28.97 | 30.24 |
| after dry-cleaned with stoddard solvent type II | | | | | |
| one time | 28.58 | 57.89 | 5.2 | 28.58 | 28.94 |
| two times | 33.11 | 58.92 | 6.02 | 33.11 | 29.46 |
| five times | 29.16 | 60.2 | 5.3 | 29.16 | 30.1 |
| after dry-cleaned with perchloroethylene | | | | | |
| one time | 22.59 | 52.77 | 4.11 | 22.59 | 26.39 |
| two times | 23.81 | 64.41 | 4.33 | 23.81 | 33.7 |
| five times | 28.29 | 54.2 | 5.14 | 28.29 | 27.1 |

TABLE 30 the load weight, the displacement, the stress, the specific stress and the strain of the undyed fabric of gray wool goods at the maximum load point before dry-cleaned and after dry-cleaned with a dry-cleaning solvent

| gray wool goods | load weight (kg) | displacement (mm) | stress (kg/mm$^2$) | specific stress (kg/l) | strain (%) |
|---|---|---|---|---|---|
| before dry-cleaned | 84.91 | 88.83 | 4.85 | 84.91 | 59.22 |
| after dry-cleaned with propylene glycol methyl ether propionate | | | | | |
| one time | 82.57 | 87.75 | 4.72 | 82.57 | 58.5 |
| two times | 85.2 | 89.39 | 4.87 | 85.2 | 59.6 |
| five times | 76.24 | 81.58 | 4.36 | 76.24 | 54.39 |
| after dry-cleaned with stoddard solvent type I | | | | | |
| one time | 77.26 | 83.89 | 4.42 | 77.26 | 55.92 |
| two times | 90.56 | 86.75 | 5.17 | 90.56 | 57.83 |
| five times | 85 | 84.55 | 4.86 | 85 | 56.36 |
| after dry-cleaned with stoddard solvent type II | | | | | |
| one time | 85.49 | 85.25 | 4.89 | 85.49 | 56.83 |
| two times | 87.93 | 83.54 | 5.02 | 87.93 | 55.69 |
| five times | 82.33 | 87.03 | 4.7 | 82.33 | 58.02 |
| after dry-cleaned with perchloroethylene | | | | | |
| one time | 83.64 | 82.56 | 4.78 | 83.64 | 55.04 |
| two times | 88.56 | 90.89 | 5.06 | 88.56 | 60.59 |
| five times | 67.14 | 74.1 | 3.84 | 67.14 | 49.4 |

TABLE 31 the bursting strength and softness of the dyed fabric of wool/polyester before dry-cleaned and after dry-cleaned with a dry-cleaning solvent

| | bursting strength | | | |
|---|---|---|---|---|
| | bursting | | softness | |
| wool/polyester | strength (kg · f/cm$^2$) | percentage of variation | softness (cm) | percentage of variation |
| before dry-cleaned | 13 | — | 2.83 | — |
| after dry-cleaned with propylene glycol methyl ether propionate | | | | |
| one time | 13.5 | 3.85 | 2.6 | −8.13 |
| two times | 13.5 | 3.85 | 2.6 | −8.13 |
| five times | 13 | 0 | 2.7 | −4.59 |
| ten times | 13.75 | 5.77 | 2.8 | −1.06 |
| twenty times | 13 | 0 | 2.8 | −1.06 |
| after dry-cleaned with stoddard solvent type I | | | | |
| one time | 13.5 | 3.85 | 2.5 | −11.66 |
| two times | 13.5 | 3.85 | 2.3 | −18.73 |
| five times | 13.25 | 1.92 | 2.6 | −8.13 |
| after dry-cleaned with stoddard solvent type II | | | | |
| one time | 13.5 | 3.85 | 2.7 | −4.59 |
| two times | 13.5 | 3.85 | 3.05 | 7.77 |
| five times | 13 | 0 | 2.6 | −8.13 |
| after dry-cleaned with perchloroethylene | | | | |
| one time | 13 | 0 | 2.9 | 2.47 |
| two times | 13 | 0 | 2.7 | −4.59 |
| five times | 13.25 | 1.92 | 2.7 | −4.59 |

TABLE 32 the bursting strength and softness of the dyed fabric of wool before dry-cleaned and after dry-cleaned with a dry-cleaning solvent

| | bursting strength | | softness | |
|---|---|---|---|---|
| wool | bursting strength (kg · f/cm$^2$) | percentage of variation | softness (cm) | percentage of variation |
| before dry-cleaned | 9.5 | — | 3.25 | — |
| after dry-cleaned with propylene glycol methyl ether propionate | | | | |
| one time | 10 | 11.08 | 2.1 | −35.28 |
| two times | 10 | 11.08 | 3.3 | 1.538 |
| five times | 10 | 11.08 | 2.8 | −13.85 |
| ten times | 10 | 11.08 | 2.3 | −29.23 |
| twenty times | 10 | 11.08 | 2.2 | −32.3 |
| after dry-cleaned with stoddard solvent type I | | | | |
| one time | 10 | 11.08 | 3.1 | −4.61 |
| two times | 10 | 11.08 | 2.6 | −20 |
| five times | 10 | 11.08 | 2.3 | −29.23 |
| after dry-cleaned with stoddard solvent type II | | | | |
| one time | 9.5 | 0 | 3.1 | −4.61 |
| two times | 10 | 11.08 | 3.4 | 4.62 |
| five times | 9.75 | 2.63 | 3.9 | 20 |
| after dry-cleaned with perchloroethylene | | | | |
| one time | 9.25 | −2.63 | 2.5 | −23.08 |
| two times | 9 | −5.26 | 2.2 | −32.3 |
| five times | 9.25 | −2.63 | 2 | −38.46 |

TABLE 33 the bursting strength and softness of the dyed fabric of polyester before dry-cleaned and after dry-cleaned with a dry-cleaning solvent

| polyester | bursting strength (kg · f/cm$^2$) | bursting strength percentage of variation | softness (cm) | softness percentage of variation |
|---|---|---|---|---|
| before dry-cleaned | 13 | — | 2.1 | — |
| after dry-cleaned with propylene glycol methyl ether propionate | | | | |
| one time | 13 | 0 | 1.7 | −19.05 |
| two times | 12.5 | −3.85 | 1.7 | −19.05 |
| five times | 12.75 | −1.92 | 2.1 | 0 |
| ten times | 12.5 | −3.85 | 1.9 | −9.52 |
| twenty times | 12.75 | −1.92 | 2 | −4.76 |
| after dry-cleaned with stoddard solvent type I | | | | |
| one time | 13 | 0 | 1.7 | −19.05 |
| two times | 12.75 | −1.92 | 1.6 | −23.81 |
| five times | 12.25 | −1.92 | 1.6 | −23.81 |
| after dry-cleaned with stoddard solvent type II | | | | |
| one time | 12.75 | −1.92 | 2.05 | −2.38 |
| two times | 12.5 | −3.85 | 2.5 | 19.5 |
| five times | 12.5 | −3.85 | 2.4 | 14.29 |
| after dry-cleaned with perchloroethylene | | | | |
| one time | 12.5 | −3.85 | 1.8 | −14.29 |
| two times | 13 | 0 | 2 | −4.76 |
| five times | 12.5 | −3.85 | 1.8 | −14.29 |

TABLE 34 the bursting strength and softness of the dyed fabric of wool/polyacrylonitrile before dry-cleaned and after dry-cleaned with a dry-cleaning solvent

| wool/poly-acrylonitrile | bursting strength (kg · f/cm$^2$) | bursting strength percentage of variation | softness (cm) | softness percentage of variation |
|---|---|---|---|---|
| before dry-cleaned | 11 | — | 2.7 | — |
| after dry-cleaned with propylene glycol methyl ether propionate | | | | |
| one time | 11.5 | 4.55 | 2.6 | −3.7 |
| two times | 11.5 | 4.55 | 2.9 | 7.41 |
| five times | 11 | 0 | 2.9 | 7.41 |
| ten times | 12.5 | 13.64 | 2.7 | 0 |
| twenty times | 11 | 0 | 2.4 | −11.11 |
| after dry-cleaned with stoddard solvent type I | | | | |
| one time | 11 | 0 | 2.7 | 0 |
| two times | 11.5 | 4.55 | 2.7 | 0 |
| five times | 12 | 9.09 | 2.6 | −3.7 |
| after dry-cleaned with stoddard solvent type II | | | | |
| one time | 11.5 | 4.55 | 2.55 | −5.56 |
| two times | 12.25 | 11.36 | 2.85 | 0.56 |
| five times | 11.25 | 2.27 | 2.4 | −11.11 |
| after dry-cleaned with perchloroethylene | | | | |
| one time | 11.75 | 6.82 | 3 | 11.11 |
| two times | 11.25 | 2.27 | 2.7 | 0 |
| five times | 12.25 | 11.36 | 2.6 | −3.7 |

TABLE 35 the bursting strength and softness of the dyed fabric of polyester/rayon before dry-cleaned and after dry-cleaned with a dry-cleaning solvent

| polyester/rayon | bursting strength (kg · f/cm$^2$) | bursting strength percentage of variation | softness (cm) | softness percentage of variation |
|---|---|---|---|---|
| before dry-cleaned | 26 | — | 2.63 | — |
| after dry-cleaned with propylene glycol methyl ether propionate | | | | |
| one time | 26 | 0 | 2.8 | 6.46 |
| two times | 28 | 7.69 | 2.6 | −1.14 |
| five times | 27 | 3.85 | 2.5 | −4.94 |
| ten times | 27 | 3.85 | 2.5 | −4.94 |
| twenty times | 27 | 3.85 | 2.5 | −4.94 |
| after dry-cleaned with stoddard solvent type I | | | | |
| one time | 28 | 7.69 | 2.3 | −12.55 |
| two times | 28 | 7.69 | 2.3 | −12.55 |
| five times | 28.75 | 10.58 | 2.5 | −4.94 |
| after dry-cleaned with stoddard solvent type II | | | | |
| one time | 28.25 | 8.65 | 3.1 | 17.87 |
| two times | 26.5 | 1.92 | 2.65 | 0.76 |
| five times | 27.5 | 5.77 | 2.6 | −1.14 |
| after dry-cleaned with perchloroethylene | | | | |
| one time | 25.5 | −1.92 | 2.6 | −1.14 |
| two times | 27.25 | 14.81 | 2.5 | −4.94 |
| five times | 26 | 0 | 2.3 | −12.55 |

TABLE 36 the bursting strength and softness of the dyed fabric of nylon/polyacrylonitrile before dry-cleaned and after dry-cleaned with a dry-cleaning solvent

| nylon/poly-acrylonitrile | bursting strength (kg · f/cm$^2$) | bursting strength percentage of variation | softness (cm) | softness percentage of variation |
|---|---|---|---|---|
| before dry-cleaned | 5.67 | — | 2 | — |
| after dry-cleaned with propylene glycol methyl ether propionate | | | | |
| one time | 7.5 | 32.28 | 2 | 0 |
| two times | 6.5 | 14.64 | 1.9 | −5 |
| five times | 6.25 | 10.23 | 2.1 | 5 |
| ten times | 6.25 | 10.23 | 2.2 | 10 |
| twenty times | 6 | 5.82 | 1.9 | −5 |
| after dry-cleaned with stoddard solvent type I | | | | |
| one time | 6 | 5.82 | 1.9 | −5 |
| two times | 6.5 | 14.64 | 2 | 0 |
| five times | 7 | 0.23 | 2 | 0 |
| after dry-cleaned with stoddard solvent type II | | | | |
| one time | 6 | 5.82 | 2.3 | 15 |
| two times | 6.25 | 10.23 | 2 | 0 |
| five times | 6.25 | 10.23 | 2.2 | 10 |
| after dry-cleaned with perchloroethylene | | | | |
| one time | 6.25 | 10.23 | 2.2 | 10 |
| two times | 6.25 | 10.23 | 2 | 0 |
| five times | 6.25 | 10.23 | 2 | 0 |

TABLE 37 the bursting strength and softness of the dyed fabric of cotton before dry-cleaned and after dry-cleaned with a dry-cleaning solvent

| | bursting strength | | softness | |
|---|---|---|---|---|
| cotton | bursting strength (kg · f/cm$^2$) | percentage of variation | softness (cm) | percentage of variation |
| before dry-cleaned | 11.67 | — | 2.15 | — |
| after dry-cleaned with propylene glycol methyl ether propionate | | | | |
| one time | 10 | −14.31 | 3.3 | 53.49 |
| two times | 11.5 | −14.57 | 3 | 39.53 |
| five times | 11 | −5.74 | 2.9 | 0.35 |
| ten times | 11.25 | −3.6 | 2.8 | 30.23 |
| twenty times | 11.75 | 0.69 | 2.5 | 16.28 |
| after dry-cleaned with stoddard solvent type I | | | | |
| one time | 11 | −5.74 | 3.4 | 58.14 |
| two times | 11.25 | −14.57 | 3.4 | 58.14 |
| five times | 11.25 | −3.6 | 2.7 | 25.58 |
| after dry-cleaned with stoddard solvent type II | | | | |
| one time | 11 | −5.74 | 4 | 86.05 |
| two times | 11 | −5.74 | 3.65 | 69.77 |
| five times | 10.5 | −10.03 | 3.9 | 81.4 |
| after dry-cleaned with perchloroethylene | | | | |
| one time | 12.25 | 4.97 | 3.4 | 58.14 |
| two times | 12 | 2.83 | 3 | 39.53 |
| five times | 11.5 | −14.57 | 2.9 | 0.35 |

TABLE 38 the bursting strength and softness of the dyed fabric of polyester/cotton before dry-cleaned and after dry-cleaned with a dry-cleaning solvent

| | bursting strength | | softness | |
|---|---|---|---|---|
| polyester/cotton | bursting strength (kg · f/cm$^2$) | percentage of variation | softness (cm) | percentage of variation |
| before dry-cleaned | 12 | — | 2.63 | — |
| after dry-cleaned with propylene glycol methyl ether propionate | | | | |
| one time | 11.5 | −4.17 | 2.8 | 6.46 |
| two times | 11.5 | −4.17 | 2.4 | −8.75 |
| five times | 11 | −8.33 | 2.4 | −8.75 |
| ten times | 11.5 | −4.17 | 2.4 | −8.75 |
| twenty times | 11.5 | −4.17 | 2.4 | −8.75 |
| after dry-cleaned with stoddard solvent type I | | | | |
| one time | 11.5 | −4.17 | 2.7 | 2.66 |
| two times | 11.5 | −4.17 | 2.6 | −1.14 |
| five times | 11.5 | −4.17 | 2.6 | −1.14 |
| after dry-cleaned with stoddard solvent type II | | | | |
| one time | 12.5 | 4.17 | 3.6 | 36.88 |
| two times | 11.75 | −2.08 | 3.05 | 15.97 |
| five times | 11.25 | −6.25 | 3.5 | 33.08 |
| after dry-cleaned with perchloroethylene | | | | |
| one time | 2 | 0 | 2.45 | −6.84 |
| two times | 12 | 0 | 3 | 14.07 |
| five times | 11.5 | −4.17 | 2.7 | 2.66 |

TABLE 39 the bursting strength and softness of the dyed fabric of nylon before dry-cleaned and after dry-cleaned with a dry-cleaning solvent

| | bursting strength | | softness | |
|---|---|---|---|---|
| nylon | bursting strength (kg · f/cm$^2$) | percentage of variation | softness (cm) | percentage of variation |
| before dry-cleaned | 19.76 | — | 5.05 | — |
| after dry-cleaned with propylene glycol methyl ether propionate | | | | |
| one time | 18 | −8.49 | 5.5 | 8.91 |
| two times | 19.5 | −0.86 | 5 | −0.99 |
| five times | 17.5 | −11.03 | 5 | −0.99 |
| ten times | 18 | −8.49 | 5 | −0.99 |
| twenty times | 18 | −8.49 | 4.9 | −2.97 |
| after dry-cleaned with stoddard solvent type I | | | | |
| one time | 19.5 | −0.86 | 6.2 | 22.77 |
| two times | 18.5 | −5.95 | 6.3 | 24.75 |
| five times | 17.5 | −11.03 | 6.5 | 28.71 |
| after dry-cleaned with stoddard solvent type II | | | | |
| one time | 18.5 | −5.95 | 3.55 | −29.7 |
| two times | 18.25 | −7.22 | 5.95 | 17.82 |
| five times | 19.25 | −0.86 | 5.8 | 14.85 |
| after dry-cleaned with perchloroethylene | | | | |
| one time | 19.5 | −0.86 | 4.2 | −16.83 |
| two times | 19 | −3.41 | 3.6 | −28.71 |
| five times | 19 | −3.41 | 3.3 | −34.65 |

TABLE 40 the bursting strength and softness of the undyed fabric of gray polyester goods before dry-cleaned and after dry-cleaned with a dry-cleaning solvent

| | bursting strength | | softness | |
|---|---|---|---|---|
| gray polyester goods | bursting strength (kg · f/cm$^2$) | percentage of variation | softness (cm) | percentage of variation |
| before dry-cleaned | 20 | — | 3.9 | — |
| after dry-cleaned with propylene glycol methyl ether propionate | | | | |
| one time | 21.5 | 7.5 | 4.6 | 2.56 |
| two times | 21 | 5 | 3.5 | −10.26 |
| five times | 20.25 | 1.25 | 3.6 | −7.7 |
| after dry-cleaned with stoddard solvent type I | | | | |
| one time | 22 | 10 | 4 | 2.56 |
| two times | 20.5 | 2.5 | 4.5 | 15.38 |
| five times | 21.75 | 8.75 | 3.4 | −12.82 |
| after dry-cleaned with stoddard solvent type II | | | | |
| one time | 20.5 | 2.5 | 4.1 | 5.13 |
| two times | 21.5 | 7.5 | 3 | −23.08 |
| five times | 20 | 0 | 3.4 | −12.82 |
| after dry-cleaned with perchloroethylene | | | | |
| one time | 20 | 0 | 3.7 | −5.13 |
| two times | 20.5 | 2.5 | 3.3 | −15.38 |
| five times | 20 | 0 | 2.5 | −35.9 |

TABLE 41 the bursting strength and softness of the undyed fabric of gray nylon goods before dry-cleaned and after dry-cleaned with a dry-cleaning solvent

| | bursting strength | | softness | |
|---|---|---|---|---|
| gray nylon goods | bursting strength (kg · f/cm$^2$) | percentage of variation | softness (cm) | percentage of variation |
| before dry-cleaned | 12.87 | — | 4 | — |
| after dry-cleaned with propylene glycol methyl ether propionate | | | | |
| one time | 12.5 | −5.59 | 2.7 | −32.5 |
| two times | 12.5 | −5.59 | 2.6 | −35 |
| five times | 12.5 | −5.59 | 2.7 | −32.5 |
| after dry-cleaned with stoddard solvent type I | | | | |
| one time | 12.5 | −5.59 | 3 | −25 |
| two times | 12.5 | −5.59 | 3.9 | −25 |
| five times | 12.75 | −0.93 | 3 | −25 |
| after dry-cleaned with stoddard solvent type II | | | | |
| one time | 12.5 | −5.59 | 4.1 | 2.5 |
| two times | 12.5 | −5.59 | 3 | −2.5 |
| five times | 12.5 | −5.59 | 2.9 | −27.5 |
| after dry-cleaned with perchloroethylene | | | | |
| one time | 12.75 | −0.93 | 3.9 | −2.5 |
| two times | 12.25 | −4.82 | 3.2 | −20 |
| five times | 12.25 | −4.82 | 2.8 | −30 |

TABLE 42 the bursting strength and softness of the undyed fabric of gray cotton goods before dry-cleaned and after dry-cleaned with a dry-cleaning solvent

| | bursting strength | | softness | |
|---|---|---|---|---|
| gray cotton goods | bursting strength (kg · f/cm$^2$) | percentage of variation | softness (cm) | percentage of variation |
| before dry-cleaned | 13.5 | — | 5.4 | — |
| after dry-cleaned with propylene glycol methyl ether propionate | | | | |
| one time | 12.5 | −7.41 | 5.8 | 7.41 |
| two times | 12.75 | −5.56 | 5 | −7.41 |
| five times | 13 | −3.7 | 5 | −7.41 |
| after dry-cleaned with stoddard solvent type I | | | | |
| one time | 13.5 | 0 | 6.6 | 22.22 |
| two times | 12.5 | −7.41 | 6.6 | 22.22 |
| five times | 13.25 | −1.85 | 5.2 | −3.7 |
| after dry-cleaned with stoddard solvent type II | | | | |
| one time | 12 | −11.11 | 5.2 | −3.7 |
| two times | 12.5 | −7.41 | 5 | −7.41 |
| five times | 11.5 | −4.81 | 4.2 | −22.22 |
| after dry-cleaned with perchloroethylene | | | | |
| one time | 12.75 | −5.56 | 6.3 | 16.67 |
| two times | 12.75 | −5.56 | 5.1 | −5.56 |
| five times | 11.5 | −14.81 | 4.1 | −24.07 |

TABLE 43 the bursting strength and softness of the undyed fabric of gray silk goods before dry-cleaned and after dry-cleaned with a dry-cleaning solvent

| | bursting strength | | softness | |
|---|---|---|---|---|
| gray silk goods | bursting strength (kg · f/cm$^2$) | percentage of variation | softness (cm) | percentage of variation |
| before dry-cleaned | 12.87 | — | 2.4 | — |
| after dry-cleaned with propylene glycol methyl ether propionate | | | | |
| one time | 11.25 | −12.59 | 2 | −16.67 |
| two times | 10 | −22.3 | 2.1 | −12.5 |
| five times | 10.5 | −18.41 | 2.1 | −12.5 |
| after dry-cleaned with stoddard solvent type I | | | | |
| one time | 11.25 | −12.59 | 2.2 | −8.33 |
| two times | 10 | −22.3 | 2.2 | −8.33 |
| five times | 10 | −22.3 | 2.1 | −12.5 |
| after dry-cleaned with stoddard solvent type II | | | | |
| one time | 10.5 | −18.41 | 2.1 | −12.5 |
| two times | 10.25 | −20.36 | 2.5 | 4.17 |
| five times | 11 | −14.53 | 1.9 | −20.83 |
| after dry-cleaned with perchloroethylene | | | | |
| one time | 11.75 | −8.7 | 2.1 | −12.5 |
| two times | 10.5 | −18.41 | 2 | −16.67 |
| five times | 11 | −14.53 | 1.8 | −25 |

TABLE 44 the bursting strength and softness of the undyed fabric of gray wool goods before dry-cleaned and after dry-cleaned with a dry-cleaning solvent

| | bursting strength | | softness | |
|---|---|---|---|---|
| gray wool goods | bursting strength (kg · f/cm$^2$) | percentage of variation | softness (cm) | percentage of variation |
| before dry-cleaned | 22.42 | — | 3.8 | — |
| after dry-cleaned with propylene glycol methyl ether propionate | | | | |
| one time | 22.5 | 0.36 | 4.2 | 10.53 |
| two times | 21.75 | −3 | 4.1 | 7.89 |
| five times | 23 | 2.59 | 4.1 | 7.89 |
| after dry-cleaned with stoddard solvent type I | | | | |
| one time | 21.75 | −3 | 3.7 | −2.63 |
| two times | 21.5 | −4.1 | 3.7 | −2.63 |
| five times | 23 | 2.59 | 3.9 | 2.63 |
| after dry-cleaned with stoddard solvent type II | | | | |
| one time | 21.75 | −3 | 4 | 5.26 |
| two times | 21.5 | −4.1 | 3.5 | −7.89 |
| five times | 22.5 | 0.36 | 3.5 | −7.89 |
| after dry-cleaned with perchloroethylene | | | | |
| one time | 21.75 | −3 | 3.9 | 2.63 |
| five times | 22.25 | −0.76 | 3.9 | 2.63 |
| two times | 21 | −6.33 | 4 | 5.26 |

TABLE 45

| types of dyed fabric | before dry-cleaned | after dry-cleaned: with propylene glycol methyl ether propionate 1 time, 2, 5, 10, 20 times | after dry-cleaned: with stoddard solvent type I 1 time, 2, 5 times | after dry-cleaned: with stoddard solvent type II 1 time, 2, 5 times | after dry-cleaned: with perchloro-ethylene 1 time, 2, 5 times |
|---|---|---|---|---|---|
| | the color fastness to light of a dyed fabric before dry-cleaned and after dry-cleaned with a dry-cleaning solvent | | | | |
| nylon | fifth grade | fifth grade | fifth grade | fourth grade | 4–5th grade (one time) 4th grade (others) |
| nylon/poly-acrylonitrile | fifth grade | 3–4 grade (20 times) fifth grade (others) | fifth grade | fifth grade | fifth grade |
| polyester/rayon | above sixth grade | above sixth grade | above sixth grade | above sixth grade | above sixth grade |
| polyester | between fourth and fifth grade | third grade | between third and fourth grade | between third and fourth grade | third grade |
| cotton | between fourth and fifth grade | between fourth and fifth grade | fourth grade | fourth grade | fourth grade |
| polyester/cotton | between fourth and fifth grade | fourth grade | 4th grade (one time), 3rd grade (others) | fourth grade | 3rd grade (one time) 2nd–3rd grade (others) |
| wool | between fourth and fifth grade | between fourth and fifth grade | fourth grade | between fourth and fifth grade | between fourth and fifth grade |
| wool/poly-acrylonitrile | between fourth and fifth grade | between fourth and fifth grade | fourth grade | between fourth and fifth grade | fourth grade |
| wool/polyester | between fourth and fifth grade | between fourth and fifth grade | between fourth and fifth grade | 5th grade (5 times) 4–5th grade (others) | between fourth and fifth grade |

TABLE 46

| Grade | name of dye |
|---|---|
| the grade in color fastness to light of a dye | |
| First grade | C.I. Acid Blue 104 |
| Second grade | C.I Acid Blue 109 |
| Third grade | C.I Acid Blue 83 |
| Fourth grade | C.I Acid Blue 121 |
| Fifth grade | C.I Acid Blue 47 |
| Sixth grade | C.I Acid Blue 23 |

TABLE 46-continued

| Grade | name of dye |
|---|---|
| the grade in color fastness to light of a dye | |
| seventh grade | C.I. Solubilized Vat Blue 5 C.I. Solubilized Vat Blue 9 |
| eighth grade | C.I. Solubilized Vat Blue 8 |

Remark: C.I. represents color index

TABLE 47

| wool | K/S value | the grade of color change | the grade of pollution | L | a | b | c |
|---|---|---|---|---|---|---|---|
| the K/S value, the grades of color change and pollution and Lab values of the dyed fabric of wool before dry-cleaned and after dry-cleaned with a dry-cleaning solvent | | | | | | | |
| before dry-cleaned | 22.6 | — | — | 28.83 | 36.6 | 8.46 | 37.57 |
| after dry-cleaned with propylene glycol methyl ether propionate | | | | | | | |
| one time | 24.48 | 4th | 4th–5th | 28.06 | 36.34 | 8.27 | 37.27 |
| two times | 25.83 | 3rd–4th | 4th–5th | 27.25 | 35.86 | 8.51 | 36.86 |
| five times | 26.07 | 3rd–4th | 4th–5th | 27.08 | 35.6 | 8.02 | 36.49 |
| ten times | 23.14 | 4th | 4th–5th | 28.3 | 36.06 | 8.29 | 37 |
| twenty times | 23.25 | 4th | 4th–5th | 28.16 | 35.89 | 8.32 | 36.84 |
| after dry-cleaned with stoddard solvent type I | | | | | | | |
| one time | 22.64 | 4th–5th | 4th–5th | 28.7 | 36.4 | 8.34 | 37.34 |

TABLE 47-continued the K/S value, the grades of color change and pollution and Lab values of the dyed fabric of wool before dry-cleaned and after dry-cleaned with a dry-cleaning solvent

| wool | K/S value | the grade of color change | the grade of pollution | L | a | b | c |
|---|---|---|---|---|---|---|---|
| two times | 23.82 | 4th | 4th–5th | 28.24 | 36.31 | 8.38 | 37.27 |
| five times | 23.29 | 4th | 4th–5th | 28.36 | 36.2 | 8.04 | 37.08 |
| after dry-cleaned with stoddard solvent type II | | | | | | | |
| one time | 22.55 | 4th | 4th–5th | 28.61 | 36.02 | 8.2 | 36.94 |
| two times | 22.84 | 4th | 4th–5th | 28.41 | 35.88 | 8.16 | 36.8 |
| five times | 22.04 | 4th | 4th–5th | 28.72 | 35.89 | 8.15 | 36.8 |
| after dry-cleaned with perchloroethylene | | | | | | | |
| one time | 24.5 | 3rd–4th | 4th–5th | 27.38 | 35.2 | 8.26 | 36.16 |
| two times | 24.68 | 3rd–4th | 4th–5th | 27.47 | 35.44 | 8.23 | 36.39 |
| five times | 24.81 | 3rd–4th | 4th–5th | 27.19 | 34.99 | 7.98 | 35.89 |

TABLE 48 the difference of Lab values of the dyed fabric of wool after dry-cleaned with a dry-cleaning solvent

| wool | ΔL | Δa | Δb | Δc | Δh | ΔE | h |
|---|---|---|---|---|---|---|---|
| after dry-cleaned with propylene glycol methyl ether propionate | | | | | | | |
| one time | −0.77 | −0.26 | −0.19 | −0.3 | −0.13 | 0.83 | 12.82 |
| two times | −1.58 | −0.74 | 0.05 | −0.71 | 0.22 | 1.75 | 13.36 |
| five times | −1.75 | 0 | −0.45 | −1.07 | −0.21 | 2.06 | 12.69 |
| ten times | −0.53 | −0.55 | −0.18 | −0.57 | −0.05 | 0.78 | 12.94 |
| twenty times | −0.67 | −0.71 | −0.15 | −0.73 | 0.02 | 0.99 | 13.05 |
| after dry-cleaned with stoddard solvent type I | | | | | | | |
| one time | −0.13 | −0.2 | −0.12 | −0.23 | −0.07 | 0.27 | 12.91 |
| two times | −0.59 | −0.29 | −0.08 | −0.3 | −0.01 | 0.66 | 13 |
| five times | −0.47 | −0.41 | −0.42 | −0.49 | −0.32 | 0.75 | 12.53 |

TABLE 48-continued the difference of Lab values of the dyed fabric of wool after dry-cleaned with a dry-cleaning solvent

| wool | ΔL | Δa | Δb | Δc | Δh | ΔE | h |
|---|---|---|---|---|---|---|---|
| after dry-cleaned with stoddard solvent type II | | | | | | | |
| one time | −0.22 | −0.59 | −0.26 | −0.63 | −0.13 | 0.68 | 12.83 |
| two times | −0.42 | −0.72 | −0.31 | −0.77 | −0.14 | 0.89 | 12.81 |
| five times | −0.11 | −0.71 | −0.31 | −0.76 | −0.15 | 0.79 | 12.8 |
| after dry-cleaned with perchloroethylene | | | | | | | |
| one time | −1.45 | −1.4 | −0.2 | −1.41 | 0.12 | 2.02 | 3.21 |
| two times | −1.36 | −1.16 | −0.23 | −1.18 | 0.03 | 1.8 | 13.07 |
| five times | −1.64 | −1.61 | −0.49 | −1.68 | −0.12 | 2.35 | 12.84 |

TABLE 49 the K/S value, the grades of color change and pollution and Lab values of the dyed fabric of polyester/rayon before dry-cleaned and after dry-cleaned with a dry-cleaning solvent

| Polyester/ rayon | K/S value | the grade of color change | the grade of pollution | L | a | b | c |
|---|---|---|---|---|---|---|---|
| before dry-cleaned | 18.45 | — | — | 31.82 | 43.64 | 18.11 | 47.25 |
| after dry-cleaned with propylene glycol methyl ether propionate | | | | | | | |
| one time | 18.62 | 3rd grade | 4th–5th grade | 33.58 | 41.08 | 16.04 | 44.1 |
| two times | 19.27 | 4th–5th grade | 4th–5th grade | 31.43 | 43.68 | 17.5 | 47.05 |
| five times | 18.33 | 4th grade | 4th–5th grade | 32.29 | 44.12 | 17.6 | 17.5 |
| ten times | 16.85 | 3rd–4th grade | 4th–5th grade | 32.16 | 42.32 | 17.17 | 45.67 |
| twenty times | 15.85 | 3rd–4th grade | 4th–5th grade | 32.36 | 41.46 | 16.71 | 44.7 |
| after dry-cleaned with stoddard solvent type I | | | | | | | |
| one time | 17.36 | 4th grade | 4th–5th grade | 32.17 | 42.96 | 17.54 | 46.41 |
| two times | 15.79 | 3rd–4th grade | 4th–5th grade | 32.99 | 42.58 | 16.64 | 45.72 |
| five times | 14.42 | 3rd grade | 4th–5th grade | 33.12 | 40.81 | 16.23 | 43.92 |
| after dry-cleaned with stoddard solvent type II | | | | | | | |
| one time | 19.11 | 4th–5th grade | 4th–5th grade | 31.5 | 43.34 | 18.11 | 46.97 |
| two times | 19.05 | 4th–5th grade | 4th–5th grade | 31.57 | 43.38 | 18.13 | 47.02 |
| five times | 19.03 | 4th–5th grade | 4th–5th grade | 31.55 | 43.36 | 18.08 | 46.97 |
| after dry-cleaned with perchloroethylene | | | | | | | |
| one time | 19.64 | 4th–5th grade | 4th–5th grade | 31.29 | 43.39 | 18.11 | 47.02 |
| two times | 19.69 | 4th–5th grade | 4th–5th grade | 31.28 | 43.42 | 18.03 | 47.01 |
| five times | 19.77 | 3rd–4th grade | 4th–5th grade | 31.02 | 42.89 | 17.76 | 42.46 |

TABLE 50 the difference of Lab values of the dyed fabric of polyester/rayon after dry-cleaned with a dry-cleaning solvent

| polyester/rayon | ΔL | Δa | Δb | Δc | Δh | ΔE | h |
|---|---|---|---|---|---|---|---|
| after dry-cleaned with propylene glycol methyl ether propionate | | | | | | | |
| one time | 1.76 | −2.56 | −2.07 | −3.15 | −0.96 | 3.73 | 21.33 |
| two times | −0.39 | 0.04 | −0.62 | −0.2 | −0.58 | 0.73 | 21.83 |
| five times | 0.47 | 0.48 | −0.52 | 0.25 | −0.66 | 0.85 | 21.74 |
| ten times | 0.34 | −1.32 | −0.94 | −1.58 | −0.37 | 1.66 | 22.08 |
| twenty times | 0.54 | −2.18 | −1.4 | −2.55 | −0.47 | 2.65 | 21.95 |
| after dry-cleaned with stoddard solvent type I | | | | | | | |
| one time | 0.35 | −0.68 | −0.57 | −0.84 | −0.27 | 0.95 | 22.21 |
| two times | 1.17 | −1.06 | −1.47 | −1.53 | −0.97 | 2.16 | 21.34 |
| five times | 1.3 | −2.83 | −1.88 | −3.33 | −0.68 | 3.64 | 21.69 |
| after dry-cleaned with stoddard solvent type II | | | | | | | |
| one time | −0.32 | −0.3 | −0 | −0.28 | 0.12 | 0.44 | 22.68 |
| two times | −0.25 | −0.26 | 0.02 | −0.24 | 0.11 | 0.36 | 22.68 |
| five times | −0.27 | −0.28 | −0.04 | −0.28 | 0.08 | 0.39 | 22.63 |
| after dry-cleaned with perchloroethylene | | | | | | | |
| one time | −0.53 | −0.25 | −0.01 | −0.23 | 0.09 | 0.58 | 22.65 |
| two times | −0.54 | −0.22 | −0.08 | −0.24 | 0.01 | 0.58 | 22.55 |
| five times | −0.8 | −0.75 | −0.35 | −0.83 | −0.03 | 1.15 | 22.5 |

TABLE 51 the K/S value, the grades of color change and pollution and Lab values of the dyed fabric of nylon before dry-cleaned and after dry-cleaned with a dry-cleaning solvent

| nylon | K/S value | the grade of color change | the grade of pollution | L | a | b | c |
|---|---|---|---|---|---|---|---|
| before dry-cleaned | 13.22 | — | — | 42.38 | 54.44 | 24.61 | 59.75 |
| after dry-cleaned with propylene glycol methyl ether propionate | | | | | | | |
| one time | 13.36 | 3rd–4th grade | 4th–5th grade | 41.55 | 55.1 | 25.24 | 60.61 |
| two times | 13.24 | 3rd grade | 4th–5th grade | 40.86 | 52.47 | 22.83 | 57.22 |
| five times | 13.21 | 3rd–4th grade | 4th–5th grade | 42.31 | 53.73 | 22.14 | 58.3 |
| ten times | 13.29 | 3rd–4th grade | 4th–5th grade | 41.47 | 53.71 | 25.12 | 59.29 |
| twenty times | 13.03 | 3rd–4th grade | 4th–5th grade | 43.9 | 55.27 | 25.36 | 60.8 |
| after dry-cleaned with stoddard solvent type I | | | | | | | |
| one time | 13.1 | 4th–5th grade | 4th–5th grade | 42.7 | 54.75 | 24.05 | 59.63 |
| two times | 13.15 | 3rd–4th grade | 4th–5th grade | 43.28 | 54.96 | 24.51 | 60.18 |
| five times | 12.86 | 3rd–4th grade | 4th–5th grade | 43.36 | 54.75 | 24.01 | 59.78 |
| after dry-cleaned with stoddard solvent type II | | | | | | | |
| one time | 12.96 | 1st–2nd grade | 3rd–4th grade | 40.37 | 49.1 | 20.26 | 53.11 |
| two times | 13 | 2nd grade | 3rd–4th grade | 40.39 | 49.08 | 20.53 | 53.2 |
| five times | 12.88 | 2nd–3rd grade | 3rd–4th grade | 41.09 | 49.63 | 21.79 | 54.2 |
| after dry-cleaned with perchloroethylene | | | | | | | |
| one time | 13.08 | 1st–2nd grade | 3rd grade | 39.91 | 48.74 | 19.9 | 52.64 |
| two times | 13.01 | 2nd grade | 3rd–4th grade | 40.35 | 49.36 | 20.44 | 53.43 |
| five times | 13.02 | 2nd grade | 33rd–4th grade | 40.65 | 49.61 | 21.08 | 53.9 |

TABLE 52 the difference of Lab values of the dyed fabric of nylon after dry-cleaned with a dry-cleaning solvent

| nylon | ΔL | Δa | Δb | Δc | Δh | ΔE | h |
|---|---|---|---|---|---|---|---|
| after dry-cleaned with propylene glycol methyl ether propionate | | | | | | | |
| one time | −0.83 | 0.66 | −0.64 | 0.86 | 0.31 | 1.24 | 24.61 |
| two times | −1.52 | −1.97 | −1.78 | −2.53 | −0.83 | 3.06 | 23.51 |
| five times | −0.08 | −0.71 | −1.97 | −1.44 | −1.52 | 2.09 | 22.85 |
| ten times | −0.91 | −0.73 | 0.51 | −0.45 | 0.77 | 1.28 | 25.06 |
| twenty times | 1.52 | 0.82 | 0.75 | 1.06 | 0.34 | 1.88 | 24.65 |
| after dry-cleaned with stoddard solvent type I | | | | | | | |
| one time | 0.32 | 0.13 | −0.56 | −0.11 | −0.57 | 0.66 | 23.78 |
| two times | 0.9 | 0.52 | −0.1 | 0.44 | −0.31 | 1.04 | 24.03 |
| five times | 0.98 | 0.31 | −0.6 | 0.04 | −0.68 | 1.19 | 23.68 |
| after dry-cleaned with stoddard solvent type II | | | | | | | |
| one time | −2.02 | −5.34 | −4.53 | −6.63 | −1.87 | 7.18 | 22.42 |
| two times | −1.99 | −5.37 | −4.08 | −6.55 | −1.59 | 7.03 | 22.7 |
| five times | −1.29 | −4.81 | −2.82 | −5.54 | −0.62 | 5.73 | 23.7 |
| after dry-cleaned with perchloroethylene | | | | | | | |
| one time | −2.47 | −5.71 | −4.71 | −7.1 | −2.07 | 7.8 | 22.21 |
| two times | −2.03 | −5.08 | −4.17 | −6.32 | −1.8 | 6.88 | 22.49 |
| five times | −1.74 | −4.84 | −3.53 | −5.85 | −1.29 | 6.23 | 23.03 |

TABLE 53 the K/S value, the grades of color change and pollution and Lab values of the dyed fabric of polyester/cotton before dry-cleaned and after dry-cleaned with a dry-cleaning solvent

| polyester/cotton | K/S value | the grade of color change | the grade of pollution | L | a | b | c |
|---|---|---|---|---|---|---|---|
| before dry-cleaned | 0.23 | — | — | 82.9 | −7.22 | 0.79 | 7.26 |
| after dry-cleaned with propylene glycol methyl ether propionate | | | | | | | |
| one time | 0.2 | 3rd grade | 4th–5th grade | 85.35 | −9.35 | 1.25 | 9.44 |
| two times | 0.25 | 3rd grade | 4th–5th grade | 80.35 | −6.13 | −0.32 | 6.14 |
| five times | 0.24 | 3rd–4th grade | 4th–5th grade | 81.43 | −6.7 | −0.29 | 6.71 |
| ten times | 0.22 | 4th–5th grade | 4th–5th grade | 82.96 | −7 | 0.52 | 7.02 |
| twenty times | 0.22 | 4th grade | 4th–5th grade | 82.47 | −6.57 | 0.69 | 6.61 |
| after dry-cleaned with stoddard solvent type I | | | | | | | |
| one time | 0.22 | 4th–5th grade | 4th–5th grade | 82.96 | −7.02 | 0.45 | 7.04 |
| two times | 0.23 | 4th grade | 4th–5th grade | 82.25 | −6.66 | 0.32 | 6.67 |
| five times | 0.22 | 4th–5th grade | 4th–5th grade | 82.84 | −6.82 | 0.61 | 6.85 |
| after dry-cleaned with stoddard solvent type II | | | | | | | |
| one time | 0.36 | 1st–2nd grade | 3rd–4th grade | 75.73 | −4.21 | −0.32 | 4.22 |
| two times | 0.36 | 1st–2nd grade | 3rd–4th grade | 75.72 | −4.19 | −0.38 | 4.2 |
| five times | 0.34 | 2nd grade | 3rd–4th grade | 76.37 | −4.25 | −0.34 | 4.26 |
| after dry-cleaned with perchloroethylene | | | | | | | |
| one time | 0.37 | 1st–2nd grade | 3rd grade | 75 | −3.9 | −0.02 | 3.9 |
| two times | 0.38 | 1st–2nd grade | 3rd grade | 74.63 | −3.96 | 0.14 | 3.96 |
| five times | 0.37 | 1st–2nd grade | 3rd grade | 74.82 | −3.8 | 0.11 | 3.81 |

TABLE 54 the difference of Lab values of the dyed fabric of polyester/cotton after dry-cleaned with a dry-cleaning solvent

| polyester/cotton | ΔL | Δa | Δb | Δc | Δh | ΔE | h |
|---|---|---|---|---|---|---|---|
| after dry-cleaned with propylene glycol methyl ether propionate | | | | | | | |
| one time | 2.54 | −2.13 | 0.46 | 2.17 | −0.2 | 3.28 | 172.38 |
| two times | −2.55 | 1.09 | −1.11 | −1.13 | 1.08 | 2.99 | 183.01 |
| five times | −1.47 | 0.52 | −1.08 | −0.56 | 1.06 | 1.9 | 182.47 |
| ten times | 0.06 | 0.22 | −0.28 | −0.25 | 0.25 | 0.36 | 175.79 |
| twenty times | −0.43 | 0.65 | −0.1 | −0.66 | 0.03 | 0.78 | 174 |
| after dry-cleaned with stoddard solvent type I | | | | | | | |
| one time | 0.06 | 0.2 | −0.34 | −0.23 | 0.32 | 0.4 | 176.34 |
| two times | −0.65 | 0.56 | −0.48 | −0.6 | 0.43 | 0.99 | 177.28 |
| five times | −0.06 | 0.4 | −0.18 | −0.41 | 0.14 | 0.44 | 174.88 |

TABLE 54-continued the difference of Lab values of the dyed fabric of polyester/cotton after dry-cleaned with a dry-cleaning solvent

| polyester/cotton | ΔL | Δa | Δb | Δc | Δh | ΔE | h |
|---|---|---|---|---|---|---|---|
| after dry-cleaned with stoddard solvent type II | | | | | | | |
| one time | −7.17 | 3.01 | −1.11 | −3.04 | 1.02 | 7.86 | 184.37 |
| two times | −7.18 | 3.04 | −1.18 | −3.06 | 1.11 | 7.89 | 185.24 |
| five times | −6.53 | 2.97 | −1.13 | −3 | 1.05 | 7.27 | 184.57 |
| after dry-cleaned with perchloroethylene | | | | | | | |
| one time | −7.9 | 3.32 | −0.81 | −3.37 | 0.6 | 8.61 | 180.23 |
| two times | −8.27 | 3.27 | −0.65 | −3.31 | 0.39 | 8.91 | 177.93 |
| five times | −8.08 | 3.42 | −0.68 | −3.46 | 0.42 | 8.8 | 178.32 |

TABLE 55 the K/S value, the grades of color change and pollution and Lab values of the dyed fabric of cotton before dry-cleaned and after dry-cleaned with a dry-cleaning solvent

| cotton | K/S value | the grade of color change | the grade of pollution | L | a | b | c |
|---|---|---|---|---|---|---|---|
| before dry-cleaned | 21.73 | — | — | 32.96 | 40.02 | 16.74 | 43.38 |
| after dry-cleaned with propylene glycol methyl ether propionate | | | | | | | |
| one time | 21.24 | 4th–5th grade | 4th–5th grade | 32.81 | 39.75 | 16.87 | 43.18 |
| two times | 22.55 | 4th grade | 4th–5th grade | 32.38 | 39.62 | 17 | 43.12 |
| five times | 22.01 | 4th–5th grade | 4th–5th grade | 32.61 | 39.72 | 16.79 | 43.12 |
| ten times | 21.29 | 4th–5th grade | 4th–5th grade | 33.02 | 39.42 | 16.64 | 42.79 |
| twenty times | 21.24 | 4th–5th grade | 4th–5th grade | 33.22 | 39.87 | 16.27 | 43.06 |

TABLE 55-continued the K/S value, the grades of color change and pollution and Lab values of the dyed fabric of cotton before dry-cleaned and after dry-cleaned with a dry-cleaning solvent

| cotton | K/S value | the grade of color change | the grade of pollution | L | a | b | c |
|---|---|---|---|---|---|---|---|
| after dry-cleaned with stoddard solvent type I | | | | | | | |
| one time | 21.77 | 4th–5th grade | 4th–5th grade | 32.88 | 39.68 | 16.75 | 43.07 |
| two times | 21.82 | 4th–5th grade | 4th–5th grade | 32.71 | 39.61 | 16.34 | 42.84 |
| five times | 21.63 | 4th–5th grade | 4th–5th grade | 32.93 | 39.82 | 16.51 | 43.11 |
| after dry-cleaned with stoddard solvent type II | | | | | | | |
| one time | 20.89 | 4th grade | 4th–5th grade | 32.89 | 39.37 | 16.24 | 42.59 |
| two times | 20.74 | 4th grade | 4th–5th grade | 32.96 | 39.48 | 16.4 | 42.75 |
| five times | 21.12 | 4th grade | 4th–5th grade | 32.81 | 39.36 | 16.32 | 42.61 |
| after dry-cleaned with perchloroethylene | | | | | | | |
| one time | 21.01 | 4th grade | 4th–5th grade | 32.69 | 39.3 | 16.8 | 42.74 |
| two times | 21.57 | 3rd–4th grade | 4th–5th grade | 32.33 | 38.95 | 16.63 | 42.35 |
| five times | 21.84 | 3rd–4th grade | 4th–5th grade | 32.06 | 38.54 | 16.56 | 41.95 |

TABLE 56 the differences of the Lab values of the dyed fabric of cotton after dry-cleaned with a dry-cleaning solvent

| cotton | ΔL | Δa | Δb | Δc | Δh | ΔE | h |
|---|---|---|---|---|---|---|---|
| after dry-cleaned with propylene glycol methyl ether propionate | | | | | | | |
| one time | −0.14 | −0.27 | 0.13 | −0.2 | 0.22 | 0.33 | 23 |
| two times | −0.58 | −0.39 | 0.26 | −0.26 | 0.39 | 0.74 | 23.22 |
| five times | −0.34 | −0.3 | 0.05 | −0.25 | 0.16 | 0.46 | 22.91 |
| ten times | 0.06 | −0.6 | −0.11 | −0.59 | 0.13 | 0.61 | 22.88 |
| twenty times | 0.27 | −0.15 | −0.48 | −0.32 | −0.38 | 0.56 | 22.19 |
| after dry-cleaned with stoddard solvent type I | | | | | | | |
| one time | −0.07 | −0.33 | 0.01 | −0.3 | 0.14 | 0.34 | 22.88 |
| two times | −0.25 | −0.41 | −0.4 | −0.53 | −0.21 | 0.63 | 22.42 |
| five times | −0.02 | −0.19 | −0.23 | −0.27 | −0.14 | 0.3 | 22.52 |

TABLE 56-continued the differences of the Lab values of the dyed fabric of cotton after dry-cleaned with a dry-cleaning solvent

| cotton | ΔL | Δa | Δb | Δc | Δh | ΔE | h |
|---|---|---|---|---|---|---|---|
| after dry-cleaned with stoddard solvent type II | | | | | | | |
| one time | −0.07 | −0.64 | −0.51 | −0.79 | −0.22 | 0.82 | 22.41 |
| two times | 0 | −0.54 | −0.34 | −0.62 | −0.11 | 0.63 | 22.56 |
| five times | −0.15 | −0.66 | −0.42 | 0.77 | −0.13 | 0.8 | 22.52 |
| after dry-cleaned with perchloroethylene | | | | | | | |
| one time | −0.27 | −0.72 | 0.06 | −0.64 | 0.33 | 0.77 | 23.14 |
| two times | −0.63 | −1.07 | −0.11 | −1.03 | 0.31 | 1.25 | 23.12 |
| five times | −0.9 | −1.47 | −0.18 | −1.43 | 0.41 | 1.73 | 23.25 |

TABLE 57 the K/S value, the grades of color change and pollution and the Lab values of the dyed fabric of wool/polyacrylonitrile before dry-cleaned and after dry-cleaned with a dry-cleaning solvent

| wool/polyacrylonitrile | K/S value | the grade of color change | the grade of ′ pollution | L | a | b | c |
|---|---|---|---|---|---|---|---|
| before dry-cleaned | 15.17 | — | — | 38.69 | −11.67 | 31.85 | 33.92 |
| after dry-cleaned with propylene glycol methyl ether propionate | | | | | | | |
| one time | 14.42 | fourth grade | fourth to fifth grade | 39 | −11.48 | −32.51 | 34.47 |
| two times | 15.46 | fourth grade | fourth to fifth grade | 38.12 | −11.25 | −31.76 | 33.7 |
| five times | 14.52 | third to fourth grade | fourth to fifth grade | 39.33 | −11.43 | −32.84 | 34.77 |
| ten times | 14.2 | fourth grade | fourth to fifth grade | 39.4 | −11.47 | −32.48 | 34.44 |
| twenty times | 13.93 | fourth grade | fourth to fifth grade | 39.13 | −11.28 | −32.42 | 34.33 |
| after dry-cleaned with stoddard solvent type I | | | | | | | |
| one time | 14.18 | third to fourth grade | fourth to fifth grade | 39.79 | −11.91 | −32.35 | 34.47 |
| two times | 13.85 | fourth grade | fourth to fifth grade | 39.46 | −11.33 | −32.5 | 34.41 |
| five times | 14.53 | fourth grade | fourth to fifth grade | 39.33 | −11.65 | −32.36 | 34.39 |

TABLE 57-continued the K/S value, the grades of color change and pollution and the Lab values of the dyed fabric of wool/polyacrylonitrile before dry-cleaned and after dry-cleaned with a dry-cleaning solvent

| wool/polyacrylonitrile | K/S value | the grade of color change | the grade of pollution | L | a | b | c |
|---|---|---|---|---|---|---|---|
| after dry-cleaned with stoddard solvent type II | | | | | | | |
| one time | 14.18 | fourth grade | fourth to fifth grade | 39.41 | −11.9 | −31.68 | 33.85 |
| two times | 13.92 | third to fourth grade | fourth to fifth grade | 39.62 | −12.05 | −31.42 | 33.65 |
| five times | 13.62 | third to fourth grade | fourth to fifth grade | 39.71 | −11.74 | −31.86 | 33.96 |
| after dry-cleaned with perchloroethylene | | | | | | | |
| one time | 14.8 | fourth grade | fourth to fifth grade | 38.84 | −11.95 | −31.12 | 33.34 |
| two times | 15.05 | fourth to fifth grade | fourth to fifth grade | 38.77 | −11.93 | −31.43 | 33.62 |
| five times | 15.02 | fourth grade | fourth to fifth grade | 38.4 | −11.76 | −30.89 | 33.05 |

TABLE 58 the differences of the Lab values of the dyed fabric of wool/polyacrylonitrile after dry-cleaned with a dry-cleaning solvent

| wool/polyacrylonitrile | ΔL | Δa | Δb | Δc | Δh | ΔE | h |
|---|---|---|---|---|---|---|---|
| after dry-cleaned with propylene glycol methyl ether propionate | | | | | | | |
| one time | 0.31 | 0.19 | −0.66 | 0.55 | 0.4 | 0.75 | 250.54 |
| two times | −0.57 | 0.42 | 0.09 | −0.22 | 0.36 | 0.71 | 250.49 |
| five times | 0.63 | 0.25 | −0.99 | 0.85 | 0.56 | 1.2 | 250.82 |
| ten times | 0.71 | 0.2 | −0.63 | 0.52 | 0.4 | 0.97 | 250.54 |
| twenty times | 0.44 | 0.4 | −0.57 | 0.41 | 0.56 | 0.82 | 250.82 |
| after dry-cleaned with stoddard solvent type I | | | | | | | |
| one time | 1.09 | −0.24 | −0.5 | 0.55 | −0.05 | 1.23 | 249.79 |
| two times | 0.77 | 0.34 | −0.65 | 0.5 | 0.54 | 1.06 | 250.78 |
| five times | 0.64 | 0.02 | −0.51 | 0.47 | 0.19 | 0.82 | 250.19 |

TABLE 58-continued the differences of the Lab values of the dyed fabric of wool/polyacrylonitrile after dry-cleaned with a dry-cleaning solvent

| wool/polyacrylonitrile | ΔL | Δa | Δb | Δc | Δh | ΔE | h |
|---|---|---|---|---|---|---|---|
| after dry-cleaned with stoddard solvent type II | | | | | | | |
| one time | 0.71 | −0.23 | 0.17 | −0.07 | −0.28 | 0.77 | 249.41 |
| two times | 0.93 | −0.38 | 0.43 | −0.27 | −0.51 | 1.09 | 249.01 |
| five times | 1.02 | −0.07 | −0.01 | 0.04 | −0.06 | 1.02 | 249.77 |
| after dry-cleaned with perchloroethylene | | | | | | | |
| one time | 0.15 | −0.28 | 0.73 | −0.58 | −0.52 | 0.8 | 248.99 |
| two times | 0.08 | −0.25 | 0.42 | −0.3 | −0.38 | 0.49 | 249.22 |
| five times | −0.29 | −0.09 | 0.96 | −0.87 | −0.42 | 1 | 249.16 |

TABLE 59 the K/S value, the grades of color change and pollution and the Lab values of the dyed fabric of wool/polyester before dry-cleaned and after dry-cleaned with a dry-cleaning solvent

| wool/polyester | K/S value | the grade of color change | the grade of pollution | L | a | b | c |
|---|---|---|---|---|---|---|---|
| before dry-cleaned | 16.6 | — | — | 23.33 | 11.71 | −12.97 | 17.48 |
| after dry-cleaned with propylene glycol methyl ether propionate | | | | | | | |
| one time | 16.61 | fourth to fifth grade | fourth to fifth grade | 23.29 | 11.46 | −12.92 | 17.27 |
| two times | 17.07 | fourth to fifth grade | fourth to fifth grade | 22.92 | 11.31 | −12.85 | 17.11 |
| five times | 16.73 | fourth to fifth grade | fourth to fifth grade | 23.15 | 11.14 | −12.92 | 17.06 |
| ten times | 16.08 | fourth to fifth grade | fourth to fifth grade | 23.64 | 11.57 | −12.83 | 17.27 |
| twenty times | 15.94 | fourth to fifth grade | fourth to fifth grade | 23.7 | 11.47 | −12.75 | 17.15 |
| after dry-cleaned with stoddard solvent type I | | | | | | | |
| one time | 16.37 | fourth to fifth grade | fourth to fifth grade | 23.37 | 11.32 | −12.84 | 17.12 |
| two times | 16.07 | fourth to fifth grade | fourth to fifth grade | 23.67 | 11.41 | −12.97 | 17.28 |
| five times | 16.32 | fourth to fifth grade | fourth to fifth grade | 23.52 | 11.58 | −13 | 17.41 |

TABLE 59-continued the K/S value, the grades of color change and pollution and the Lab values of the dyed fabric of wool/polyester before dry-cleaned and after dry-cleaned with a dry-cleaning solvent

| wool/polyester | K/S value | the grade of color change | the grade of pollution | L | a | b | c |
|---|---|---|---|---|---|---|---|
| after dry-cleaned with stoddard solvent type II | | | | | | | |
| one time | 15.83 | fourth grade | fourth to fifth grade | 23.82 | 11.34 | −12.82 | 17.11 |
| two times | 16.1 | fourth grade | fourth to fifth grade | 23.49 | 10.72 | −12.79 | 16.69 |
| five times | 15.75 | fourth grade | fourth to fifth grade | 23.75 | 10.81 | −12.75 | 16.69 |
| after dry-cleaned with perchloroethylene | | | | | | | |
| one time | 16.4 | third to fourth grade | fourth to fifth grade | 23.19 | 10.58 | −12.61 | 16.46 |
| two times | 16.2 | fourth grade | first to fifth grade | 23.45 | 11.18 | −12.56 | 16.82 |
| five times | 16.06 | fourth grade | fourth to fifth grade | 23.59 | 11.28 | −12.54 | 16.87 |

TABLE 60 the differences of the Lab values of the dyed fabric of wool/polyester after dry-cleaned with a dry-cleaning solvent

| wool/polyester | ΔL | Δa | Δb | Δc | Δh | ΔE | h |
|---|---|---|---|---|---|---|---|
| after dry-cleaned with propylene glycol methyl ether propionate | | | | | | | |
| one time | −0.04 | −0.25 | 0.05 | −0.2 | −0.16 | 0.26 | 311.56 |
| two times | −0.42 | −0.4 | 0.13 | −0.36 | −0.22 | 0.59 | 311.36 |
| five times | −0.18 | −0.57 | 0.05 | −0.41 | −0.4 | 0.6 | 310.76 |
| ten times | 0.3 | −0.14 | 0.14 | −0.2 | −0.01 | 0.37 | 312.05 |
| twenty times | 0.36 | −0.24 | 0.22 | −0.33 | −0.03 | 0.49 | 311.97 |
| after dry-cleaned with stoddard solvent type I | | | | | | | |
| one time | 0.04 | −0.39 | 0.14 | −0.36 | −0.2 | 0.41 | 311.42 |
| two times | 0.34 | −0.3 | 0 | −0.2 | −0.22 | 0.45 | 311.35 |
| five times | 0.19 | −0.13 | −0.02 | −0.07 | −0.11 | 0.23 | 311.7 |
| after dry-cleaned with stoddard solvent type II | | | | | | | |
| one time | 0.49 | −0.37 | 0.15 | −0.36 | −0.18 | 0.63 | 311.49 |
| two times | 0.16 | −1 | 0.18 | −0.79 | −0.63 | 1.02 | 309.96 |
| five times | 0.42 | −0.91 | 0.25 | −0.78 | −0.52 | 1.03 | 310.34 |
| after dry-cleaned with perchloroethylene | | | | | | | |
| one time | −0.14 | −1.14 | 0.36 | −1.02 | −0.62 | 1.2 | 309.99 |
| two times | 0.12 | −0.53 | 0.41 | −0.66 | −0.12 | 0.68 | 311.68 |
| five times | 0.26 | −0.44 | 0.43 | −0.61 | −0.04 | 0.67 | 311.95 |

TABLE 61 the K/S value, the grades of color change and pollution and the Lab values of the dyed fabric of polyester before dry-cleaned and after dry-cleaned with a dry-cleaning solvent

| polyester | K/S value | the grade of color change | the grade of pollution | L | a | b | c |
|---|---|---|---|---|---|---|---|
| before dry-cleaned | 17.86 | — | — | 31.18 | 8.68 | −43.6 | 44.46 |
| after dry-cleaned with propylene glycol methyl ether propionate | | | | | | | |
| one time | 8.97 | first grade | first grade | 32.86 | 23.48 | −4.37 | 23.88 |
| two times | 9.09 | first grade | first grade | 32.7 | 23.53 | −4.39 | 23.94 |
| five times | 8.74 | first grade | first grade | 33.19 | 23.41 | −4.38 | 23.81 |
| ten times | 8.92 | first grade | first grade | 33 | 23.63 | −4.1 | 23.98 |
| twenty times | 8.74 | first grade | first grade | 33.2 | 23.46 | −4.17 | 23.83 |

TABLE 61-continued the K/S value, the grades of color change and pollution and the Lab values of the dyed fabric of polyester before dry-cleaned and after dry-cleaned with a dry-cleaning solvent

| polyester | K/S value | the grade of color change | the grade of pollution | L | a | b | c |
|---|---|---|---|---|---|---|---|
| after dry-cleaned with stoddard solvent type I | | | | | | | |
| one time | 8.88 | first grade | first grade | 33.05 | 23.62 | −4.2 | 23.99 |
| two times | 8.62 | first grade | first grade | 33.41 | 23.52 | −4.38 | 23.93 |
| five times | 8.96 | first grade | first grade | 32.88 | 23.41 | −4.15 | 23.77 |
| after dry-cleaned with stoddard solvent type II | | | | | | | |
| one time | 8.78 | first grade | first grade | 33.04 | 23.06 | −4.25 | 23.45 |
| two times | 8.8 | first grade | first grade | 33.03 | 23.06 | −4.22 | 23.44 |
| five times | 8.56 | first grade | first grade | 33.47 | 23.3 | −4.14 | 23.67 |
| after dry-cleaned with perchloroethylene | | | | | | | |
| one time | 9.17 | first grade | first grade | 32.45 | 22.92 | −4.26 | 23.31 |
| two times | 9.09 | first grade | first grade | 32.54 | 22.85 | −4.05 | 23.21 |
| five times | 9.16 | first grade | first grade | 32.45 | 22.84 | −4.12 | 23.21 |

TABLE 62 the differences of the Lab values of the dyed fabric of polyester after dry-cleaned with a dry-cleaning solvent

| polyester | ΔL | Δa | Δb | Δc | Δh | ΔE | h |
|---|---|---|---|---|---|---|---|
| after dry-cleaned with propylene glycol methyl ether propionate | | | | | | | |
| one time | 1.68 | 14.79 | 39.24 | −20.58 | 36.54 | 41.97 | 349.46 |
| two times | 1.53 | 14.85 | 39.21 | −20.52 | 36.56 | 41.96 | 349.43 |
| five times | 2.01 | 14.72 | 39.22 | −20.65 | 36.46 | 41.94 | 349.4 |
| ten times | 1.82 | 14.94 | 39.5 | −20.48 | 36.94 | 42.27 | 350.15 |
| twenty times | 2.03 | 14.78 | 39.44 | −20.63 | 36.72 | 42.16 | 349.93 |
| after dry-cleaned with stoddard solvent type I | | | | | | | |
| one time | 1.87 | 14.94 | 39.4 | −20.47 | 36.84 | 42.18 | 349.92 |
| two times | 2.23 | 14.84 | 39.22 | −20.53 | 36.56 | 41.99 | 349.44 |
| five times | 1.7 | 14.72 | 39.46 | −20.69 | 36.68 | 42.15 | 349.95 |
| after dry-cleaned with stoddard solvent type II | | | | | | | |
| one time | 1.86 | 14.37 | 39.35 | −21.01 | 36.24 | 41.94 | 349.55 |
| two times | 1.85 | 14.38 | 39.39 | −21.02 | 36.28 | 41.97 | 349.64 |
| five times | 2.29 | 14.62 | 39.46 | −20.79 | 36.59 | 42.15 | 349.93 |

TABLE 62-continued the differences of the Lab values of the dyed fabric of polyester after dry-cleaned with a dry-cleaning solvent

| polyester | ΔL | Δa | Δb | Δc | Δh | ΔE | h |
|---|---|---|---|---|---|---|---|
| after dry-cleaned with perchloroethylene | | | | | | | |
| one time | 1.27 | 14.23 | 39.34 | −21.15 | 36.1 | 41.86 | 349.46 |
| two times | 1.37 | 14.17 | 39.56 | −21.25 | 36.25 | 42.04 | 349.96 |
| five times | 1.27 | 14.16 | 39.48 | −21.25 | 36.16 | 41.96 | 349.77 |

TABLE 63 the K/S value, the grades of color change and pollution and the Lab values of the dyed fabric of nylon/polyacrylonitrile before dry-cleaned and after dry-cleaned with a dry-cleaning solvent

| nylon/polyacrylonitrile | K/S value | the grade of color change | the grade of pollution | L | a | b | c |
|---|---|---|---|---|---|---|---|
| before dry-cleaned | 25.2 | — | — | 16.93 | −0.63 | −5.08 | 5.11 |
| after dry-cleaned with propylene glycol methyl ether propionate | | | | | | | |
| one time | 24.57 | fourth to fifth grade | fourth to fifth grade | 17.28 | −0.65 | −5.26 | 5.3 |
| two times | 26.3 | fourth to fifth grade | fourth to fifth grade | 16.41 | −0.49 | −4.81 | 4.83 |
| five times | 25.18 | fifth grade | fifth grade | 16.91 | −0.64 | −4.91 | 4.96 |
| ten times | 26.75 | fourth grade | fourth to fifth grade | 16.08 | −0.11 | −4.89 | 4.89 |
| twenty times | 25.96 | fourth to fifth grade | fourth to fifth grade | 16.5 | −0.19 | −5.18 | 5.18 |
| after dry-cleaned with stoddard solvent type I | | | | | | | |
| one time | 27.73 | third to fourth grade | fourth to fifth grade | 15.86 | −0.33 | −4.81 | 4.83 |
| two times | 28.39 | third to fourth grade | fourth to fifth grade | 15.76 | −0.17 | −5.27 | 5.82 |
| five times | 27.22 | fourth grade | fourth to fifth grade | 16.11 | −0.38 | −4.97 | 4.99 |
| after dry-cleaned with stoddard solvent type II | | | | | | | |
| one time | 27.69 | fourth grade | fourth to fifth grade | 16.01 | −0.56 | −5.29 | 5.32 |
| two times | 27.85 | third to fourth grade | fourth to fifth grade | 15.99 | −0.53 | −5.44 | 5.47 |
| five times | 27.05 | fourth to fifth grade | fourth to fifth grade | 16.37 | −0.73 | −5.17 | 5.22 |
| after dry-cleaned with perchloroethylene | | | | | | | |
| one time | 29.41 | third to fourth grade | fourth to fifth grade | 15.42 | −0.57 | −4.98 | 5.01 |
| two times | 30.35 | third to fourth grade | fourth to fifth grade | 15.09 | −0.6 | −4.96 | 4.99 |
| five times | 30.35 | third to fourth grade | fourth to fifth grade | 14.96 | −0.39 | −4.81 | 4.83 |

TABLE 64 the differences of the Lab values of the dyed fabric of nylon/polyacrylonitrile after dry-cleaned with a dry-cleaning solvent

| nylon/ polyacrylonitrile | ΔL | Δa | Δb | Δc | Δh | ΔE | h |
|---|---|---|---|---|---|---|---|
| after dry-cleaned with propylene glycol methyl ether propionate | | | | | | | |
| one time | 0.34 | −0.02 | −0.19 | 0.19 | 0 | 0.39 | 262.95 |
| two times | −0.52 | 0.15 | 0.27 | −0.28 | 0.11 | 0.61 | 264.24 |
| five times | −0.02 | −0.01 | 0.16 | −0.16 | −0.03 | 0.16 | 262.56 |
| ten times | −0.85 | 0.52 | 0.19 | −0.23 | 0.5 | 1.01 | 268.67 |
| twenty times | −0.44 | 0.54 | −0.1 | 0.07 | 0.55 | 0.7 | 269 |

TABLE 64-continued the differences of the Lab values of the dyed fabric of nylon/polyacrylonitrile after dry-cleaned with a dry-cleaning solvent

| nylon/ polyacrylonitrile | ΔL | Δa | Δb | Δc | Δh | ΔE | h |
|---|---|---|---|---|---|---|---|
| after dry-cleaned with stoddard solvent type I | | | | | | | |
| one time | −1.07 | 0.3 | 0.26 | −0.29 | 0.27 | 1.14 | 266.04 |
| two times | −1.18 | 0.46 | −0.2 | 0.16 | 0.47 | 0.28 | 268.15 |
| five times | −0.83 | 0.25 | 0.1 | −0.13 | 0.24 | 0.87 | 265.66 |

TABLE 64-continued the differences of the Lab values of the dyed fabric of nylon/polyacrylonitrile after dry-cleaned with a dry-cleaning solvent

| nylon/ polyacrylonitrile | ΔL | Δa | Δb | Δc | Δh | ΔE | h |
|---|---|---|---|---|---|---|---|
| after dry-cleaned with stoddard solvent type II | | | | | | | |
| one time | −0.92 | 0.08 | −0.22 | 0.21 | 0.1 | 0.95 | 264.01 |
| two times | −0.94 | 0.1 | −0.36 | 0.35 | 0.14 | 1.02 | 264.42 |
| five times | −0.56 | −0.1 | −0.09 | 0.1 | −0.09 | 0.58 | 261.92 |

TABLE 64-continued

| the differences of the Lab values of the dyed fabric of nylon/polyacrylonitrile after dry-cleaned with a dry-cleaning solvent | | | | | | | |
|---|---|---|---|---|---|---|---|
| nylon/ polyacrylonitrile | ΔL | Δa | Δb | Δc | Δh | ΔE | h |
| after dry-cleaned with perchloroethylene | | | | | | | |
| one time | −1.51 | 0.07 | 0.1 | −0.1 | 0.05 | 1.51 | 263.52 |
| two times | −1.85 | 0.04 | 0.12 | −0.12 | 0.02 | 1.85 | 263.15 |
| five times | −1.97 | 0.24 | 0.27 | −0.29 | 0.21 | 2 | 265.36 |

TABLE 65

| the grade of the color fastness to abrasion of the dyed fabric of wool/polyester before dry-cleaned and after dry-cleaned with a dry-cleaning solvent | | |
|---|---|---|
| | the grade of the color fastness to abrasion | |
| wool/polyester | before the test | after the test |
| before dry-cleaned | fourth grade | fourth to fifth grade |
| after dry-cleaned with propylene glycol methyl ether propionate | | |
| one time | fourth grade | fourth to fifth grade |
| two times | fourth grade | fourth to fifth grade |
| five times | fourth grade | fourth to fifth grade |
| ten times | fourth grade | fourth to fifth grade |
| twenty times | fourth to fifth grade | fourth to fifth grade |
| after dry-cleaned with stoddard solvent type I | | |
| one time | fourth grade | fourth to fifth grade |
| two times | fourth grade | fourth to fifth grade |
| five times | fourth to fifth grade | fourth to fifth grade |
| after dry-cleaned with stoddard solvent type II | | |
| one time | fourth to fifth grade | fourth to fifth grade |
| two times | fourth to fifth grade | fourth to fifth grade |
| five times | fourth to fifth grade | fourth to fifth grade |
| after dry-cleaned with perchloroethylene | | |
| one time | fourth grade | fourth to fifth grade |
| two times | fourth to fifth grade | fourth to fifth grade |
| five times | fourth to fifth grade | fourth to fifth grade |

TABLE 66

| the grade of the color fastness to abrasion of the dyed fabric of wool before dry-cleaned and after dry-cleaned with a dry-cleaning solvent | | |
|---|---|---|
| | the grade of the color fastness to abrasion | |
| wool | before the test | after the test |
| before dry-cleaned | fourth to fifth grade | fourth to fifth grade |
| after dry-cleaned with propylene glycol methyl ether propionate | | |
| one time | fourth grade | fourth to fifth grade |
| two times | fourth to fifth grade | fourth to fifth grade |
| five times | fourth to fifth grade | fourth to fifth grade |
| ten times | fourth to fifth grade | fourth to fifth grade |
| twenty times | fourth to fifth grade | fourth to fifth grade |
| after dry-cleaned with stoddard solvent type I | | |
| one time | fourth to fifth grade | fourth to fifth grade |
| two times | fourth to fifth grade | fourth to fifth grade |
| five times | fourth to fifth grade | fourth to fifth grade |
| after dry-cleaned with stoddard solvent type II | | |
| one time | fourth grade | fourth grade |
| two times | fourth grade | third to fourth grade |
| five times | fourth grade | fourth to fifth grade |

TABLE 66-continued

| the grade of the color fastness to abrasion of the dyed fabric of wool before dry-cleaned and after dry-cleaned with a dry-cleaning solvent | | |
|---|---|---|
| | the grade of the color fastness to abrasion | |
| wool | before the test | after the test |
| after dry-cleaned with perchloroethylene | | |
| one time | fourth to fifth grade | fourth to fifth grade |
| two times | fourth to fifth grade | fourth to fifth grade |
| five times | fourth to fifth grade | fourth to fifth grade |

TABLE 67

| the grade of the color fastness to abrasion of the dyed fabric of wool/polyacrylonitrile before dry-cleaned and after dry-cleaned with a dry-cleaning solvent | | |
|---|---|---|
| | the grade of the color fastness to abrasion | |
| wool/polyacrylonitrile | before the test | after the test |
| before dry cleaned | fourth to fifth grade | fourth to fifth grade |
| after dry-cleaned with propylene glycol methyl ether propionate | | |
| one time | fourth grade | fourth to fifth grade |
| two times | fourth to fifth grade | fourth to fifth grade |
| five times | fourth to fifth grade | fourth to fifth grade |
| ten times | fourth to fifth grade | fourth to fifth grade |
| twenty times | fourth to fifth grade | fourth to fifth grade |
| after dry-cleaned with stoddard solvent type I | | |
| one time | fourth to fifth grade | fourth to fifth grade |
| two times | fourth to fifth grade | fourth to fifth grade |
| five times | fourth to fifth grade | fourth to fifth grade |
| after dry-cleaned with stoddard solvent type II | | |
| one time | fourth to fifth grade | fourth to fifth grade |
| two times | fourth to fifth grade | fourth to fifth grade |
| five times | fourth to fifth grade | fourth to fifth grade |
| after dry-cleaned with perchloroethylene | | |
| one time | fourth to fifth grade | fourth to fifth grade |
| two times | fourth to fifth grade | fourth to fifth grade |
| five times | fourth to fifth grade | fourth to fifth grade |

TABLE 68

| the grade of the color fastness to abrasion of the dyed fabric of polyester before dry-cleaned and after dry-cleaned with a dry-cleaning solvent | | |
|---|---|---|
| | the grade of the color fastness to abrasion | |
| polyester | before the test | after the test |
| before dry-cleaned | fourth to fifth grade | fourth to fifth grade |
| after dry-cleaned with propylene glycol methyl ether propionate | | |
| one time | fourth to fifth grade | fourth to fifth grade |
| two times | fourth to fifth grade | fourth to fifth grade |
| five times | fourth to fifth grade | fourth to fifth grade |
| ten times | fourth to fifth grade | fourth to fifth grade |
| twenty times | fourth to fifth grade | fourth to fifth grade |
| after dry-cleaned with stoddard solvent type I | | |
| one time | fourth to fifth grade | fourth to fifth grade |
| two times | fourth to fifth grade | fourth to fifth grade |
| five times | fourth to fifth grade | fourth to fifth grade |
| after dry-cleaned with stoddard solvent type II | | |
| one time | fourth to fifth grade | fourth to fifth grade |
| two times | fourth to fifth grade | fourth to fifth grade |
| five times | fourth to fifth grade | fourth to fifth grade |

TABLE 68-continued the grade of the color fastness to abrasion of the dyed fabric of polyester before dry-cleaned and after dry-cleaned with a dry-cleaning solvent

| polyester | the grade of the color fastness to abrasion before the test | after the test |
|---|---|---|
| after dry-cleaned with perchloroethylene | | |
| one time | fourth to fifth grade | fourth to fifth grade |
| two times | fourth to fifth grade | fourth to fifth grade |
| five times | fourth to fifth grade | fourth to fifth grade |

TABLE 69 the grade of the color fastness to abrasion of the dyed fabric of polyester/rayon before dry-cleaned and after dry-cleaned with a dry-cleaning solvent

| polyester/rayon | the grade of the color fastness to abrasion before the test | after the test |
|---|---|---|
| before dry-cleaned | fourth to fifth grade | fourth to fifth grade |
| after dry-cleaned with propylene glycol methyl ether propionate | | |
| one time | fourth to fifth grade | fourth to fifth grade |
| two times | fourth to fifth grade | fourth to fifth grade |
| five times | fourth to fifth grade | fourth to fifth grade |
| ten times | fourth to fifth grade | fourth to fifth grade |
| twenty times | fourth to fifth grade | fourth to fifth grade |
| after dry-cleaned with stoddard solvent type I | | |
| one time | fourth to fifth grade | fourth to fifth grade |
| two times | fourth to fifth grade | fourth to fifth grade |
| five times | fourth to fifth grade | fourth to fifth grade |
| after dry-cleaned with stoddard solvent type II | | |
| one time | fourth to fifth grade | fourth to fifth grade |
| two times | fourth grade | fourth to fifth grade |
| five times | fourth to fifth grade | fourth to fifth grade |
| after dry-cleaned with perchloroethylene | | |
| one time | fourth to fifth grade | fourth to fifth grade |
| two times | fourth to fifth grade | fourth to fifth grade |
| five times | fourth to fifth grade | fourth to fifth grade |

TABLE 70 the grade of the color fastness to abrasion of the dyed fabric of nylon/polyacrylonitrile before dry-cleaned and after dry-cleaned with a dry-cleaning solvent

| nylon/polyacrylonitrile | the grade of the color fastness to abrasion before the test | after the test |
|---|---|---|
| before dry-cleaned | fourth to fifth grade | fourth to fifth grade |
| after dry-cleaned with propylene glycol methyl ether propionate | | |
| one time | fourth to fifth grade | fourth to fifth grade |
| two times | fourth to fifth grade | fourth to fifth grade |
| five times | fourth to fifth grade | fourth to fifth grade |
| ten times | fourth grade | fourth to fifth grade |
| twenty times | fourth to fifth grade | fourth to fifth grade |
| after dry-cleaned with stoddard solvent type I | | |
| one time | fourth to fifth grade | fourth to fifth grade |
| two times | fourth to fifth grade | fourth to fifth grade |
| five times | fourth to fifth grade | fourth to fifth grade |
| after dry-cleaned with stoddard solvent type II | | |
| one time | fourth to fifth grade | fourth to fifth grade |
| two times | fourth to fifth grade | fourth to fifth grade |
| five times | fourth to fifth grade | fourth to fifth grade |

TABLE 70-continued the grade of the color fastness to abrasion of the dyed fabric of nylon/polyacrylonitrile before dry-cleaned and after dry-cleaned with a dry-cleaning solvent

| nylon/polyacrylonitrile | the grade of the color fastness to abrasion before the test | after the test |
|---|---|---|
| after dry-cleaned with perchloroethylene | | |
| one time | fourth to fifth grade | fourth to fifth grade |
| two times | fourth to fifth grade | fourth to fifth grade |
| five times | fourth to fifth grade | fourth to fifth grade |

TABLE 71 the grade of the color fastness to abrasion of the dyed fabric of polyester/cotton before dry-cleaned and after dry-cleaned with a dry-cleaning solvent

| polyester/cotton | the grade of the color fastness to abrasion before the test | after the test |
|---|---|---|
| before dry-cleaned | fourth to fifth grade | fourth to fifth grade |
| after dry-cleaned with propylene glycol methyl ether propionate | | |
| one time | fourth grade | fourth to fifth grade |
| two times | fourth to fifth grade | fourth to fifth grade |
| five times | fourth to fifth grade | fourth to fifth grade |
| ten times | fourth to fifth grade | fourth to fifth grade |
| twenty times | fourth to fifth grade | fourth to fifth grade |
| after dry-cleaned with stoddard solvent type I | | |
| one time | fourth to fifth grade | fourth to fifth grade |
| two times | fourth to fifth grade | fourth to fifth grade |
| five times | fourth to fifth grade | fourth to fifth grade |
| after dry-cleaned with stoddard solvent type II | | |
| one time | fourth to fifth grade | fourth to fifth grade |
| two times | fourth to fifth grade | fourth to fifth grade |
| five times | fourth to fifth grade | fourth to fifth grade |
| after dry-cleaned with perchloroethylene | | |
| one time | fourth to fifth grade | fourth to fifth grade |
| two times | fourth to fifth grade | fourth to fifth grade |
| five times | fourth to fifth grade | fourth to fifth grade |

TABLE 72 the grade of the color fastness to abrasion of the dyed fabric of cotton before dry-cleaned and after dry-cleaned with a dry-cleaning solvent

| cotton | the grade of the color fastness to abrasion before the test | after the test |
|---|---|---|
| before dry-cleaned | fourth to fifth grade | fourth to fifth grade |
| after dry-cleaned with propylene glycol methyl ether propionate | | |
| one time | fourth grade | fourth grade |
| two times | fourth to fifth grade | fourth to fifth grade |
| five times | fourth to fifth grade | fourth to fifth grade |
| ten times | fourth to fifth grade | fourth to fifth grade |
| twenty times | fourth to fifth grade | fourth to fifth grade |
| after dry-cleaned with stoddard solvent: type I | | |
| one time | fourth to fifth grade | fourth to fifth grade |
| two times | fourth to fifth grade | fourth to fifth grade |
| five times | fourth to fifth grade | fourth to fifth grade |
| after dry-cleaned with stoddard solvent type II | | |
| one time | fourth to fifth grade | fourth to fifth grade |
| two times | fourth to fifth grade | fourth to fifth grade |
| five times | fourth to fifth grade | fourth to fifth grade |

TABLE 72-continued the grade of the color fastness to abrasion of the dyed fabric of cotton before dry-cleaned and after dry-cleaned with a dry-cleaning solvent

| cotton | the grade of the color fastness to abrasion before the test | after the test |
|---|---|---|
| after dry-cleaned with perchloroethylene | | |
| one time | fourth to fifth grade | fourth to fifth grade |
| two times | fourth to fifth grade | fourth to fifth grade |
| five times | fourth to fifth grade | fourth to fifth grade |

TABLE 73 the grade of the color fastness to abrasion of the dyed fabric of nylon before dry-cleaned and after dry-cleaned with a dry-cleaning solvent

| nylon | the grade of the color fastness to abrasion before the test | after the test |
|---|---|---|
| before dry-cleaned | fourth to fifth grade | fourth to fifth grade |
| after dry-cleaned with propylene glycol methyl ether propionate | | |
| one time | fourth to fifth grade | fourth to fifth grade |
| two times | fourth to fifth grade | fourth to fifth grade |
| five times | fourth to fifth grade | fourth to fifth grade |
| ten times | fourth to fifth grade | fourth to fifth grade |
| twenty times | fourth to fifth grade | fourth to fifth grade |
| after dry-cleaned with stoddard solvent type I | | |
| one time | fourth to fifth grade | fourth to fifth grade |
| two times | fourth to fifth grade | fourth to fifth grade |
| five times | fourth to fifth grade | fourth to fifth grade |
| after dry-cleaned with stoddard solvent type II | | |
| one time | fourth to fifth grade | fourth to fifth grade |
| two times | fourth to fifth grade | fourth to fifth grade |
| five times | fourth to fifth grade | fourth to fifth grade |
| after dry-cleaned with perchloroethylene | | |
| one time | fourth to fifth grade | fourth to fifth grade |
| two times | fourth to fifth grade | fourth to fifth grade |
| five times | fourth to fifth grade | fourth to fifth grade |

TABLE 74 the yellowness index, the whiteness index and the Lab values of gray nylon goods before dry-cleaned and after dry-cleaned with a dry-cleaning solvent

| gray nylon goods | the yellowness index | the whiteness index | L | a | b | c |
|---|---|---|---|---|---|---|
| before dry-cleaning | −15.75 | 108.11 | 85.51 | −0.01 | −6.99 | 6.99 |
| after dry-cleaned with propylene glycol methyl ether propionate | | | | | | |
| one time | −18.33 | 90.1 | 78.7 | 0.28 | −7.71 | 7.72 |
| two times | −18.79 | 91.13 | 78.73 | 0.35 | −7.91 | 7.92 |
| five times | −17.68 | 89.31 | 78.81 | 0.36 | −7.51 | 7.52 |
| after dry-cleaned with stoddard solvent type I | | | | | | |
| one time | −18.46 | 89.55 | 78.5 | 0.16 | −7.69 | 7.7 |
| two times | −18.56 | 89.27 | 78.31 | 0.23 | −7.76 | 7.76 |
| five times | −17.77 | 88.65 | 78.57 | 0.25 | −7.48 | 7.49 |
| after dry-cleaned with stoddard solvent type II | | | | | | |
| one time | −18.88 | 88.85 | 77.97 | 0.18 | −7.81 | 7.82 |
| two times | −18.25 | 90.71 | 78.97 | 0.31 | −7.73 | 7.74 |
| five times | −18.2 | 88.45 | 78.2 | 0.29 | −7.64 | 7.65 |

TABLE 74-continued the yellowness index, the whiteness index and the Lab values of gray nylon goods before dry-cleaned and after dry-cleaned with a dry-cleaning solvent

| gray nylon goods | the yellowness index | the whiteness index | L | a | b | c |
|---|---|---|---|---|---|---|
| after dry-cleaned with perchloroethylene | | | | | | |
| one time | −17.84 | 86.79 | 77.88 | 0.21 | −7.42 | 7.43 |
| two times | −17.15 | 88.32 | 78.9 | 0.15 | −7.2 | 7.21 |
| five times | −17.75 | 87.15 | 78.04 | 0.25 | −7.41 | 7.42 |

TABLE 75 the differences of the Lab values of gray nylon goods after dry-cleaned with a dry-cleaning solvent

| gray nylon goods | ΔL | Δa | Δb | Δc | Δh | ΔE | h |
|---|---|---|---|---|---|---|---|
| after dry-cleaned with propylene glycol methyl ether propionate | | | | | | | |
| one time | −7.81 | 0.29 | −0.73 | 0.73 | 0.28 | 7.85 | 272.05 |
| two times | −7.78 | 0.36 | −0.93 | 6.94 | 0.34 | 7.85 | 272.55 |
| five times | −7.71 | 0.37 | −0.52 | 0.53 | 0.36 | 7.73 | 272.71 |
| after dry-cleaned with stoddard solvent type I | | | | | | | |
| one time | −8.01 | 0.08 | 0.71 | 0.71 | 0.17 | 8.05 | 271.13 |
| two times | −8.21 | 0.25 | −0.07 | 0.77 | 0.23 | 8.25 | 271.72 |
| five times | −7.95 | 0.27 | −0.5 | 0.5 | 0.26 | 7.97 | 271.94 |
| after dry-cleaned with stoddard solvent type II | | | | | | | |
| one time | −8.54 | 0.19 | −0.83 | 0.83 | 0.18 | 8.58 | 271.33 |
| two times | −7.55 | 0.32 | −0.75 | 0.76 | 0.31 | 7.59 | 272.31 |
| five times | −8.32 | 0.31 | −0.66 | 0.66 | 0.29 | 8.35 | 272.2 |
| after dry-cleaned with perchloroethylene | | | | | | | |
| one time | −8.64 | 0.22 | −0.44 | 0.44 | 0.22 | 8.65 | 271.61 |
| two times | −7.62 | 0.16 | −0.22 | 0.22 | 0.16 | 7.62 | 271.19 |
| five times | −8.47 | 0.26 | −0.43 | 0.43 | 0.25 | 8.49 | 271.9 |

TABLE 76 the yellowness index, the whiteness index, and the Lab values of gray silk goods before dry-cleaned and after dry-cleaned with a dry-cleaning solvent

| gray silk goods | the yellowness index | the whiteness index | L | a | b | c |
|---|---|---|---|---|---|---|
| before dry-cleaned | 12.21 | 39.88 | 83.9 | −0.09 | 5.67 | 5.67 |
| after dry-cleaned with propylene glycol methyl ether propionate | | | | | | |
| one time | 8.07 | 50.87 | 85.78 | −0.38 | 3.81 | 3.83 |
| two times | 8.79 | 48.19 | 85.12 | −0.44 | 4.19 | 4.19 |
| five times | 11.22 | 43.65 | 85.35 | −0.18 | 5.29 | 5.29 |
| after dry-cleaned with stoddard solvent type I | | | | | | |
| one time | 10.6 | 44.42 | 84.96 | −0.23 | 4.97 | 4.98 |
| two times | 9.61 | 46.88 | 85.33 | −0.35 | 4.55 | 4.56 |
| five times | 8.87 | 48.73 | 85.57 | −0.4 | 4.21 | 4.23 |
| after dry-cleaned with stoddard solvent type II | | | | | | |
| one time | 11.22 | 43 | 84.79 | −0.15 | 5.25 | 5.25 |
| two times | 9.51 | 46.73 | 85.12 | −0.39 | 4.51 | 4.53 |
| five times | 9.07 | 48.07 | 85.48 | −0.45 | 4.33 | 4.36 |
| after dry-cleaned with perchloroethylene | | | | | | |
| one time | 11.41 | 40.92 | 83.73 | −0.32 | 5.37 | 5.37 |
| two times | 10.15 | 44.46 | 84.71 | −0.55 | 4.89 | 4.92 |
| five times | 10.36 | 44.24 | 84.78 | −0.45 | 4.95 | 4.97 |

TABLE 77 the differences of the Lab values of gray silk goods after dry-cleaned with a dry-cleaning solvent

| gray silk goods | ΔL | Δa | Δb | Δc | Δh | ΔE | h |
|---|---|---|---|---|---|---|---|
| after dry-cleaned with propylene glycol methyl ether propionate | | | | | | | |
| one time | 1.88 | −0.3 | −1.87 | −1.85 | 0.39 | 2.67 | 95.73 |
| two times | 1.22 | −0.35 | −1.5 | −1.48 | 0.43 | 1.97 | 95.96 |
| five times | 1.45 | −0.09 | −0.38 | −0.38 | 0.1 | 1.5 | 91.91 |
| after dry-cleaned with stoddard solvent type I | | | | | | | |
| one time | 1.06 | −0.14 | −0.7 | −0.69 | 0.16 | 1.28 | 92.63 |
| two times | 1.43 | −0.26 | −1.12 | −1.11 | 0.31 | 1.84 | 94.36 |
| five times | 1.67 | −0.32 | −1.46 | −1.44 | 0.39 | 2.24 | 95.48 |
| after dry-cleaned with stoddard solvent type II | | | | | | | |
| one time | 0.89 | −0.06 | −0.42 | −0.42 | 0.07 | 0.99 | 91.59 |
| two times | 1.22 | −0.3 | −1.16 | −1.15 | 0.35 | 1.71 | 94.88 |
| five times | 1.59 | −0.36 | −1.34 | −1.32 | 0.44 | 2.11 | 95.95 |
| after dry-cleaned with perchloroethylene | | | | | | | |
| one time | −0.17 | −0.23 | −0.31 | −0.3 | 0.24 | 0.42 | 93.41 |
| two times | 0.82 | −0.46 | −0.78 | −0.75 | 0.51 | 1.22 | 96.37 |
| five times | 0.89 | −0.36 | −0.72 | −0.7 | 0.4 | 1.2 | 95.21 |

TABLE 78 the yellowness index, the whiteness index, and the Lab values of gray cotton goods before dry-cleaned and after dry-cleaned with a dry-cleaning solvent

| gray cotton goods | the yellowness index | the whiteness index | L | a | b | c |
|---|---|---|---|---|---|---|
| before dry-cleaned | 3.78 | 64.84 | 88.13 | −0.28 | 1.61 | 1.64 |
| after dry-cleaned with propylene glycol methyl ether propionate | | | | | | |
| one time | 4.07 | 64.44 | 88.18 | −0.19 | 1.71 | 1.72 |
| two times | 4.24 | 64.79 | 88.53 | −0.13 | 1.78 | 1.78 |
| five times | 4.08 | 64.45 | 88.18 | −0.16 | 1.71 | 1.72 |
| after dry-cleaned with stoddard solvent type I | | | | | | |
| one time | 4.24 | 63.66 | 88.05 | −0.24 | 1.83 | 1.84 |
| two times | 4.11 | 63.2 | 87.63 | −0.25 | 1.76 | 1.77 |
| five times | 4.28 | 64.01 | 88.27 | −0.23 | 1.84 | 1.86 |
| after dry-cleaned with stoddard solvent type II | | | | | | |
| one time | 4.06 | 63.11 | 87.51 | −0.25 | 1.73 | 1.75 |
| two times | 3.83 | 65.43 | 88.37 | −0.16 | 1.59 | 1.59 |
| five times | 3.92 | 64.84 | 88.2 | −0.18 | 1.64 | 1.65 |
| after dry-cleaned with perchloroethylene | | | | | | |
| one time | 4.31 | 62.8 | 87.59 | −0.17 | 1.81 | 1.81 |
| two times | 4.27 | 64.47 | 88.43 | −0.16 | 1.81 | 1.81 |
| five times | 4.27 | 64.22 | 88.27 | −0.14 | 1.8 | 1.81 |

TABLE 79 the differences of the Lab values of gray cotton goods after dry-cleaned with a dry-cleaning solvent

| gray cotton goods | ΔL | Δa | Δb | Δc | Δh | ΔE | h |
|---|---|---|---|---|---|---|---|
| after dry-cleaned with propylene glycol methyl ether propionate | | | | | | | |
| one time | 0.06 | 0.09 | 0.1 | 0.09 | −0.1 | 0.15 | 96.28 |
| two times | 0.4 | 0.15 | 0.17 | 0.15 | −0.17 | 0.46 | 94.24 |
| five times | 0.06 | 0.12 | 0.09 | 0.08 | −0.13 | 0.16 | 95.44 |

TABLE 79-continued the differences of the Lab values of gray cotton goods after dry-cleaned with a dry-cleaning solvent

| gray cotton goods | ΔL | Δa | Δb | Δc | Δh | ΔE | h |
|---|---|---|---|---|---|---|---|
| after dry-cleaned with stoddard solvent type I | | | | | | | |
| one time | −0.08 | 0.04 | 0.21 | 0.21 | −0.07 | 0.23 | 97.48 |
| two times | −0.5 | 0.03 | 0.14 | 0.14 | −0.05 | 0.52 | 98.01 |
| five times | 0.14 | 0.05 | 0.23 | 0.22 | −0.09 | 0.28 | 97.01 |
| after dry-cleaned with stoddard solvent type II | | | | | | | |
| one time | −0.61 | 0.03 | 0.11 | 0.11 | −0.05 | 0.62 | 98.17 |
| two times | 0.24 | 0.12 | −0.03 | −0.04 | −0.11 | 0.27 | 95.88 |
| five times | 0.07 | 0.1 | 0.03 | 0.01 | −0.1 | 0.12 | 96.33 |
| after dry-cleaned with perchloroethylene | | | | | | | |
| one time | −0.54 | 0.11 | 0.19 | 0.18 | −0.14 | 0.58 | 95.28 |
| two times | 0.3 | 0.12 | 0.19 | 0.17 | −0.14 | 0.37 | 95.15 |
| five times | 0.15 | 0.14 | 0.19 | 0.17 | −0.16 | 0.27 | 94.57 |

TABLE 80 the yellowness index, the whiteness index, and the Lab values of gray wool goods before dry-cleaned and after dry-cleaned with a dry-cleaning solvent

| gray wool goods | the yellowness index | the whiteness index | L | a | b | c |
|---|---|---|---|---|---|---|
| before dry-cleaned | 13 | 36.13 | 82.89 | −0.65 | 6.33 | 6.36 |
| after dry-cleaned with propylene glycol methyl ether propionate | | | | | | |
| one time | 14 | 34.45 | 83.14 | −0.58 | 6.82 | 6.84 |
| two times | 12.48 | 37.27 | 83.96 | −0.65 | 6.07 | 6.1 |
| five times | 13.55 | 35.69 | 83.45 | −0.59 | 6.61 | 6.64 |
| after dry-cleaned with stoddard solvent type I | | | | | | |
| one time | 13.97 | 34.34 | 83.09 | −0.64 | 6.83 | 6.86 |
| two times | 13.33 | 35.56 | 83.07 | −0.69 | 6.53 | 6.56 |
| five times | 15.36 | 31.06 | 82.73 | −0.65 | 7.52 | 7.55 |
| after dry-cleaned with stoddard solvent type II | | | | | | |
| one time | 15.12 | 31.56 | 82.68 | −0.63 | 7.38 | 7.41 |
| two times | 13.86 | 34.53 | 82.56 | −0.36 | 6.59 | 6.6 |
| five times | 14.58 | 32.97 | 82.96 | −0.61 | 7.12 | 7.15 |
| after dry-cleaned with perchloroethylene | | | | | | |
| one time | 14.31 | 32.43 | 81.71 | −0.51 | 6.84 | 6.86 |
| two times | 14.88 | 32.16 | 82.62 | −0.54 | 7.21 | 7.23 |
| five times | 14.41 | 33.18 | 82.6 | −0.49 | 6.94 | 6.96 |

TABLE 81 the differences of the Lab values of gray wool goods after dry-cleaned with a dry-cleaning solvent

| gray wool goods | ΔL | Δa | Δb | Δc | Δh | ΔE | h |
|---|---|---|---|---|---|---|---|
| after dry-cleaned with propylene glycol methyl ether propionate | | | | | | | |
| one time | 0.25 | 0.07 | 0.49 | 0.48 | −0.11 | 0.56 | 94.9 |
| two times | 0.07 | 0 | −0.26 | −0.26 | 0.03 | 0.27 | 96.14 |
| five times | 0.56 | 0.06 | 0.28 | 0.28 | −0.09 | 0.63 | 95.1 |
| after dry-cleaned with stoddard solvent type I | | | | | | | |
| one time | 0.2 | 0.02 | 0.5 | 0.5 | −0.06 | 0.54 | 95.33 |
| two times | 0.18 | −0.04 | 0.2 | 0.2 | 0.02 | 0.27 | 96.05 |
| five times | −0.16 | 0 | 1.2 | 1.19 | 0.11 | 1.21 | 94.95 |

TABLE 81-continued

| the differences of the Lab values of gray wool goods after dry-cleaned with a dry-cleaning solvent | | | | | | | |
|---|---|---|---|---|---|---|---|
| gray wool goods | ΔL | Δa | Δb | Δc | Δh | ΔE | h |
| after dry-cleaned with stoddard solvent type II | | | | | | | |
| one time | −0.21 | 0.03 | 1.05 | 1.05 | −0.13 | 1.07 | 94.84 |
| two times | −0.33 | 0.3 | 0.26 | 0.24 | −0.32 | 0.52 | 93.09 |
| five times | 0.08 | 0.04 | 0.79 | 0.79 | 0.11 | 0.8 | 94.93 |
| after dry-cleaned with perchloroethylene | | | | | | | |
| one time | −1.18 | 0.14 | 0.51 | 0.49 | −0.18 | 1.29 | 94.29 |
| two times | −0.27 | 0.11 | 0.88 | 0.87 | −0.19 | 0.93 | 94.28 |
| five times | −0.29 | 0.16 | 0.62 | 0.6 | −0.22 | 0.7 | 94.03 |

TABLE 82

| the yellowness index, the whiteness index, and the Lab values of gray polyester goods before dry-cleaned and after dry-cleaned with a dry-cleaning solvent | | | | | | |
|---|---|---|---|---|---|---|
| gray polyester goods | the yellowness index | the whiteness index | L | a | b | c |
| before dry-cleaned | −15.66 | 112.14 | 87.83 | 0.12 | −7.37 | 7.37 |
| after dry-cleaned with propylene glycol methyl ether propionate | | | | | | |
| one time | −13.7 | 93.65 | 83 | 0.51 | −6.45 | 6.47 |
| two times | −15.52 | 113.85 | 88.3 | 0.37 | −7.47 | 7.48 |
| five times | −13.99 | 111.31 | 88.71 | 0.32 | −6.82 | 6.83 |
| after dry-cleaned with stoddard solvent type I | | | | | | |
| one time | −12.65 | 88.58 | 82.04 | 0.38 | −5.9 | 5.92 |
| two times | −15 | 109.42 | 87.39 | 0.23 | −7.12 | 7.13 |
| five times | −14.29 | 109.64 | 87.98 | 0.27 | −6.87 | 6.87 |
| after dry-cleaned with stoddard solvent type II | | | | | | |
| one time | −14.32 | 107.7 | 87.49 | 0.06 | −6.75 | 6.75 |
| two times | −14.26 | 109.54 | 87.98 | 0.26 | −6.85 | 6.85 |
| five times | −13.84 | 94.02 | 83.04 | 0.51 | −6.51 | 6.53 |
| after dry-cleaned with perchloroethylene | | | | | | |
| one time | −11.7 | 90.08 | 83.3 | 0.38 | −5.57 | 5.58 |
| two times | −13.73 | 108.61 | 88.14 | 0.18 | −6.6 | 6.6 |
| five times | −12.14 | 92.01 | 83.65 | 0.44 | −5.81 | 5.83 |

TABLE 83

| the differences of the Lab values of gray polyester goods after dry-cleaned with a dry-cleaning solvent | | | | | | | |
|---|---|---|---|---|---|---|---|
| gray polyester goods | ΔL | Δa | Δb | Δc | Δh | ΔE | h |
| after dry-cleaned with propylene glycol methyl ether propionate | | | | | | | |
| one time | −4.82 | 0.38 | 0.93 | −0.91 | 0.43 | 4.92 | 274.49 |
| two times | 0.48 | 0.25 | −0.09 | 0.1 | 0.24 | 0.54 | 272.82 |
| five times | 0.89 | 0.2 | 0.58 | −0.55 | 0.22 | 1.07 | 272.71 |
| after dry-cleaned with stoddard solvent type I | | | | | | | |
| one time | −5.79 | 0.26 | 1.47 | −1.46 | 0.32 | 5.98 | 273.72 |
| two times | −0.43 | 0.11 | 0.25 | −0.25 | 0.12 | 0.51 | 271.89 |
| five times | −0.16 | 0.15 | 0.51 | −0.5 | 0.16 | 0.55 | 272.25 |
| after dry-cleaned with stoddard solvent type II | | | | | | | |
| one time | −0.34 | −0.06 | 0.62 | −0.62 | −0.05 | 0.71 | 270.52 |
| two times | 0.16 | 0.13 | 0.52 | −0.52 | 0.15 | 0.56 | 272.14 |
| five times | −4.78 | 0.39 | 0.86 | −0.84 | 0.43 | 4.88 | 274.48 |

TABLE 83-continued

| the differences of the Lab values of gray polyester goods after dry-cleaned with a dry-cleaning solvent | | | | | | | |
|---|---|---|---|---|---|---|---|
| gray polyester goods | ΔL | Δa | Δb | Δc | Δh | ΔE | h |
| after dry-cleaned with perchloroethylene | | | | | | | |
| one time | −4.53 | 0.25 | 1.81 | 1.79 | 0.33 | 4.88 | 273.87 |
| two times | −4.18 | 0.31 | 1.56 | −1.54 | 0.38 | 4.47 | 271.58 |
| five times | −4.18 | 0.31 | 1.56 | −1.54 | 0.38 | 4.47 | 274.29 |

TABLE 84

| the K/S value, the grade of color change and the Lab values of the dyed fabric of wool before dry-cleaned and after dry-cleaned with a dry-cleaning solvent | | | | | | | |
|---|---|---|---|---|---|---|---|
| wool | K/S value | the grade of color change | L | a | b | c | h |
| before dry-cleaned | 9.02 | — | 32.73 | −8.01 | 6.18 | 10.12 | 142.32 |
| after dry-cleaned with dry-cleaning solvent composition A | | | | | | | |
| one time | 9.36 | fourth grade | 31.99 | −7.87 | 5.67 | 5.67 | 144.22 |
| two times | 9.08 | fifth grade | 32.58 | −8.16 | 5.94 | 5.94 | 143.95 |
| five times | 9.32 | third to fourth grade | 31.9 | −7.7 | 5.01 | 5.01 | 146.93 |
| after dry-cleaned with dry-cleaning solvent composition B | | | | | | | |
| one time | 9.12 | fifth grade | 32.69 | −7.9 | 6.03 | 6.03 | 142.65 |
| two times | 8.77 | fourth to fifth grade | 33.01 | −7.88 | 5.93 | 5.93 | 143 |
| five times | 8.58 | fourth grade | 32.55 | −7.55 | 5.26 | 5.26 | 145.14 |
| after dry-cleaned with dry-cleaning solvent composition C | | | | | | | |
| one time | 9.08 | fourth to fifth grade | 32.45 | −7.82 | 5.89 | 5.89 | 143.14 |
| two times | 8.83 | fourth grade | 32.97 | −7.57 | 5.37 | 5.37 | 144.65 |
| five times | 8.83 | third to fourth grade | 32.38 | −7.5 | 4.89 | 4.89 | 146.86 |
| after dry-cleaned with dry-cleaning solvent composition D | | | | | | | |
| one time | 8.65 | fourth grade | 32.84 | −7.71 | 5.39 | 5.39 | 145.02 |
| two times | 8.76 | third to fourth grade | 32.58 | −7.32 | 4.93 | 4.93 | 146.05 |
| five times | 9.16 | fourth grade | 32.22 | −7.48 | 5.19 | 5.19 | 145.24 |
| after dry-cleaned with dry-cleaning solvent composition E | | | | | | | |
| one time | 9.28 | fourth grade | 32.23 | −7.67 | 5.42 | 5.42 | 144.79 |
| two times | 8.93 | third to fourth grade | 32.58 | −7.45 | 5.08 | 5.08 | 145.73 |
| five times | 9.22 | third to fourth grade | 32.15 | −7.49 | 5.25 | 5.25 | 144.94 |

TABLE 85

| the differences of the Lab values of the dyed fabric of wool after dry-cleaned with a dry-cleaning solvent | | | | | | |
|---|---|---|---|---|---|---|
| wool | ΔL | Δa | Δb | Δc | Δh | ΔE |
| after dry-cleaned with dry-cleaning solvent composition A | | | | | | |
| one time | −0.74 | 0.14 | −0.51 | −0.42 | 0.33 | 0.91 |
| two times | −0.16 | −0.16 | −0.24 | −0.02 | 0.29 | 0.33 |
| five times | −0.83 | 0.31 | −1.17 | −0.93 | 0.78 | 1.47 |
| after dry-cleaned with dry-cleaning solvent composition B | | | | | | |
| one time | −0.04 | 0.11 | −0.16 | −0.18 | 0.06 | 0.2 |
| two times | 0.28 | 0.13 | −0.25 | −0.26 | 0.12 | 0.4 |
| five times | −0.18 | 0.46 | −0.93 | −0.92 | 0.47 | 1.05 |

TABLE 85-continued the differences of the Lab values of the dyed fabric of wool after dry-cleaned with a dry-cleaning solvent

| wool | ΔL | Δa | Δb | Δc | Δh | ΔE |
|---|---|---|---|---|---|---|
| after dry-cleaned with dry-cleaning solvent composition C | | | | | | |
| one time | −0.28 | 0.19 | −0.3 | −0.33 | 0.12 | 0.45 |
| two times | 0.27 | 0.44 | −0.81 | −0.84 | 0.39 | 0.95 |
| five times | −0.35 | 0.51 | −1.29 | −1.17 | 0.75 | 1.43 |
| after dry-cleaned with dry-cleaning solvent composition D | | | | | | |
| one time | 0.1 | 0.3 | −0.79 | −0.71 | 0.46 | 0.85 |
| two times | −0.15 | 0.69 | −1.26 | −1.3 | 0.61 | 1.44 |
| five times | −0.47 | 0.38 | −0.87 | −0.82 | 0.47 | 1.04 |
| after dry-cleaned with dry-cleaning solvent composition E | | | | | | |
| one time | −0.51 | 0.33 | −0.77 | −0.73 | 0.42 | 0.98 |
| two times | −0.15 | 0.56 | −1.11 | −1.1 | 0.57 | 1.25 |
| five times | −0.58 | 0.52 | −0.93 | −0.97 | 0.44 | 1.22 |

TABLE 86 the K/S value, the grade of color change and the Lab values of the dyed fabric of polyester/rayon before dry-cleaned and after dry-cleaned with a dry-cleaning solvent

| polyester/rayon | K/S value | the grade of color change | L | a | b | c | h |
|---|---|---|---|---|---|---|---|
| before dry-cleaned | 2.87 | N/A | 50.88 | −2.32 | −22.39 | 22.51 | 264.09 |
| after dry-cleaned with dry-cleaning solvent composition A | | | | | | | |
| one time | 2.94 | fourth to fifth grade | 50.75 | −2.8 | −22.04 | 22.22 | 262.76 |
| two times | 2.81 | fourth grade | 51.36 | −2.74 | −21.94 | 22.11 | 262.88 |
| five times | 3.03 | fourth grade | 50.34 | −2.86 | −21.96 | 22.15 | 262.58 |
| after dry-cleaned with dry-cleaning solvent composition B | | | | | | | |
| one time | 3.04 | fourth grade | 50.37 | −2.65 | −22.66 | 22.82 | 263.32 |
| two times | 2.71 | third to fourth grade | 51.67 | −2.7 | −21.53 | 21.7 | 262.85 |
| five times | 2.97 | fourth to fifth grade | 50.58 | −2.7 | −21.98 | 22.14 | 262.99 |
| after dry-cleaned with dry-cleaning solvent composition C | | | | | | | |
| one time | 2.94 | fourth grade | 50.49 | −2.55 | −21.9 | 22.05 | 263.36 |
| two times | 2.96 | fourth to fifth grade | 50.86 | −2.98 | −22.16 | 22.36 | 262.34 |
| five times | 2.97 | fourth to fifth grade | 50.85 | −2.66 | −22.88 | 23.03 | 263.38 |
| after dry-cleaned with dry-cleaning solvent composition D | | | | | | | |
| one time | 3.09 | third to fourth grade | 50.43 | −2.66 | −23.25 | 23.41 | 263.47 |
| two times | 3.03 | fourth grade | 50.56 | −2.32 | −23.3 | 23.42 | 264.3 |
| five times | 3 | fourth to fifth grade | 50.48 | −2.43 | −22.77 | 22.9 | 263.92 |
| after dry-cleaned with dry-cleaning solvent composition E | | | | | | | |
| one time | 2.84 | fourth to fifth grade | 51.15 | −2.34 | −22.55 | 22.67 | 264.08 |
| two times | 2.97 | fourth grade | 50.82 | −2.56 | −23.05 | 23.19 | 263.68 |
| five times | 3.01 | fourth grade | 50.3 | −2.66 | −21.99 | 22.15 | 263.1 |

TABLE 87 the differences of the Lab values of the dyed fabric of polyester/rayon after dry-cleaned with a dry-cleaning solvent

| polyester/rayon | ΔL | Δa | Δb | Δc | Δh | ΔE |
|---|---|---|---|---|---|---|
| after dry-cleaned with dry-cleaning solvent composition A | | | | | | |
| one time | −0.13 | −0.48 | 0.35 | −0.29 | −0.52 | 0.61 |
| two times | 0.48 | −0.43 | 0.45 | −0.4 | −0.47 | 0.78 |
| five times | −0.54 | −0.54 | 0.43 | −0.36 | −0.59 | 0.88 |
| after dry-cleaned with dry-cleaning solvent composition B | | | | | | |
| one time | −0.51 | −0.34 | −0.27 | 0.31 | −0.3 | 0.67 |
| two times | 0.8 | −0.39 | 0.86 | −0.81 | −0.48 | 1.23 |
| five times | −0.3 | −0.39 | 0.41 | −0.37 | −0.43 | 0.64 |
| after dry-cleaned with dry-cleaning solvent composition C | | | | | | |
| one time | −0.39 | −0.23 | 0.49 | −0.46 | −0.28 | 0.67 |
| two times | −0.02 | −0.66 | 0.23 | −0.15 | −0.69 | 0.7 |
| five times | −0.03 | −0.34 | −0.49 | 0.52 | −0.28 | 0.6 |
| after dry-cleaned with dry-cleaning solvent composition D | | | | | | |
| one time | −0.45 | −0.34 | −0.89 | 0.9 | −0.25 | 1.03 |
| two times | −0.31 | −0.01 | −0.91 | 0.91 | 0.08 | 0.97 |
| five times | −0.4 | −0.11 | −0.38 | 0.39 | −0.07 | 0.56 |
| after dry-cleaned with dry-cleaning solvent composition E | | | | | | |
| one time | 0.27 | −0.02 | −0.16 | 0.16 | 0 | 0.31 |
| two times | −0.06 | −0.24 | −0.66 | 0.69 | −0.17 | 0.71 |
| five times | −0.58 | −0.34 | 0.4 | −0.36 | −0.39 | 0.78 |

TABLE 88 the K/S value, the grade of color change and the Lab values of the dyed fabric of polyester before dry-cleaned and after dry-cleaned with a dry-cleaning solvent

| polyester | K/S value | the grade of color change | L | a | b | c | h |
|---|---|---|---|---|---|---|---|
| before dry-cleaned | 2.87 | N/A | 45.64 | −33.61 | 4.49 | 33.9 | 172.39 |
| after dry-cleaned with dry-cleaning solvent composition A | | | | | | | |
| one time | 8.13 | fourth to fifth grade | 45.43 | −33.81 | 4.38 | 34.09 | 172.62 |
| two times | 7.86 | fourth to fifth grade | 45.97 | −33.97 | 4.64 | 34.28 | 172.21 |
| five times | 7.85 | fourth grade | 46.25 | −34.31 | 4.24 | 34.57 | 172.96 |
| after dry-cleaned with dry-cleaning solvent composition B | | | | | | | |
| one time | 7.45 | third to fourth grade | 46.81 | −34.24 | 4.74 | 34.56 | 172.12 |
| two times | 7.45 | third to fourth grade | 46.83 | −34.21 | 4.76 | 34.54 | 172.48 |
| five times | 8 | fourth to fifth grade | 45.83 | −34.17 | 4.53 | 34.47 | 172.45 |
| after dry-cleaned with dry-cleaning solvent composition C | | | | | | | |
| one time | 7.8 | fourth to fifth grade | 46.07 | −33.84 | 4.5 | 34.14 | 172.43 |
| two times | 7.65 | fourth to fifth grade | 46.17 | −33.78 | 4.54 | 34.08 | 172.34 |
| five times | 7.95 | fifth grade | 45.68 | −33.72 | 4.39 | 34.01 | 172.59 |
| after dry-cleaned with dry-cleaning solvent composition D | | | | | | | |
| one time | 7.62 | fourth grade | 46.38 | −34.03 | 4.55 | 34.34 | 172.38 |
| two times | 7.59 | fourth grade | 46.35 | −33.86 | 4.6 | 34.18 | 172.27 |
| five times | 8.1 | fourth to fifth grade | 45.52 | −33.81 | 4.35 | 34.08 | 172.66 |
| after dry-cleaned with dry-cleaning solvent composition E | | | | | | | |
| one time | 8.06 | fourth to fifth grade | 45.62 | −33.81 | 4.09 | 34.05 | 173.10 |
| two times | 8.2 | fourth to fifth grade | 45.14 | −33.48 | 4.18 | 33.74 | 172.88 |

TABLE 88-continued

| the K/S value, the grade of color change and the Lab values of the dyed fabric of polyester before dry-cleaned and after dry-cleaned with a dry-cleaning solvent | | | | | | | |
|---|---|---|---|---|---|---|---|
| polyester | K/S value | the grade of color change | L | a | b | c | h |
| five times | 7.78 | fourth to fifth grade | 46.09 | −33.87 | 4.66 | 34.19 | 172.17 |

TABLE 89

| the differences of the Lab values of the dyed fabric of polyester after dry-cleaned with a dry-cleaning solvent | | | | | | |
|---|---|---|---|---|---|---|
| polyester | ΔL | Δa | Δb | Δc | Δh | ΔE |
| after dry-cleaned with dry-cleaning solvent composition A | | | | | | |
| one time | −0.21 | −0.21 | −0.11 | 0.19 | 0.13 | 0.31 |
| two times | 0.34 | −0.36 | 0.16 | 0.38 | −0.11 | 0.52 |
| five times | 0.61 | −0.71 | −0.25 | 0.67 | 0.34 | 0.97 |

TABLE 89-continued

| the differences of the Lab values of the dyed fabric of polyester after dry-cleaned with a dry-cleaning solvent | | | | | | |
|---|---|---|---|---|---|---|
| polyester | ΔL | Δa | Δb | Δc | Δh | ΔE |
| after dry-cleaned with dry-cleaning solvent composition B | | | | | | |
| one time | 1.18 | −0.63 | 0.25 | 0.66 | −0.16 | 1.36 |
| two times | 1.19 | −0.6 | 0.27 | 0.63 | −0.19 | 1.36 |
| five times | 0.19 | −0.57 | 0.04 | 0.57 | 0.03 | 0.6 |
| after dry-cleaned with dry-cleaning solvent composition C | | | | | | |
| one time | 0.44 | −0.23 | 0.01 | 0.23 | 0.02 | 0.5 |
| two times | 0.53 | −0.17 | 0.05 | 0.18 | −0.03 | 0.57 |
| five times | 0.04 | −0.12 | −0.1 | 0.1 | 0.12 | 0.16 |
| after dry-cleaned with dry-cleaning solvent composition D | | | | | | |
| one time | 0.74 | −0.43 | 0.06 | 0.43 | −0.51 | 0.83 |
| two times | 0.71 | −0.26 | 0.11 | 0.27 | −0.07 | 0.77 |
| five times | −0.11 | −0.2 | −0.14 | 0.18 | 0.16 | 0.27 |
| after dry-cleaned with dry-cleaning solvent composition E | | | | | | |
| one time | −0.01 | −0.2 | 0.4 | 0.15 | 0.42 | 0.44 |
| two times | −0.5 | 0.12 | −0.31 | −0.16 | 0.29 | 0.6 |
| five times | 0.45 | −0.27 | 0.17 | 0.29 | 0.13 | 0.55 |

TABLE 90

| the K/S value, the grades of color change and pollution and the Lab values of the dyed fabric of wool after dry-cleaned with a dry-cleaning solvent | | | | | | | | |
|---|---|---|---|---|---|---|---|---|
| wool | K/S value | the grade of color change | the grade of pollution | L | a | b | c | h |
| after dry-cleaned with dry-cleaning solvent composition A | | | | | | | | |
| one time | 9.65 | fourth grade | second to third grade | 31.4 | −7.97 | 5.38 | 9.62 | 146.9 |
| two times | 8.93 | fourth to fifth grade | second to third grade | 32.43 | −8.17 | 5.47 | 9.83 | 146.19 |
| five times | 8.98 | third to fourth grade | third grade | 32.14 | −7.73 | 4.86 | 9.13 | 147.83 |
| after dry-cleaned with dry-cleaning solvent composition B | | | | | | | | |
| one time | 8.85 | fourth to fifth grade | third to fourth grade | 32.97 | −7.81 | 5.92 | 9.8 | 142.82 |
| two times | 8.74 | fifth grade | third to fourth grade | 33.09 | −7.92 | 5.87 | 9.86 | 143.46 |
| five times | 8.93 | fifth grade | third to fourth grade | 32.44 | −7.67 | 5.27 | 9.3 | 145.5 |
| after dry-cleaned with dry-cleaning solvent composition C | | | | | | | | |
| one time | 9.08 | fourth to fifth grade | third to fourth grade | 32.37 | −7.77 | 5.56 | 9.55 | 144.41 |
| two times | 8.78 | fourth to fifth grade | third grade | 33 | −7.72 | 5.63 | 9.56 | 143.9 |
| five times | 9.02 | fourth to fifth grade | third to fourth grade | 32.17 | −7.7 | 5.32 | 9.36 | 145.35 |
| after dry-cleaned with dry-cleaning solvent composition D | | | | | | | | |
| one time | 8.87 | fourth to fifth grade | second to third grade | 32.55 | −7.59 | 5.4 | 9.31 | 144.54 |
| two times | 8.73 | fourth to fifth grade | third grade | 32.75 | −7.62 | 5.32 | 9.29 | 145.07 |
| five times | 8.91 | fourth to fifth grade | third to fourth grade | 32.6 | −7.64 | 5.51 | 9.42 | 144.23 |
| after dry-cleaned with dry-cleaning solvent composition E | | | | | | | | |
| one time | 8.96 | fourth to fifth grade | third to fourth grade | 32.53 | −7.84 | 5.39 | 9.51 | 145.49 |
| two times | 8.89 | fourth to fifth grade | third to fourth grade | 32.63 | −7.73 | 5.62 | 9.56 | 143.96 |
| five times | 9.08 | fifth grade | third to fourth grade | 32.11 | −7.72 | 5.24 | 9.33 | 144.84 |

TABLE 91

| the differences of the Lab values of the dyed fabric of wool after dry-cleaned with a dry-cleaning solvent | | | | | | |
|---|---|---|---|---|---|---|
| wool | ΔL | Δa | Δb | Δc | Δh | ΔE |
| after dry-cleaned with dry-cleaning solvent composition A | | | | | | |
| one time | −0.59 | −0.1 | −0.29 | 0.08 | 0.3 | 0.67 |
| two times | −0.15 | 0 | −0.47 | −0.27 | 0.39 | 0.5 |
| five times | −0.86 | 0 | −0.77 | −0.43 | 0.64 | 1.16 |
| after dry-cleaned with dry-cleaning solvent composition B | | | | | | |
| one time | 0.27 | 0.09 | −0.1 | −0.13 | 0.03 | 0.31 |
| two times | 9.08 | −0.05 | −0.06 | 0.05 | 0.08 | 0.11 |
| five times | −0.11 | −0.12 | 0.01 | 0.1 | 0.06 | 0.16 |

TABLE 91-continued

| the differences of the Lab values of the dyed fabric of wool after dry-cleaned with a dry-cleaning solvent | | | | | | |
|---|---|---|---|---|---|---|
| wool | ΔL | Δa | Δb | Δc | Δh | ΔE |
| after dry-cleaned with dry-cleaning solvent composition C | | | | | | |
| one time | −0.09 | 0.06 | −0.33 | −0.24 | 0.23 | 0.34 |
| two times | 0.04 | −0.15 | 0.26 | 0.28 | −0.12 | 0.31 |
| five times | −0.21 | −0.2 | 0.43 | 0.41 | −0.24 | 0.52 |
| after dry-cleaned with dry-cleaning solvent composition D | | | | | | |
| one time | −0.29 | 0.12 | 0.01 | −0.09 | −0.08 | 0.31 |
| two times | 0.17 | −0.2 | 0.4 | 0.47 | −0.15 | 0.53 |
| five times | 0.26 | −0.02 | 0.19 | 0.13 | −0.14 | 0.32 |
| after dry-cleaned with dry-cleaning solvent composition E | | | | | | |
| one time | 0.34 | −0.16 | 0.03 | 0.12 | 0.12 | 0.3 |
| two times | 0.05 | −0.28 | 0.55 | 0.54 | −0.29 | 0.61 |
| five times | −0.04 | −0.24 | −0.01 | 0.19 | 0.15 | 0.24 |

TABLE 92

| the K/S value, the grades of color change and pollution and the Lab values of the dyed fabric of polyester/rayon after dry-cleaned with a dry-cleaning solvent | | | | | | | | |
|---|---|---|---|---|---|---|---|---|
| polyester/rayon | K/S value | the grade of color change | the grade of pollution | L | a | b | c | h |
| after dry-cleaned with dry-cleaning solvent composition A | | | | | | | | |
| one time | 2.98 | fourth to fifth grade | third to fourth grade | 50.51 | −2.79 | −21.87 | 22.05 | 262.74 |
| two times | 2.92 | fourth to fifth grade | third to fourth grade | 51.05 | −2.85 | −22.40 | 22.58 | 262.74 |
| five times | 2.99 | fourth to fifth grade | third to fourth grade | 50.71 | −2.9 | −22.42 | 22.6 | 262.64 |
| after dry-cleaned with dry-cleaning solvent composition B | | | | | | | | |
| one time | 3.07 | fourth to fifth grade | third to fourth grade | 50.21 | −2.67 | −22.52 | 22.67 | 262.23 |
| two times | 2.79 | fourth to fifth grade | third to fourth grade | 51.39 | −2.68 | −21.94 | 22.1 | 263.04 |
| five times | 3.34 | third to fourth grade | third to fourth grade | 49.43 | −2.76 | −23.13 | 23.3 | 263.2 |
| after dry-cleaned with dry-cleaning solvent composition C | | | | | | | | |
| one time | 3.01 | fourth grade | third grade | 50.53 | −2.75 | 22.55 | 22.71 | 263.18 |
| two times | 3.12 | third to fourth grade | third to fourth grade | 50.01 | −2.35 | −22.92 | 23.04 | 264.14 |
| five times | 2.95 | fifth grade | third to fourth grade | 51.01 | −2.72 | −22.89 | 23.05 | 263.22 |
| after dry-cleaned with dry-cleaning solvent composition D | | | | | | | | |
| one time | 3.03 | fourth grade | third to fourth grade | 50.33 | −2.55 | −22.44 | 22.59 | 263.52 |
| two times | 2.9 | third to fourth grade | third to fourth grade | 50.99 | −2.88 | −21.99 | 22.14 | 262.53 |
| five times | 2.93 | fourth to fifth grade | third to fourth grade | 50.72 | −2.46 | −22.48 | 22.64 | 263.75 |
| after dry-cleaned with dry-cleaning solvent composition E | | | | | | | | |
| one time | 3.04 | fourth grade | third to fourth grade | 50.34 | −2.55 | −22.65 | 22.8 | 263.57 |
| two times | 2.87 | fourth grade | third to fourth grade | 50.89 | −2.43 | −22.08 | 22.22 | 263.73 |
| five times | 3.05 | fourth grade | third to fourth grade | 50.45 | −2.68 | −22.82 | 22.98 | 263.29 |

TABLE 93

| the differences of the Lab values of the dyed fabric of polyester/rayon after dry-cleaned with a dry-cleaning solvent | | | | | | |
|---|---|---|---|---|---|---|
| polyester/rayon | ΔL | Δa | Δb | Δc | Δh | ΔE |
| after dry-cleaned with dry-cleaning solvent composition A | | | | | | |
| one time | −0.24 | 0.01 | 0.17 | −0.17 | −0.01 | 0.3 |
| two times | −0.31 | −0.11 | −0.46 | 0.47 | −0.05 | 0.56 |
| five times | 0.38 | −0.04 | −0.45 | 0.46 | 0.02 | 0.59 |
| after dry-cleaned with dry-cleaning solvent composition B | | | | | | |
| one time | −0.16 | −0.02 | 0.15 | −0.14 | −0.04 | 0.21 |
| two times | −0.28 | 0.02 | −0.41 | 0.4 | 0.07 | 0.5 |
| five times | −1.15 | −0.06 | −1.15 | 1.15 | 0.08 | 1.63 |

TABLE 93-continued

| the differences of the Lab values of the dyed fabric of polyester/rayon after dry-cleaned with a dry-cleaning solvent | | | | | | |
|---|---|---|---|---|---|---|
| polyester/rayon | ΔL | Δa | Δb | Δc | Δh | ΔE |
| after dry-cleaned with dry-cleaning solvent composition C | | | | | | |
| one time | 0.04 | −0.15 | −0.65 | 0.66 | −0.07 | 0.67 |
| two times | −0.85 | 0.63 | −0.76 | 0.69 | 0.71 | 1.3 |
| five times | 0.16 | 0.07 | −0.01 | 0.02 | −0.06 | 0.17 |
| after dry-cleaned with dry-cleaning solvent composition D | | | | | | |
| one time | −0.1 | 0.11 | 0.81 | −0.82 | 0.02 | 0.83 |
| two times | 0.43 | −0.56 | 1.13 | −1.24 | −0.7 | 1.49 |
| five times | 0.25 | −0.04 | 0.29 | −0.29 | −0.07 | 0.38 |
| after dry-cleaned with dry-cleaning solvent composition E | | | | | | |
| one time | −0.81 | −0.22 | −0.01 | 0.13 | −0.21 | 0.84 |
| two times | 0.06 | 0.13 | 0.97 | −0.98 | 0.02 | 0.98 |
| five times | 0.15 | −0.02 | −0.83 | 0.83 | 0.08 | 0.84 |

TABLE 94

| the K/S value, the grades of color change and pollution and the Lab values of the dyed fabric of polyester after dry-cleaned with a dry-cleaning solvent | | | | | | | | |
|---|---|---|---|---|---|---|---|---|
| polyester | K/S value | the grade of color change | the grade of pollution | L | a | b | c | h |
| after dry-cleaned with dry-cleaning solvent composition A | | | | | | | | |
| one time | 8.14 | fifth grade | third to fourth grade | 45.44 | −33.93 | 4.48 | 34.23 | 172.48 |
| two times | 7.74 | fourth to fifth grade | third to fourth grade | 46.4 | −34.29 | 4.41 | 34.57 | 172.67 |
| five times | 7.93 | fourth to fifth grade | third to fourth grade | 46.05 | −34.19 | 4.38 | 34.47 | 172.7 |
| after dry-cleaned with dry-cleaning solvent composition B | | | | | | | | |
| one time | 7.7 | fourth to fifth grade | third to fourth grade | 46.39 | −34.24 | 4.66 | 34.55 | 172.24 |
| two times | 7.67 | fourth to fifth grade | third to fourth grade | 46.65 | −34.32 | 4.72 | 34.66 | 172.17 |
| five times | 7.76 | fourth to fifth grade | third to fourth grade | 46.54 | −34.41 | 4.78 | 34.74 | 172.09 |
| after dry-cleaned with dry-cleaning solvent composition C | | | | | | | | |
| one time | 7.91 | fourth to fifth grade | third to fourth grade | 46.06 | −34.17 | 4.48 | 34.46 | 172.52 |
| two times | 7.6 | fourth to fifth grade | third to fourth grade | 46.4 | −33.93 | 4.67 | 34.25 | 172.16 |
| five times | 8.1 | fourth grade | third to fourth grade | 45.13 | −33.25 | 4.45 | 33.55 | 172.38 |
| after dry-cleaned with dry-cleaning solvent composition D | | | | | | | | |
| one time | 7.51 | fourth to fifth grade | third to fourth grade | 46.63 | −34.14 | 4.64 | 34.46 | 172.26 |
| two times | 7.7 | fifth grade | third to fourth grade | 46.19 | −33.82 | 4.61 | 34.14 | 172.25 |
| five times | 7.68 | fourth to fifth grade | third to fourth grade | 45.74 | −33.92 | 4.44 | 34.21 | 172.55 |
| after dry-cleaned with dry-cleaning solvent composition E | | | | | | | | |
| one time | 8.02 | fourth to fifth grade | third to fourth grade | 45.47 | −33.64 | 4.27 | 33.89 | 172.76 |
| two times | 8.09 | fifth grade | third to fourth grade | 45.24 | −33.35 | 4.24 | 33.62 | 172.75 |
| five times | 7.52 | fourth to fifth grade | third to fourth grade | 46.55 | −33.95 | 4.72 | 34.28 | 172.08 |

TABLE 95 the differences of the Lab values of the dyed fabric of polyester after dry-cleaned with a dry-cleaning solvent

| polyester | ΔL | Δa | Δb | Δc | Δh | ΔE |
|---|---|---|---|---|---|---|
| after dry-cleaned with dry-cleaning solvent composition A | | | | | | |
| one time | 0.01 | −0.12 | 0.1 | 0.13 | −0.08 | 0.16 |
| two times | 0.43 | −0.32 | −0.23 | 0.29 | 0.27 | 0.59 |
| five times | −0.2 | 0.13 | 0.14 | −0.11 | −0.16 | 0.28 |
| after dry-cleaned with dry-cleaning solvent composition B | | | | | | |
| one time | 0.42 | 0 | −0.07 | −0.01 | 0.07 | 0.42 |
| two times | −0.28 | −0.2 | 0.02 | 0.2 | 0 | 0.35 |
| five times | 0.22 | 0.35 | 0.03 | −0.35 | −0.08 | 0.42 |

TABLE 95-continued the differences of the Lab values of the dyed fabric of polyester after dry-cleaned with a dry-cleaning solvent

| polyester | ΔL | Δa | Δb | Δc | Δh | ΔE |
|---|---|---|---|---|---|---|
| after dry-cleaned with dry-cleaning solvent composition C | | | | | | |
| one time | −0.01 | −0.33 | −0.01 | 0.32 | 0.06 | 0.33 |
| two times | 0.23 | −0.15 | 0.13 | 0.17 | −0.11 | 0.3 |
| five times | −0.55 | 0.47 | 0.06 | −0.45 | −0.12 | 0.72 |
| after dry-cleaned with dry-cleaning solvent composition D | | | | | | |
| one time | 0.25 | −0.11 | 0.09 | 0.12 | −0.07 | 0.29 |
| two times | −0.16 | 0.04 | 0.01 | −0.04 | 0.02 | 0.16 |
| five times | 0.21 | −0.12 | 0.08 | 0.13 | −0.07 | 0.26 |
| after dry-cleaned with dry-cleaning solvent composition E | | | | | | |
| one time | −0.15 | 0.19 | 0.18 | −0.17 | −0.2 | 0.3 |
| two times | 0.1 | 0.13 | 0.06 | −0.12 | −0.08 | 0.18 |
| five times | 0.46 | −0.07 | 0.07 | 0.08 | −0.06 | 0.47 |

TABLE 96 the K/S value, the grades of color change and pollution and the Lab values of the dyed fabric of wool after dry-cleaned with a dry-cleaning solvent

| polyester | K/S value | the grade of color change | the grade of pollution | L | a | b | c | h |
|---|---|---|---|---|---|---|---|---|
| after dry-cleaned with dry-cleaning solvent composition A | | | | | | | | |
| one time | 8.65 | third to fourth grade | third to fourth grade | 33.16 | −8 | 5.54 | 9.74 | 145.29 |
| two times | 8.36 | fourth grade | third to fourth grade | 33.49 | −8.05 | 5.61 | 9.81 | 145.1 |
| five times | 8.85 | fifth grade | third to fourth grade | 32.48 | −7.57 | 5.17 | 9.17 | 145.67 |
| after dry-cleaned with dry-cleaning solvent composition B | | | | | | | | |
| one time | 8.8 | fifth grade | third to fourth grade | 32.96 | −7.71 | 5.64 | 9.55 | 143.78 |
| two times | 8.67 | fourth to fifth grade | third to fourth grade | 33.05 | −7.76 | 5.4 | 9.46 | 145.17 |
| five times | 8.33 | fourth grade | third to fourth grade | 33.32 | −8.06 | 5.44 | 9.72 | 145.96 |
| after dry-cleaned with dry-cleaning solvent composition C | | | | | | | | |
| one time | 8.78 | fourth to fifth grade | third to fourth grade | 32.71 | −7.79 | 5.58 | 9.59 | 144.41 |
| two times | 8.87 | fourth to fifth grade | third to fourth grade | 32.74 | −7.57 | 5.45 | 9.33 | 144.27 |
| five times | 8.91 | fourth to fifth grade | third to fourth grade | 32.71 | −7.42 | 5.31 | 9.12 | 144.41 |
| after dry-cleaned with dry-cleaning solvent composition D | | | | | | | | |
| one time | 8.62 | fourth to fifth grade | third to fourth grade | 33.32 | −7.58 | 5.86 | 9.59 | 142.3 |
| two times | 8.57 | fourth to fifth grade | third to fourth grade | 33.15 | −7.51 | 5.49 | 9.3 | 143.85 |
| five times | 8.87 | fourth to fifth grade | third to fourth grade | 32.82 | −7.47 | 5.45 | 9.25 | 143.92 |
| after dry-cleaned with dry-cleaning solvent composition E | | | | | | | | |
| one time | 8.6 | fourth grade | third to fourth grade | 32.92 | −7.43 | 5.25 | 9.1 | 143.73 |
| two times | 8.89 | fourth to fifth grade | third to fourth grade | 32.71 | −7.39 | 5.3 | 9.09 | 143.36 |
| five times | 8.85 | third to fourth grade | third to fourth grade | 33.04 | −7.49 | 5.16 | 9.09 | 145.42 |

TABLE 97 the differences of the Lab values of the dyed fabric of wool after dry-cleaned with a dry-cleaning solvent

| wool | ΔL | Δa | Δb | Δc | Δh | ΔE |
|---|---|---|---|---|---|---|
| after dry-cleaned with dry-cleaning solvent composition A | | | | | | |
| one time | 1.1 | 0.01 | −0.29 | −0.17 | 0.23 | 1.14 |
| two times | 0.75 | 0 | −0.11 | −0.06 | 0.09 | 0.75 |
| five times | 0.01 | 0.1 | −0.05 | −0.11 | −0.02 | 0.12 |
| after dry-cleaned with dry-cleaning solvent composition B | | | | | | |
| one time | −0.13 | 0.1 | −0.03 | −0.1 | −0.04 | 0.17 |
| two times | 0.47 | −0.01 | −0.15 | −0.08 | 0.13 | 0.49 |
| five times | 0.48 | −0.55 | 0.16 | 0.54 | 0.18 | 0.75 |

TABLE 97-continued the differences of the Lab values of the dyed fabric of wool after dry-cleaned with a dry-cleaning solvent

| wool | ΔL | Δa | Δb | Δc | Δh | ΔE |
|---|---|---|---|---|---|---|
| after dry-cleaned with dry-cleaning solvent composition C | | | | | | |
| one time | 0.2 | 0.02 | −0.06 | −0.05 | 0.04 | 0.21 |
| two times | 0.5 | 0.03 | 0.12 | 0.04 | 0.11 | 0.51 |
| five times | 0.23 | 0.25 | −0.43 | −0.45 | 0.19 | 0.54 |
| after dry-cleaned with dry-cleaning solvent composition D | | | | | | |
| one time | 0.47 | 0.04 | 0.37 | 0.19 | −0.32 | 0.6 |
| two times | 0.42 | 0.07 | 0.43 | 0.31 | −0.32 | 0.61 |
| five times | 0.52 | 0.15 | 0.13 | −0.05 | −0.19 | 0.55 |
| after dry-cleaned with dry-cleaning solvent composition E | | | | | | |
| one time | 0.69 | 0.25 | −0.16 | −0.29 | −0.01 | 0.75 |
| two times | 0.38 | 0.04 | 0.28 | 0.13 | −0.25 | 0.47 |
| five times | 1.14 | 0.04 | 0.12 | 0.03 | −0.13 | 1.15 |

TABLE 98 the K/S value, the grades of color change and pollution and the Lab values of the dyed fabric of polyester/rayon after dry-cleaned with a dry-cleaning solvent

| polyester | K/S value | the grade of color change | the grade of pollution | L | a | b | c | h |
|---|---|---|---|---|---|---|---|---|
| after dry-cleaned with dry-cleaning solvent composition A | | | | | | | | |
| one time | 2.96 | fifth grade | third to fourth grade | 50.7 | −2.59 | −22.27 | 22.42 | 263.37 |
| two times | 3.02 | fifth grade | third to fourth grade | 50.48 | −2.93 | −21.90 | 22.1 | 262.39 |
| five times | 2.78 | fourth grade | third to fourth grade | 51.59 | −3.2 | −21.42 | 21.66 | 261.51 |
| after dry-cleaned with dry-cleaning solvent composition B | | | | | | | | |
| one time | 2.8 | fourth to fifth grade | third to fourth grade | 51.28 | −2.8 | −21.48 | 21.66 | 262.58 |
| two times | 3.03 | fourth to fifth grade | third to fourth grade | 50.61 | −3.18 | −22.18 | 22.41 | 261.85 |
| five times | 3.02 | fourth grade | third to fourth grade | 50.47 | −3.07 | −21.83 | 22.05 | 261.99 |
| after dry-cleaned with dry-cleaning solvent composition C | | | | | | | | |
| one time | 2.91 | fourth to fifth grade | third to fourth grade | 51.01 | −2.77 | −22.30 | 22.47 | 261.92 |
| two times | 2.95 | fourth to fifth grade | third to fourth grade | 50.63 | −2.74 | −21.96 | 22.13 | 262.89 |
| five times | 3.06 | fourth grade | third to fourth grade | 50.21 | −2.81 | −22.19 | 22.37 | 262.79 |
| after dry-cleaned with dry-cleaning solvent composition D | | | | | | | | |
| one time | 2.96 | fourth to fifth grade | third to fourth grade | 50.72 | −3 | −21.93 | 22.14 | 262.22 |
| two times | 2.9 | fourth to fifth grade | third to fourth grade | 51.05 | −3 | −21.94 | 22.14 | 262.21 |
| five times | 2.99 | third to fourth grade | third to fourth grade | 50.34 | −2.89 | −21.51 | 21.7 | 262.35 |
| after dry-cleaned with dry-cleaning solvent composition E | | | | | | | | |
| one time | 3.03 | fourth to fifth grade | third to fourth grade | 50.41 | −2.71 | −22.46 | 22.63 | 263.11 |
| two times | 3.02 | fourth to fifth grade | third to fourth grade | 50.48 | −2.75 | −22.46 | 22.62 | 263.01 |
| five times | 2.92 | fourth grade | third to fourth grade | 50.93 | −2.98 | −21.97 | 22.17 | 262.67 |

TABLE 99

| the differences of the Lab values of the dyed fabric of polyester/rayon after dry-cleaned with a dry-cleaning solvent | | | | | | |
|---|---|---|---|---|---|---|
| polyester/rayon | ΔL | Δa | Δb | Δc | Δh | ΔE |
| after dry-cleaned with dry-cleaning solvent composition A | | | | | | |
| one time | −0.17 | −0.18 | 0.11 | −0.09 | −0.19 | 0.27 |
| two times | −0.02 | −0.25 | 0.16 | −0.13 | −0.27 | 0.3 |
| five times | 0.31 | −0.37 | 0.93 | −0.87 | −0.49 | 1.05 |
| after dry-cleaned with dry-cleaning solvent composition B | | | | | | |
| one time | 0.26 | −0.18 | 0.45 | −0.42 | −0.23 | 0.55 |
| two times | −0.56 | −0.18 | 0.02 | 0.01 | −0.18 | 0.59 |
| five times | −0.61 | −0.33 | 0.49 | −0.44 | −0.39 | 0.85 |

TABLE 99-continued

| the differences of the Lab values of the dyed fabric of polyester/rayon after dry-cleaned with a dry-cleaning solvent | | | | | | |
|---|---|---|---|---|---|---|
| polyester/rayon | ΔL | Δa | Δb | Δc | Δh | ΔE |
| after dry-cleaned with dry-cleaning solvent composition C | | | | | | |
| one time | −0.24 | −0.18 | −0.12 | 0.14 | −0.16 | 0.32 |
| two times | −0.45 | −0.31 | 0.31 | −0.27 | −0.35 | 0.63 |
| five times | −0.52 | −0.2 | 0.54 | −0.51 | −0.26 | 0.77 |
| after dry-cleaned with dry-cleaning solvent composition D | | | | | | |
| one time | −0.26 | −0.39 | −0.23 | 0.28 | −0.36 | 0.52 |
| two times | 0.27 | −0.2 | 0.03 | 0 | −0.2 | 0.33 |
| five times | 0.09 | −0.26 | 1.59 | −1.55 | −0.45 | 1.61 |
| after dry-cleaned with dry-cleaning solvent composition E | | | | | | |
| one time | −0.47 | −0.28 | 0.27 | −0.23 | 0.31 | 0.61 |
| two times | −0.42 | −0.25 | 0.18 | −0.14 | −0.27 | 0.52 |
| five times | 0.86 | −0.32 | 0.38 | −0.34 | −0.36 | 0.99 |

TABLE 100

| the K/S value, the grades of color change and pollution and the Lab values of the dyed fabric of polyester after dry-cleaned with a dry-cleaning solvent | | | | | | | | |
|---|---|---|---|---|---|---|---|---|
| polyester | K/S value | the grade of color change | the grade of pollution | L | a | b | c | h |
| after dry-cleaned with dry-cleaning solvent composition A | | | | | | | | |
| one time | 8.33 | fourth grade | third to fourth grade | 44.12 | −31.66 | 3.67 | 31.87 | 173.38 |
| two times | 7.68 | fourth grade | third to fourth grade | 45.6 | −32.27 | 3.98 | 32.51 | 172.97 |
| five times | 7.66 | fourth to fifth grade | third to fourth grade | 45.89 | −32.66 | 4.31 | 32.94 | 172.47 |
| after dry-cleaned with dry-cleaning solvent composition B | | | | | | | | |
| one time | 7.34 | fourth to fifth grade | third to fourth grade | 46.45 | −32.90 | 4.43 | 33.2 | 172.32 |
| two times | 7.38 | fourth grade | third to fourth grade | 46.38 | −32.84 | 4.68 | 33.18 | 171.89 |
| five times | 7.64 | third to fourth grade | third to fourth grade | 45.77 | −32.47 | 4.63 | 32.8 | 171.88 |
| after dry-cleaned with dry-cleaning solvent composition C | | | | | | | | |
| one time | 7.73 | third to fourth grade | third to fourth grade | 45.79 | −32.78 | 4 | 33.02 | 173.03 |
| two times | 7.63 | fourth grade | third to fourth grade | 45.62 | −32.18 | 4.4 | 32.48 | 172.21 |
| five times | 8.17 | fourth grade | third to fourth grade | 44.97 | −32.63 | 4.3 | 32.92 | 172.5 |
| after dry-cleaned with dry-cleaning solvent composition D | | | | | | | | |
| one time | 7.43 | third to fourth grade | third to fourth grade | 46.16 | −32.49 | 4.15 | 32.75 | 172.73 |
| two times | 7.9 | third to fourth grade | third grade | 45.21 | −32.48 | 4.12 | 32.74 | 172.76 |
| five times | 7.7 | fourth to fifth grade | third to fourth grade | 45.43 | −32.24 | 4.22 | 32.52 | 172.54 |
| after dry-cleaned with dry-cleaning solvent composition E | | | | | | | | |
| one time | 8.03 | fourth to fifth grade | third to fourth grade | 45.14 | −32.47 | 3.96 | 32.71 | 173.05 |
| two times | 8.22 | fourth to fifth grade | third to fourth grade | 44.62 | −32.17 | 3.68 | 32.38 | 173.47 |
| five times | 7.7 | fourth to fifth grade | third to fourth grade | 45.69 | −32.65 | 4.46 | 32.96 | 172.72 |

TABLE 101

| the differences of the Lab values of the dyed fabric of polyester after dry-cleaned with a dry-cleaned solvent | | | | | | |
|---|---|---|---|---|---|---|
| polyester | ΔL | Δa | Δb | Δc | Δh | ΔE |
| after dry-cleaned with dry-cleaning solvent composition A | | | | | | |
| one time | −0.75 | 0.04 | −0.16 | 0.02 | 0.16 | 0.77 |
| two times | −0.48 | 0.66 | −0.26 | −0.68 | 0.18 | 0.86 |
| five times | 0.17 | −0.43 | 0.33 | 0.47 | −0.28 | 0.57 |
| after dry-cleaned with dry-cleaning solvent composition B | | | | | | |
| one time | 0.03 | −0.29 | −0.07 | 0.28 | 0.1 | 0.3 |
| two times | −0.59 | −0.24 | 0.01 | 0.24 | 0.02 | 0.63 |
| five times | 0.33 | −1.05 | 0.31 | 1.08 | −0.16 | 1.14 |
| after dry-cleaned with dry-cleaning solvent composition C | | | | | | |
| one time | 0.3 | −1.02 | −0.1 | 1 | 0.22 | 1.06 |
| two times | −0.13 | −0.87 | 0.28 | 0.9 | −0.16 | 0.92 |
| five times | −0.45 | −0.38 | 0.29 | 0.42 | −0.24 | 0.66 |
| after dry-cleaned with dry-cleaning solvent composition D | | | | | | |
| one time | −0.22 | 1.54 | −0.41 | −1.58 | 0.2 | 1.61 |
| two times | −0.38 | −0.95 | 0.15 | 0.96 | −0.03 | 1.04 |
| five times | −0.1 | −0.38 | 0.07 | 0.39 | −0.02 | 0.4 |
| after dry-cleaned with dry-cleaning solvent composition E | | | | | | |
| one time | −0.39 | −0.11 | 0.08 | 0.12 | −0.07 | 0.41 |
| two times | −0.02 | −0.58 | 0.64 | 0.58 | 0.03 | 0.58 |
| five times | −0.34 | −0.4 | 0.2 | 0.42 | −0.14 | 0.56 |

What is claimed is:

1. A dry-cleaning solvent composition, comprising about 30 wt % of propylene glycol methyl ether propionate, and a solvent, and said solvent is perchloroethylene, or stoddard solvent type I, or stoddard solvent type II, and being about 70 wt % of the composition.

2. A dry-cleaning solvent composition, comprising about 70 wt % of propylene glycol methyl ether propionate, and a solvent, and said solvent is perchloroethylene, or stoddard solvent type I, or stoddard solvent type II, and being about 30 wt % of the composition.

3. A dry-cleaning solvent composition, comprising about 30 wt % of propylene glycol methyl ether acetate, and a solvent, and said solvent is perchloroethylene, Stoddard solvent type I or Stoddard solvent type II in an amount of about 70 wt % of the composition.

4. A dry-cleaning solvent composition, comprising about 70 wt % of propylene glycol methyl ether acetate, and a solvent, and said solvent is perchloroethylene, Stoddard solvent type I or Stoddard solvent type I in an amount of about 30 wt % of the composition.

* * * * *